US006450734B1

(12) United States Patent
Kuja et al.

(10) Patent No.: US 6,450,734 B1
(45) Date of Patent: Sep. 17, 2002

(54) TRANSPORTATION UNDERWATER TUNNEL SYSTEM

(76) Inventors: Michael W. Kuja, 4 Stonecliff Dr., Niantic, CT (US) 06357; Thomas M. Coletti, 69 Plain Hill Rd., Baltic, CT (US) 06330

( * ) Notice: Subject to any disclaimer, the term of this patent is extended or adjusted under 35 U.S.C. 154(b) by 0 days.

(21) Appl. No.: 09/241,698

(22) Filed: Feb. 2, 1999

Related U.S. Application Data

(62) Division of application No. 08/853,824, filed on May 9, 1997, now Pat. No. 5,899,635.

(51) Int. Cl.[7] ..... E02D 29/063; E02D 29/00
(52) U.S. Cl. ..... 405/136; 405/134; 405/135
(58) Field of Search ..... 405/136, 134, 405/135, 137, 132, 151, 152, 153

(56) References Cited

U.S. PATENT DOCUMENTS

| | | | | | |
|---|---|---|---|---|---|
| 244,752 | A | | 7/1881 | Hunter et al. | 405/154 |
| 375,464 | A | | 12/1887 | Thacher et al. | 405/171 |
| 485,983 | A | | 11/1892 | Powell | |
| 612,485 | A | | 10/1898 | Conover | 405/170 |
| 629,133 | A | * | 7/1899 | Knight et al. | 405/135 |
| 629,135 | A | * | 7/1899 | Nixon et al. | 405/135 |
| 1,050,320 | A | | 1/1913 | Williams | 405/135 |
| 1,060,271 | A | | 4/1913 | McBean et al. | |
| 1,329,317 | A | * | 1/1920 | Williams | 405/136 |
| 1,363,115 | A | * | 12/1920 | Helfrich | 405/136 |
| 1,946,389 | A | | 2/1934 | Christiansen | 61/63 |
| 2,770,950 | A | | 11/1956 | Collins | 61/72 |
| 3,086,369 | A | | 4/1963 | Brown | 61/72.3 |
| 3,425,453 | A | | 2/1969 | Fuller | 138/111 |
| 3,478,521 | A | | 11/1969 | Petrik | 61/43 |
| 3,479,831 | A | | 11/1969 | Teague, Jr. | 61/72.3 |
| 3,568,456 | A | | 3/1971 | Van Loenen | 61/72.6 |
| 3,795,115 | A | | 3/1974 | Bergquist et al. | 61/72.3 |
| 3,835,656 | A | | 9/1974 | McDermott | 61/72.3 |
| 3,849,821 | A | | 11/1974 | Arild et al. | 14/27 |
| 3,893,304 | A | | 7/1975 | Pochitaloff-Huvale et al. | 61/46 |
| 3,901,038 | A | | 8/1975 | Olsen | 61/43 |
| 3,977,201 | A | | 8/1976 | Bittner | 61/112 |
| 4,028,903 | A | | 6/1977 | Dietrich | 61/110 |
| 4,076,130 | A | | 2/1978 | Sumner | 214/1 PA |
| 4,120,168 | A | | 10/1978 | Lamy | 405/170 |
| 4,165,196 | A | | 8/1979 | Serrano | 405/205 |
| 4,171,175 | A | | 10/1979 | Nobileau et al. | 405/170 |
| 4,183,697 | A | | 1/1980 | Lamy | 405/170 |
| 4,360,290 | A | | 11/1982 | Ward | 405/170 |
| 4,406,150 | A | * | 9/1983 | Schneider et al. | 405/136 |
| 4,406,151 | A | | 9/1983 | Simonsen et al. | 72/478 |

(List continued on next page.)

FOREIGN PATENT DOCUMENTS

| | | | | |
|---|---|---|---|---|
| JP | 35193 | * | 2/1990 | 405/136 |

*Primary Examiner*—Heather Shackelford
*Assistant Examiner*—Frederick L. Lagman
(74) *Attorney, Agent, or Firm*—Albert W. Hilburger

(57) ABSTRACT

An underwater tunnel system for vehicular traffic flow, including rail, automobile and truck traffic connecting the shores of opposed land masses separated by a body of water draws heavily from submarine manufacturing and modular construction technology. It is environmentally benign and will not adversely dominate the skyline of the surrounding region. The system of the invention requires minimal, if any, dredging to insure its substantially level installation. A compensating ducting and valve system is utilized for initial tunnel submergence during construction and to provide dynamic stability subsequently during operation. Part of the ducting system utilized during submergence operations is also subsequently used for ventilation airflow throughout the tunnel system during operation. During operation, fresh air is introduced from both shores into the tunnel system and exhaust air may be selectively discharged at both shores or from the tunnel system at a location distant from both shores.

46 Claims, 33 Drawing Sheets

U.S. PATENT DOCUMENTS

| | | | | |
|---|---|---|---|---|
| 4,459,065 | A | 7/1984 | Morton | 405/169 |
| 4,465,400 | A | 8/1984 | Adams | 405/170 |
| 4,468,155 | A | 8/1984 | Levallois et al. | 405/170 |
| 4,712,946 | A | 12/1987 | Greatorex et al. | 405/170 |
| 4,778,306 | A | 10/1988 | Anselmi et al. | 405/171 |
| 4,832,530 | A | 5/1989 | Anderson et al. | 405/170 |
| 4,892,442 | A | 1/1990 | Shoffner | 405/154 |
| 5,004,017 | A | 4/1991 | White | 138/106 |
| 5,044,825 | A | 9/1991 | Kaldenbach | 405/166 |
| 5,362,921 | A | 11/1994 | Birkelund et al. | 174/47 |
| 5,899,635 | A * | 5/1999 | Kuja et al. | 405/136 |

* cited by examiner 44
46A
52
46
50
48
54
58
56
60
61
62
64
66
68
70
72

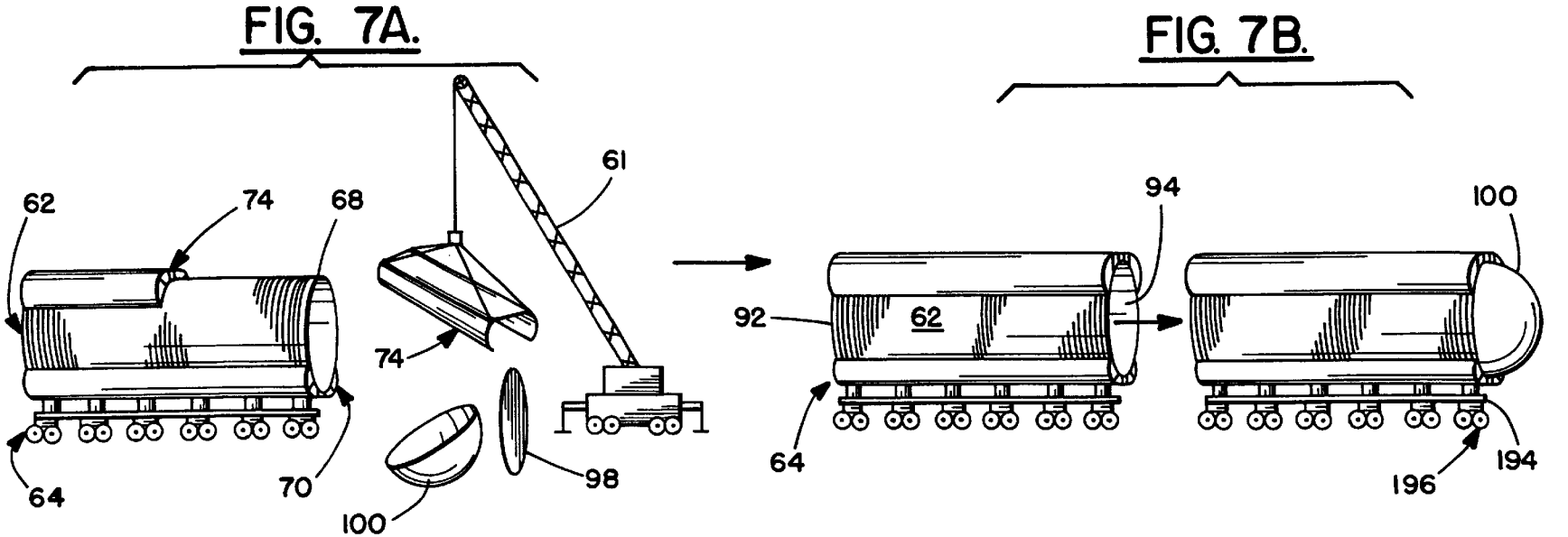
FIG. 7B.
FIG. 7A.
100
194
196
94
62
92
64
61
98
74
100
68
70
74
62
64
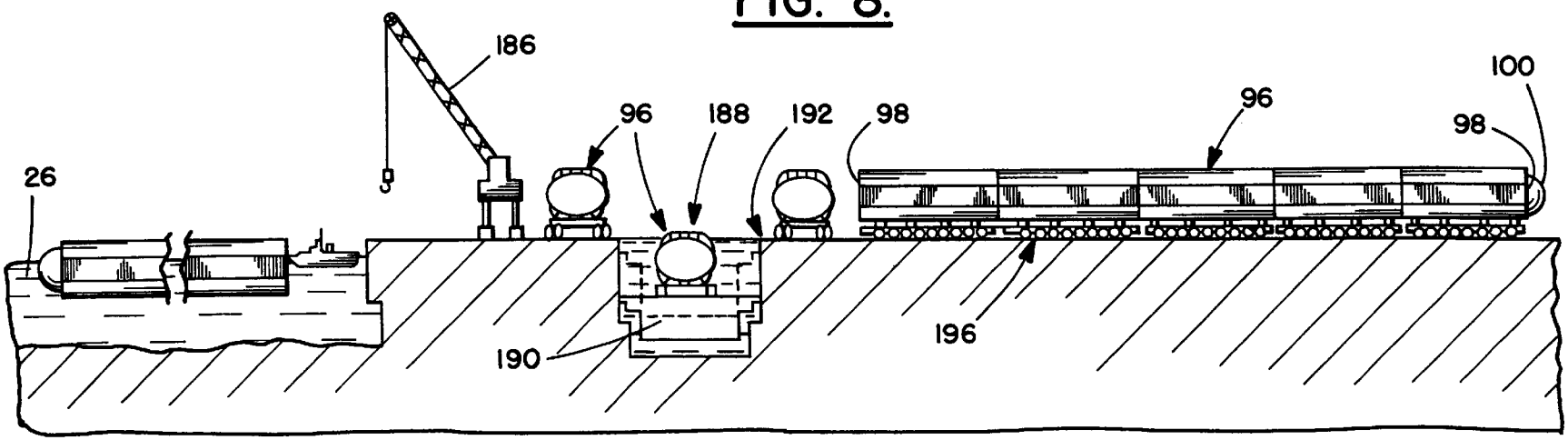
FIG. 8.
100
98
96
196
98
192
188
96
190
186
26

FIG. 35.
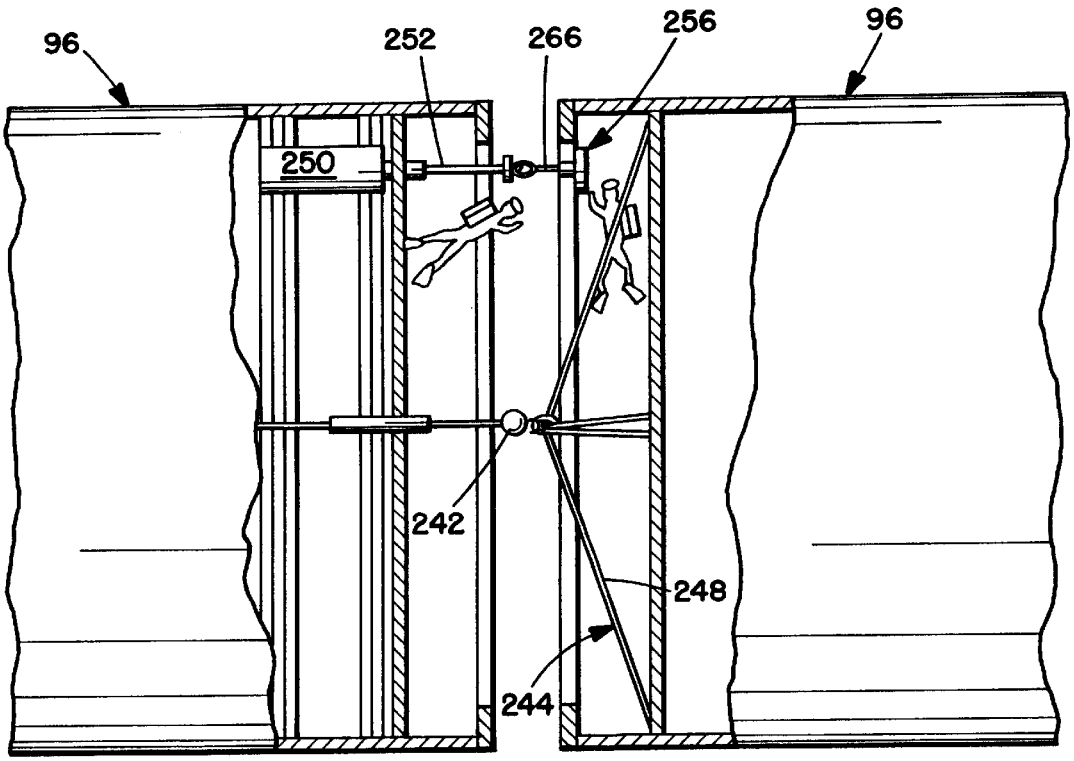
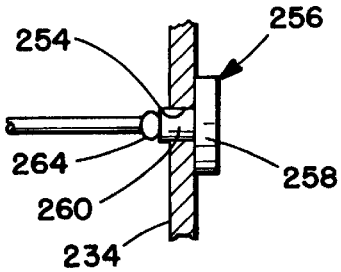
FIG. 35A.
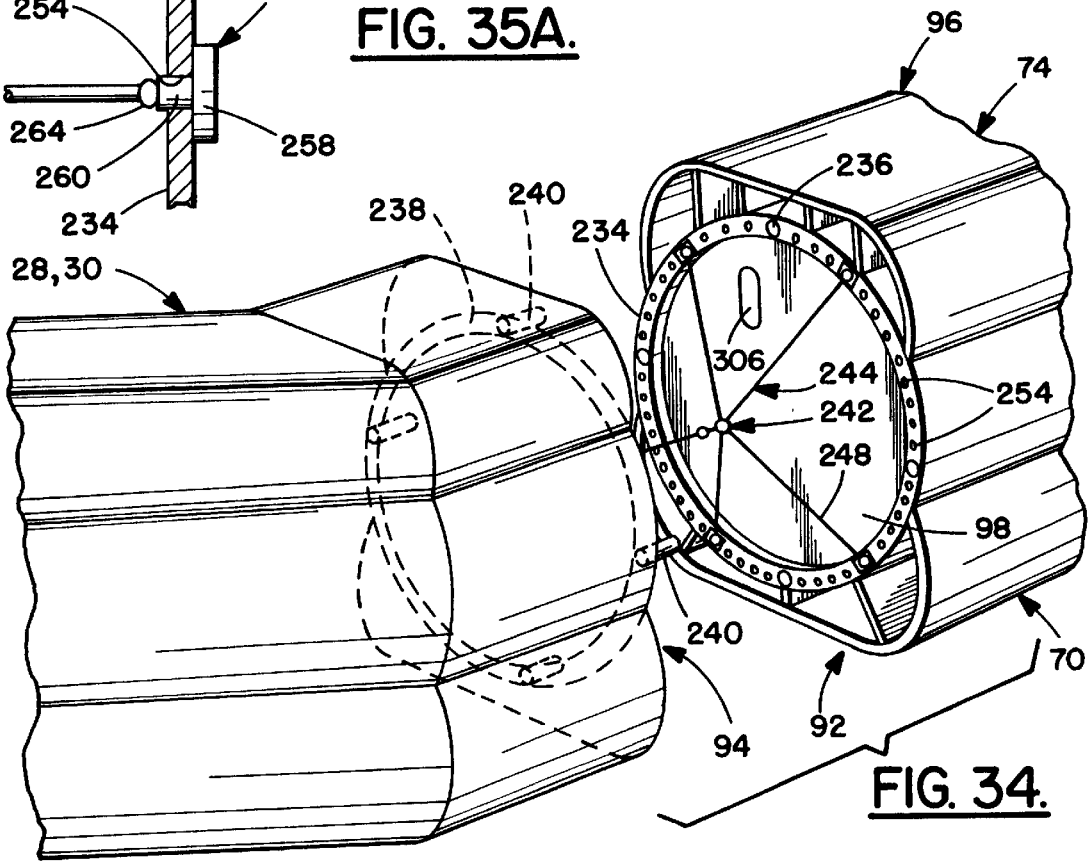
FIG. 34.

TRANSPORTATION UNDERWATER TUNNEL SYSTEM

This application is a divisional of application Ser. No. 08/853,824 filed on May 9, 1997, now U.S. Pat. No. 5,899,635.

BACKGROUND OF THE INVENTION

1. Field of the Invention

This invention relates generally to an underwater tunnel system for vehicular traffic flow, including rail, automobile and truck traffic and, more specifically, to a submerged floating tunnel system of modular construction which utilizes submarine technology to provide specific and adjustable buoyancy capabilities.

2. Description of the Prior Art

The prior art, comprising known or existing techniques for connecting two land masses, includes bridges and tunnels.

As a means of traversing a body of water between two land masses, bridge construction presents several major problems. Because bridge construction is performed substantially (about 95%) on site, delays and cost overruns are common, being subject to seasonal changes and inclement weather. In addition, the average construction time (including design) of a conventional bridge is five to seven years. Once in place, conventional bridges possess several characteristics which also present difficulty. Exposure to weather and the elements requires constant examination and continuous maintenance efforts. In addition, the same weather factors which hinder construction and shorten the life span of the resulting structure also adversely affect traffic conditions. Finally, conventional bridges can have significant environmental impact as well as degrading the scenery or skyline of the surrounding land mass areas.

Currently, underwater tunnels also contain serious flaws and weaknesses in both their design and technique of construction. Conventional tunnels require extensive boring beneath the seabed, riverbed, or the like. This is a process which results in both substantially lengthening the construction period and substantially increasing costs. Furthermore, the extensive boring required in the construction of conventional tunnels also can have negative effects on the surrounding marine environment.

While submerged and prefabricated tunnels already exist, these systems are not without flaws. Through this invention, both existing tunnel technology and design will be improved upon substantially. Presently, submerged tunnels utilize concrete tubes which, although about 60% prefabricated, require substantial on-site work. The prefabricated tubes used in concrete tunnels employ relatively short 300 foot sections. In order to build and install a concrete submerged tunnel on the floor of the body of water being traversed, additional concrete pours (above the waterline) are required to create the negative buoyancy necessary to submerge and lower these tube sections under the control of barge cranes. Extensive dredging is also required in order to produce the level of prescribed foundation to effectively join these tube sections together.

Finally, and most importantly, once a concrete tunnel of known design, is permanently weighted down with additional concrete in order to overcome positive buoyancy, repairs to the tunnel become difficult. Due to the permanent nature of the structure, maintenance and repair work can only be accomplished on site and underwater.

Numerous patents exist which are representative of a variety of fields of invention which must be considered when considering solutions to the problem being addressed by the inventors.

For example, U.S. Pat. No. 3,849,821 issued Nov. 26, 1974 to Arild et al. and U.S. Pat. No. 3,478,521 issued Nov. 18, 1969 to Petrik, disclose submerged tunnel bridges assembled underwater from prefabricated concrete modules.

U.S. Pat. No. 4,406,151 issued Sep. 27, 1983 to Simonsen et al., U.S. Pat. No. 4,165,196 issued Aug. 21, 1979 to Serrano, and U.S. Pat. No. 3,893,304 issued Jul. 8, 1975 to Pochitaloff-Huvale all disclose the fabrication of underwater structures.

U.S. Pat. No. 5,362,921 issued Nov. 8, 1994 to Birkelund et al., U.S. Pat. No. 4,892,442 issued Jan. 9, 1990 to Shoffner, U.S. Pat. No. 2,770,950 issued Nov. 20, 1956 to Collins, and U.S. Pat. No. 244,752 issued Jul. 26, 1881 to Hunter et al. all disclose various underwater cable constructions and techniques for their installation.

Numerous U.S. patents disclose the laying of underwater pipeline, of which the following are exemplary:

| U.S. Pat. No. | Inventor(s) | Issue Date |
|---|---|---|
| 5,044,825 | Kaldenbach | 09/03/91 |
| 4,778,306 | Anselmi et al. | 10/18/88 |
| 4,712,946 | Greatorex | 12/15/87 |
| 4,465,400 | Adams | 08/14/84 |
| 4,459,065 | Morton | 07/10/84 |
| 4,360,290 | Ward | 11/23/82 |
| 4,183,697 | Lamy | 01/15/80 |
| 4,120,168 | Lamy | 10/17/78 |
| 4,028,903 | Dietrich | 06/14/77 |
| 3,977,201 | Bittner | 08/31/76 |
| 3,835,656 | McDermott | 09/17/74 |
| 3,568,456 | Van Loenen | 03/09/71 |
| 3,479,831 | Teague, Jr. | 11/25/69 |
| 3,425,453 | Fuller | 02/04/69 |
| 3,086,369 | Brown | 04/23/63 |
| 1,946,389 | Christiansen | 02/06/34 |
| 612,485 | Conover | 10/18/1898 |

In a similar fashion, the following U.S. patents disclose methods and apparatus for joining pipe sections underwater:

| U.S. Pat. No. | Inventor(s) | Issue Date |
|---|---|---|
| 5,004,017 | White | 04/02/91 |
| 4,832,530 | Andersen et al. | 05/23/89 |
| 4,468,155 | Levallois et al. | 08/28/84 |
| 4,171,175 | Nobileau et al. | 10/16/79 |
| 4,076,130 | Sumner | 02/28/78 |
| 3,795,115 | Bergquist et al. | 03/05/74 |
| 375,464 | Thacher et al. | 12/27/1887 |

It was in light of the foregoing and the inventors' expertise in submarine construction and design that the present invention was conceived and has now been reduced to practice.

SUMMARY OF THE INVENTION

The present invention relates to an underwater tunnel system for vehicular, including rail, traffic connecting the shores of opposed land masses separated by a body of water. The invention draws heavily from submarine manufacturing and modular construction technology. It is environmentally benign and will not adversely dominate the skyline of the surrounding region. The system of the invention requires minimal, if any, dredging to insure its substantially level installation. A compensating ducting, piping and valve system is utilized for initial tunnel submergence during construction and to provide dynamic stability subsequently during operation. Part of the ducting system utilized during submergence operations is also subsequently used for ventilation air flow throughout the tunnel system during operation. During operation, fresh air is introduced from both shores into the tunnel system and exhaust air may be selectively discharged at both shores or from the tunnel system at locations distant from both shores.

It will be understood that the specific design parameters for constructing a Transportation Underwater Tunnel System (TUTS) in accordance with the present invention will vary with each specific project location. For example, it will be necessary for the project engineer to calculate and design the length of the tunnel and its desired width to accommodate optimum traffic conditions. Furthermore, the project engineer will have to determine the desired depth of the tunnel dependent upon the type of ship channel depth constraints. A tunnel marker buoy may be used to indicate the location of the inclined tunnel sections adjacent to both land masses. This tunnel marker will provide guidance for marine vessels passing above the tunnel, through the body of water, taking into account the tidal changes.

As stated above, each of these specific design parameters, as well as others, may be different for each individual project. However, one ordinarily skilled and reasonably competent in this particular art would readily understand how this design functions and could construct a Transportation Underwater Tunnel System in accordance with the present invention. According to the invention, there are three (3) basic tunnel configuration options or combinations that can be constructed and installed based upon tunnel size (number of traffic lanes), geographical and geological conditions and the marine environment to properly locate a specific tunnel configuration, as follows:

Type I—Shallow Water Elongated Tunnel (approximate depth of 40 feet to 60 feet)

Type II—Shallow Depth Cylindrical or Elongated Tunnel (approximate depth of 50 feet to 100 feet)

Type III—Open Depth Cylindrical Tunnel (approximate depth of 70 feet or greater)

In each instance, the depth indicated is the depth to the cylinder top centerline of the cylinder at mean low water level.

The following are typical characteristics of the Type I (Shallow Water Elongated) tunnel configuration:

(1) approximate depth: 40 feet to 60 feet (2) extensive dredging (3) concrete support pads to set designated depth (4) controlled buoyancy to position cylinders only (lower to depth)

(5) temporary and permanent weighting (lead/concrete) for stability (6) external and/or internal tank ballast/compensating configuration (7) double hull plating topside configuration (optional)

(8) no active operational buoyancy systems.

The following are typical characteristics of the Type II (Shallow-Depth Cylindrical or Elongated) tunnel configuration:

(1) approximate depth: 50 feet to 100 feet (2) limited dredging (3) concrete support pads to set designated depth (4) limited controlled buoyancy operations (less than about 25%)

(5) temporary and permanent weighting, (lead/concrete) for stability (6) external and/or internal tank ballast/compensating configuration (7) double hull plating topside configuration (optional)

(8) restricted active operational buoyancy systems.

The following are typical characteristics of the Type III (Open-Depth Cylindrical) tunnel configuration:

(1) approximate depth: 70 feet to 150 feet (2) minimum dredging (3) land transition set designated depth of inclined tubular tunnel sections (4) maintains prescribed depth tolerance by using controlled buoyancy system equipment operation (5) permanent weighting (lead/concrete) for buoyancy stability and depth control requirements (6) external and/or internal tank ballast/compensating configuration (7) full double hull configuration (optional)

(8) controlled buoyancy/depth monitored cylinder alignment/structural integrity.

Accordingly, a primary feature of the present invention is the provision of an improved system for connecting two land masses which are separated by a body of water.

Another feature of the present invention is the provision of such a system which will connect two land masses, and which is substantially prefabricated, at least about 85% complete, and which is of modular construction to thereby reduce costs and time of installation.

A further feature of the present invention is the provision of such a modular construction technique according to which prefabricated tubular tunnel sections are fabricated at an off-site location, then transported to the site already equipped with roadways, tank structure, piping, ventilation, electrical and auxiliary support subsystems in place except for the predetermined join areas for these subsystems.

Still another feature of the invention is to provide such a structure for traversing a body of water between two land masses which is 85% prefabricated at a separately controlled facility and will not subject the construction process to the delays resulting from inclement weather.

Yet a further feature of the present invention is to provide such a structure for traversing a body of water between two land masses which is 85% prefabricated at a separate facility and will significantly reduce total construction and installation time, including design because of its simplicity and repetitive end product definition.

Yet another feature of the invention is to provide such a structure for traversing a body of water between two land masses which is not open and exposed to the surface elements and to adverse weather conditions.

Still a further feature of the present invention is to provide such an underwater tunnel system which utilizes a steel hull similar to that utilized in the construction of submarines and which will provide a proven ability to withstand the surface elements and marine environmental elements.

Yet a further feature of the present invention is to provide such an underwater tunnel system designed to have a life span of no less than at least 75 to 100 years.

Still another feature of the present invention is the provision of such an underwater tunnel system which enables the traversing of a body of water between two land masses while not adversely dominating the skyline and without being detrimental to the surrounding scenery and environment.

Still a further feature of the present invention is the provision of such an underwater tunnel system which does not require extensive dredging of the seabed or riverbed area subterrain in order to properly construct and install it on a somewhat level setting.

Another feature of the present invention is the provision of such an underwater tunnel system which utilizes automatically controlled and adjustable buoyancy conditions at various depths. To this end, a compensating piping and valve system will be utilized for the initial tunnel submergence during construction and subsequently during operation, will provide dynamic stability to accommodate substantial weight changes.

Yet another feature of the present invention is the provision of such an underwater tunnel system with an internal tank system which has the capability to be utilized for tunnel buoyancy operations for tunnel submergence until structurally secured.

Yet another feature of the present invention is the provision of such an underwater tunnel system which enables a conversion of a major portion of the tunnel internal tank system to function as the internal ducting system for air flow throughout the tunnel environment during the operational phase of the tunnel.

Yet another feature of the present invention is the provision of such an underwater tunnel system which, by reason of its modular construction configuration, can be repaired if required by raising only the affected section of the tunnel rather than attempting to perform any major repairs underwater.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

FIGS. 7A and 7B are a pair of perspective views illustrating still further successive operations in the fabrication of the tubular tunnel sections;

FIG. 8 is a side elevation view, partly in section, depicting yet further successive operations in the assembly of the tubular tunnel sections at a location of embarkation at the shore adjacent the body of water intended to be traversed by the underwater tunnel system;

FIG. 34 is a perspective view generally illustrating the relative relationship of all components utilized for closure of tubular tunnel sections in FIGS. 32 and 33;

FIG. 35 is a detail side elevational view, partly cut away and shown in section, illustrating a continuance of the operation begun in FIG. 33;

FIG. 35A is a detail cross section view, enlarged, of components illustrated along line 35A—35A in FIG. 35;

DETAILED DESCRIPTION OF THE PREFERRED EMBODIMENTS

Figure 1:
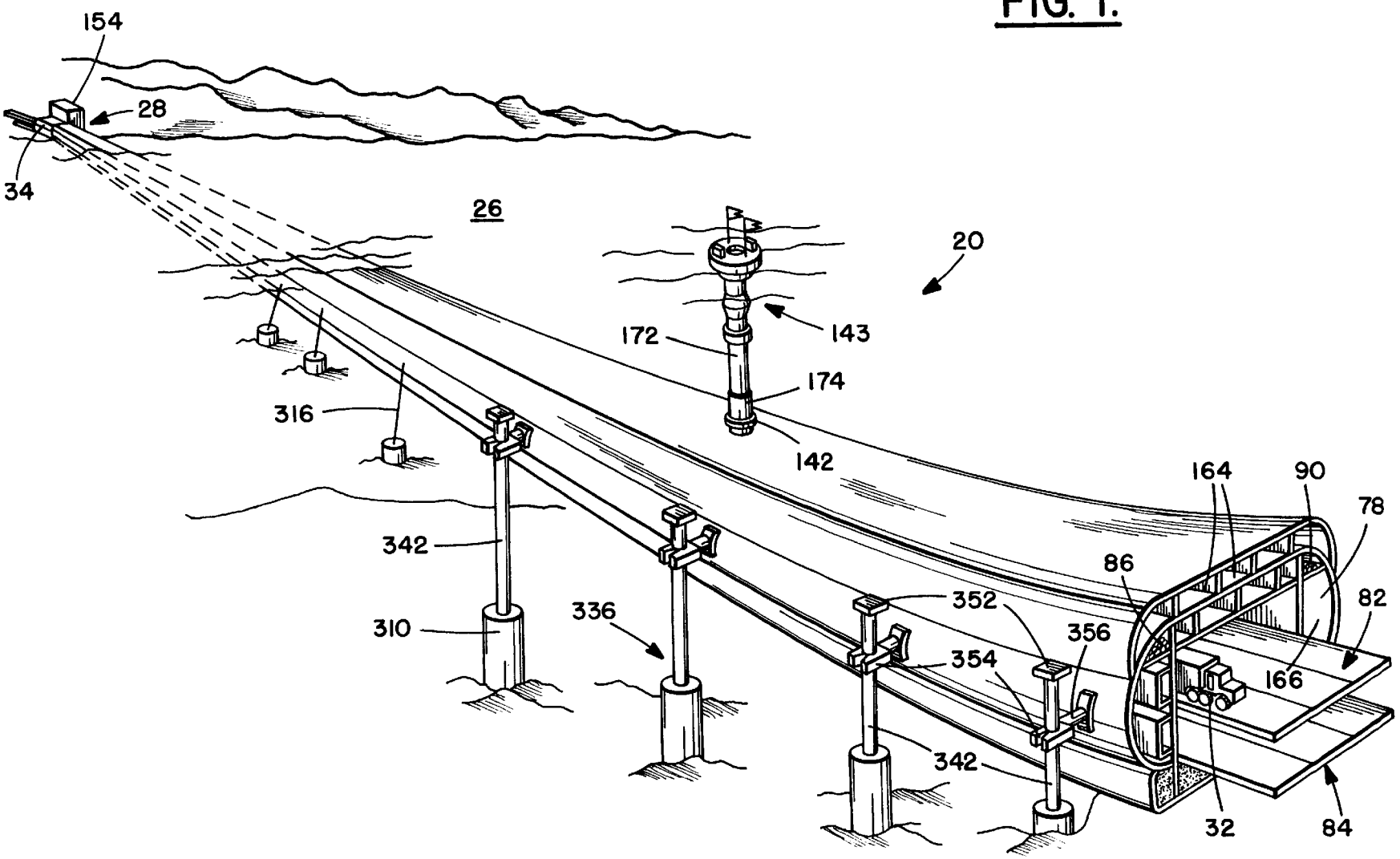
FIG. 1 is a perspective view of an underwater tunnel system (Type III) embodying the present invention.
Figure 2:
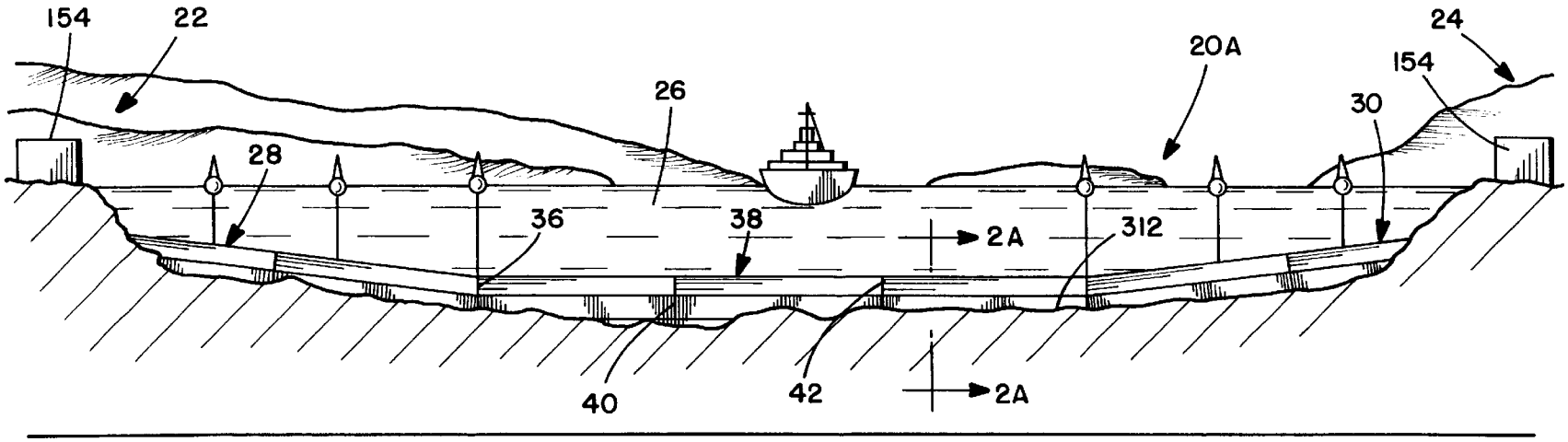
FIG. 2 is a side elevation view, partly in section, of another configuration of the underwater tunnel system (Type I), illustrating an elongated width tunnel extending between opposing shores.
Figure 3:
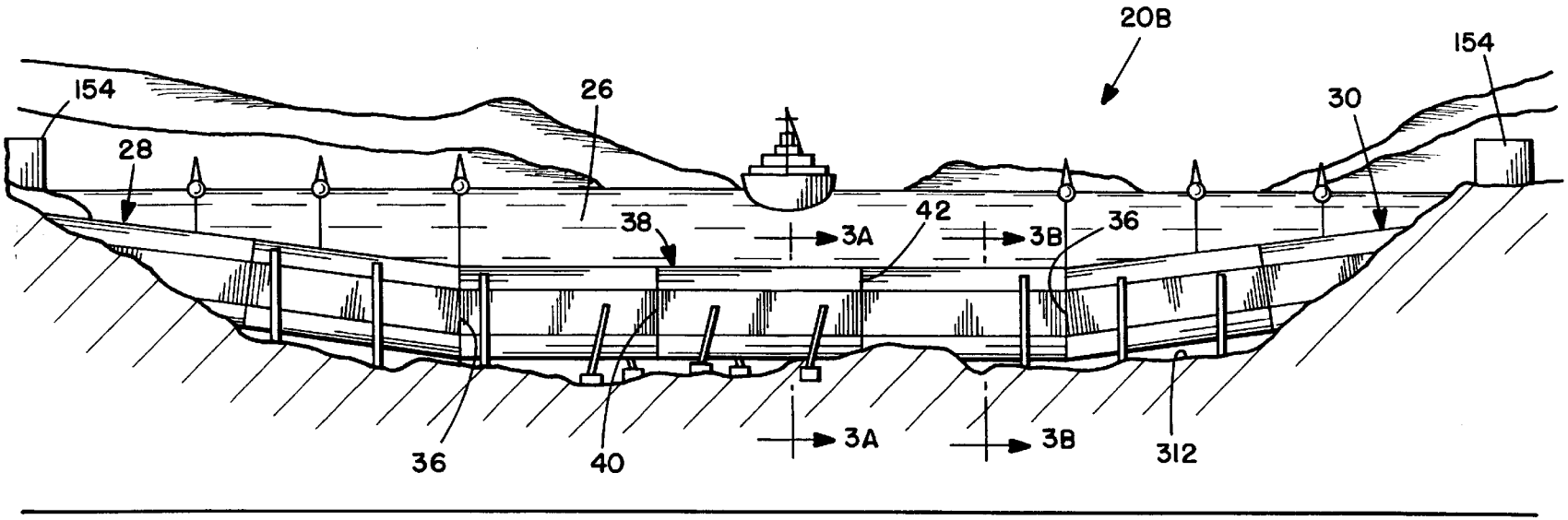
FIG. 3 is a side elevation view, partly in section, of another configuration of the underwater tunnel system (Type II) illustrating it extending between opposing shores.
Figure 4:
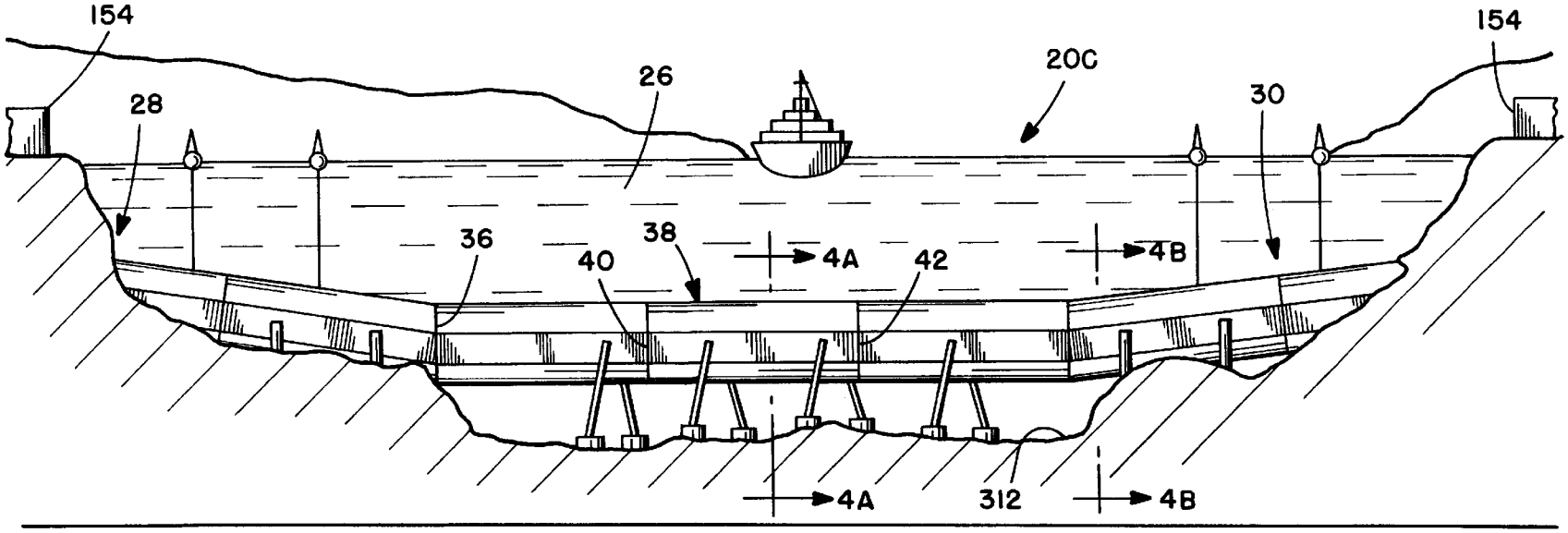
FIG. 4 is a side elevation view, partly in section, of still another configuration of the underwater tunnel system (Type III) illustrating it extending between opposing shores.

Turn now to the drawings and, initially, to FIGS. 1–4 which generally illustrate an underwater tunnel system 20 according to the invention for vehicular traffic connecting first and second shores 22, 24 of opposed land masses separated by a body of water 26. Reference numeral 20 of FIG. 1 is intended to depict a composite representation of the invention but graphically is indicative of a Type III configuration. Reference numeral 20A of FIG. 2 is intended to represent the Type I configuration earlier described, that is, the shallow water elongated tunnel (about 40 feet to 60 feet in depth). Reference numeral 20B of FIG. 3 is intended to represent the Type II configuration earlier described, that is, the shallow depth cylindrical or elongated tunnel (about 50 feet to 100 feet in depth). Reference numeral 20C of FIG. 4 is intended to represent the Type III configuration earlier described, that is, the open depth cylindrical tunnel (about 70 feet or greater in depth). In the ensuing description, whenever it is intended to refer to the tunnel system in a generic manner, that is, with reference to all configurations, numeral 20 will be used; whenever it is intended to refer to the tunnel system in a specific manner, that is, with reference to one of the configurations described above, the appropriate numeral 20A, 20B, or 20C will be used.

The tunnel system 20 includes a pair of watertight elongated inclined stationary tubular tunnel sections 28, 30 for ingress into and egress of the vehicular traffic, as represented by a vehicle 32 (FIG. 1) traveling through the system. Each inclined stationary tubular tunnel section 28, 30 is embedded into its associated shore so as to extend transverse of the shoreline and into the body of water 26 and has a land-based proximal end 34 and a distal end 36 immersed in the body of water at a predetermined depth at a location distant from the shore. The tunnel system 20 further includes a plurality of elongated watertight intermediate, initially mobile, tubular tunnel sections 38, each of which extends between opposed ends 40, 42.

Each of the inclined stationary tubular tunnel sections 28, 30 and of the intermediate tubular tunnel sections 38 is constructed using submarine manufacturing technology. This statement will be explained in greater detail below. Subsequently, a watertight joint construction is employed to join together the opposed ends 40, 42 of the intermediate tubular tunnel sections 38 and to join the distal ends 36 of the inclined stationary tubular tunnel sections 28 to associated ones of the ends of the intermediate tubular tunnel sections such that the longitudinal aces of the first and second inclined stationary tubular tunnel sections and of the intermediate tubular tunnel sections are substantially aligned.

Turning to FIGS. 5–8, an explanation will now be made of the statement related above that each of the inclined stationary tubular tunnel sections 28, 30 and of the intermediate tubular tunnel sections 38 is constructed using submarine manufacturing technology. While submarine manufacturing technology is known and effectively used for that purpose, it has not heretofore been known to apply such technology to the construction of vehicular tunnels for connecting opposed land masses. Furthermore, this known submarine manufacturing technology has been modified, as will be described in this disclosure, for the particular underwater tunnel building application to which it is being put.

Thus, at a construction site broadly represented by reference numeral 44, a primary endless structural ring 46 is laid down on a base 48 as a suitable level supporting surface. Thereupon, each of a plurality of upright elongated temporary fixture members 50 is temporarily joined at a lower end to the primary structural ring 46 at successively spaced locations such that the temporary fixture members are mutually parallel. Thereafter, a plurality of secondary endless structural rings 46A are temporarily joined to the temporary fixture members at a plurality of successive levels such that the secondary endless structural rings lie in spaced parallel planes. The endless structural rings 46, 46A and the upright elongated temporary fixture members 50 together define a tubular frame 52 which is a body of revolution. Thereupon, successively viewing FIGS. 5A, 5B, and 5C, a plurality of arcuate plate members 54 are attached, preferably by welding, to the primary and secondary endless structural rings 46, 46A in an adjoining relationship to completely encapsulate the tubular frame 52. This is achieved by positioning the arcuate plate members 54 in overlying proximal relationship with the tubular frame 52 and in abutting relationship with each other, then joining the arcuate plate members to the structural rings 46, 46A and to each other to completely enclose the tubular frame. The sequence of steps for the tubular frame construction can account for either a cylindrical cross section or for an elongated width cross section.

Figures 5A, 5B, 5C, 5D, 5E, 6A, 6B:
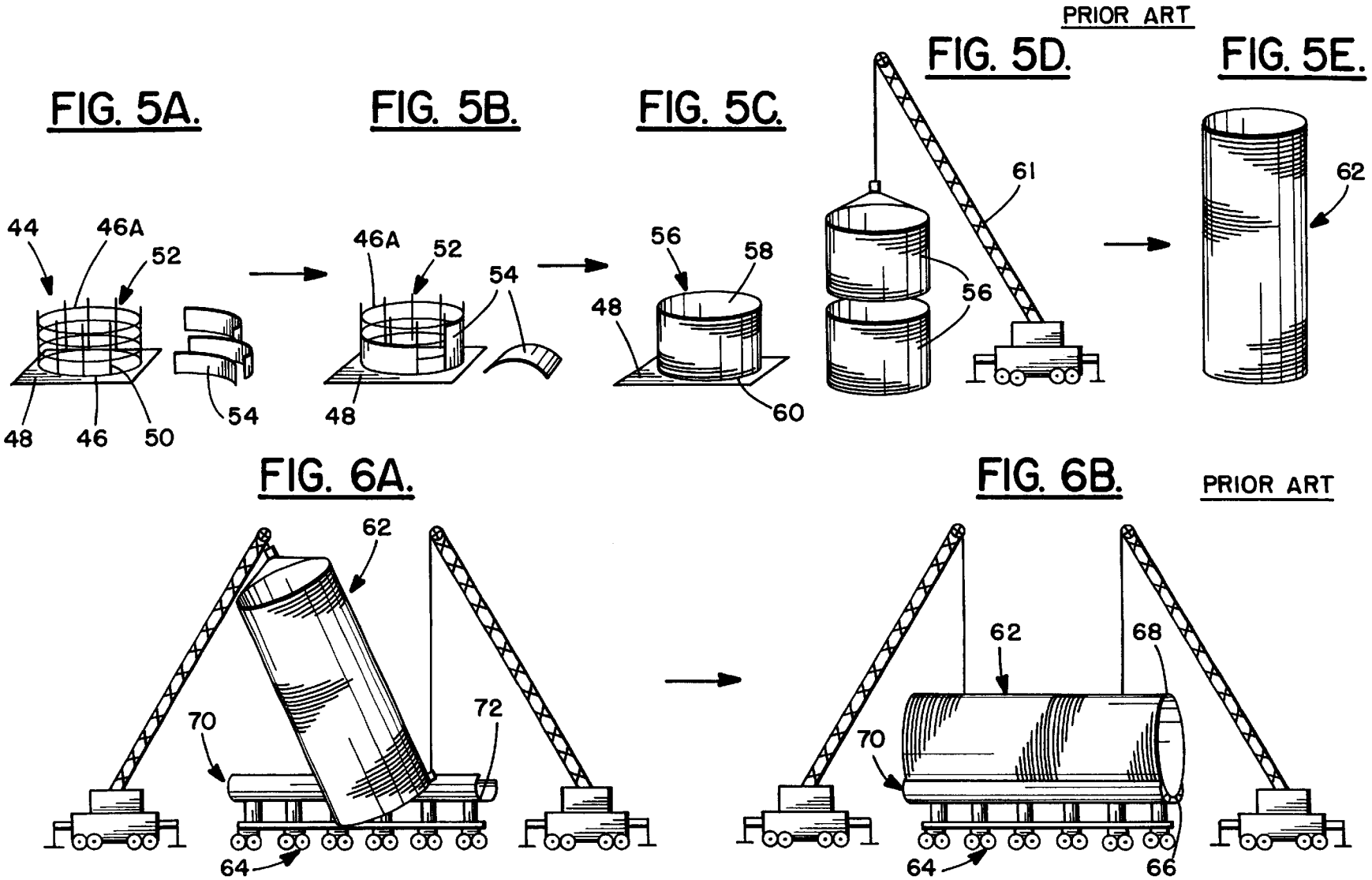
FIG. 5D. PRIOR ART
FIG. 6B. PRIOR ART
FIGS. 5A, 5B, 5C, 5D, and 5E are a series of detail perspective views illustrating successive operations in the fabrication of tubular tunnel sections as fundamental components for the underwater tunnel system of the invention.
FIGS. 6A and 6B are a pair of perspective views illustrating further successive operations in the fabrication of the tubular tunnel sections.
Figure 19:
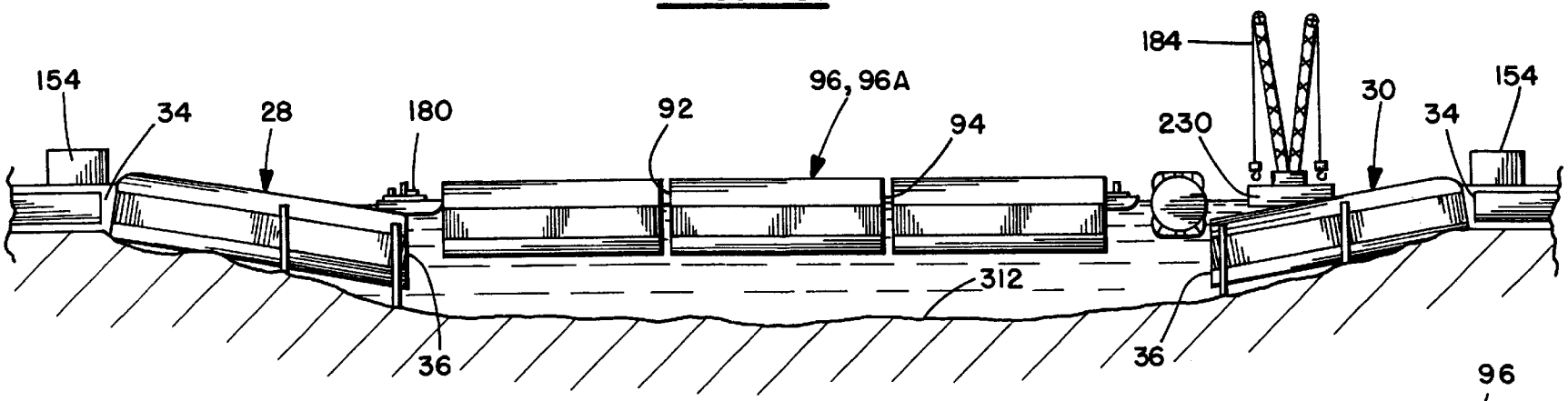
FIG. 19 is a side elevation view, partly in section, illustrating construction of the underwater tunnel system such that it eventually extends between opposing shores with initial positioning of the tubular sections in a floating condition.
Figure 8A:
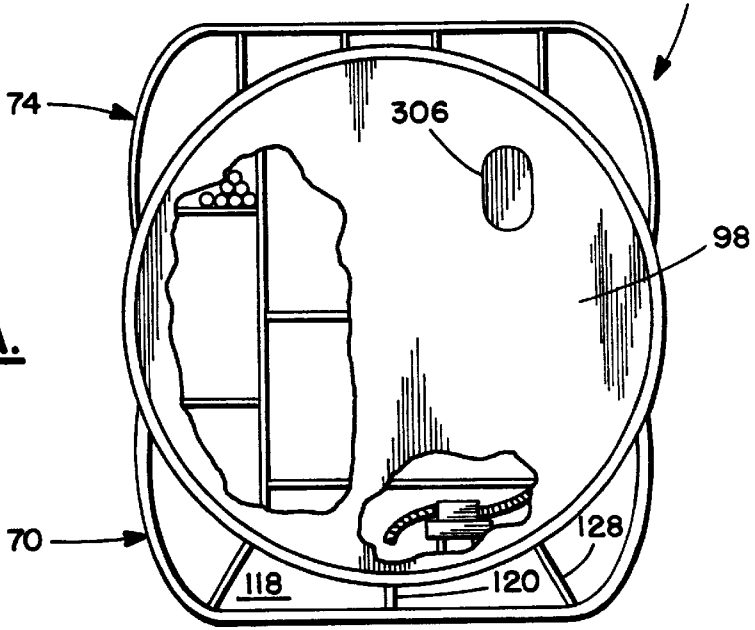
FIG. 8A is a detail cross section view of a cylindrical tubular tunnel section, certain (aspects) being cut away (for clarity) and shown in section.

Upon completion of the attachment of the arcuate plate members 54 to the tubular frame 52 (FIG. 5B), all of the upright elongated temporary fixture members 50 are removed from the tubular frame and the result is a tubular tunnel mini-section 56 extending between first and second mounting ends 58, 60, respectively (see FIG. 5C).

In actual fact, a plurality of the tubular tunnel mini-sections 56 are formed, then assembled in end-to-end axially aligned relationship in an upright orientation by means of a suitable lifting device, for example, a crane 61 as depicted in FIG. 5D, then joined, preferably by welding, at their respective facing mounting ends 58, 60 to form an unmodified midi-section 62 (FIG. 5E) having an upright longitudinal axis.

Thereafter, as seen in FIG. 6A, the unmodified midi-section 62 is repositioned from an upright orientation (FIG. 5E) to a generally level orientation. When this occurs, the midi-section 62 is placed onto a movable elongated platform 64 such that a lowermost region 66 (FIG. 6B) nearest the movable platform is a hull bottom and an uppermost region 68 farthest from the movable platform is a hull topside. More specifically, an elongated bottom support tank structure 70 having an upper receiving surface 72 (FIG. 6A) is supported on the movable elongated platform 64 and, in turn, the lowermost region 66 of the level midi-section 62 is positioned onto the upper receiving surface 72 of the elongated bottom support tank structure. The elongated bottom support tank structure 70 is then joined, as by welding, to the midi-section 62. The elongated bottom support tank structure provides a method to properly stabilize and ballast the tubular tunnel section by the addition of weighted materials and structure to the bottom side.

After integration to the midi-section 62 of the elongated bottom support tank structure 70, an elongated topside support structure 74 including a buoyancy compensating tank 76 is positioned to the uppermost region 68 of the midi-section such that the elongated topside support structure and the midi-section are substantially co-extensive. The topside support structure defines the enclosed boundary which functions as a tank to contribute to the prescribed buoyancy conditions to maintain positive buoyancy (floating) and negative buoyancy (submerging) conditions during the construction and installation phases. Again, the elongated topside support structure 74 is joined, as by welding, to the midi-section 62. Although the midi-section 62 has been modified from the construction illustrated in FIG. 5E by reason of the additions of the bottom support tank structure 70 and the topside support structure 74, throughout this disclosure, for sake of simplicity, it will continue to be referred to by the reference numeral 62.

Figure 9:
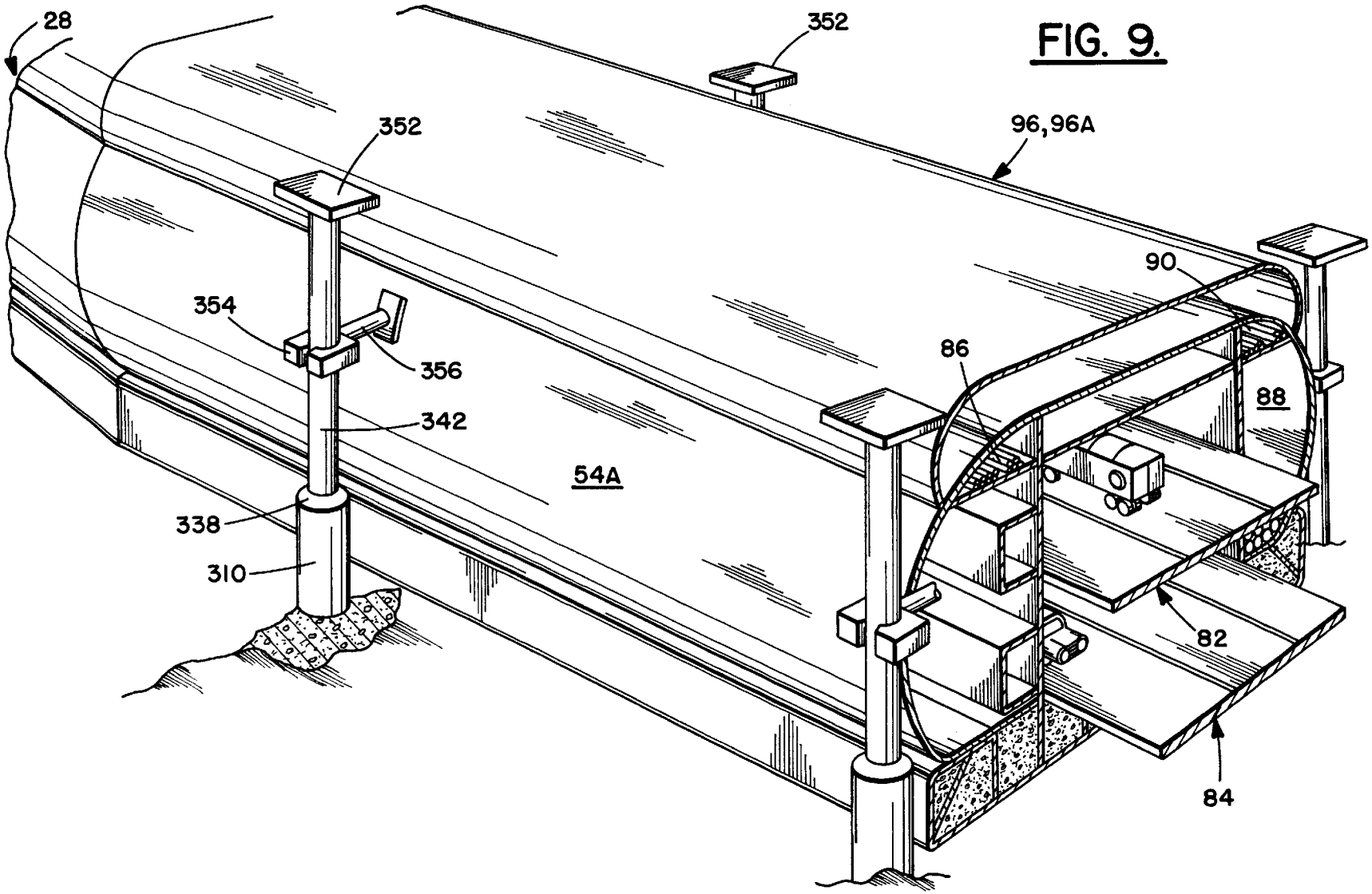
FIG. 9 is a detail perspective view, partly cut away and in section, of a mobile tubular tunnel section joined to a stationary inclined tubular tunnel section.

It may be desirable, although not mandatory, that while the midi-section 62 remains in the upright position of FIG. 5E, one or more of the following structure and material items be installed into its interior: (i) structurally defined dual use fluid tanks 78; (ii) foundations 80 (see FIG. 11); (iii) internal support structure including at least upper and lower level roadways 82, 84, respectively (see FIGS. 9 and 11).

Thereafter, as illustrated in FIGS. 7A and 7B, a plurality of substantially similar level tubular tunnel midi-sections 62, each having opposed mounting ends 92, 94, are positioned on their associated movable elongated platforms 64 in end-to-end axially aligned relationship, then joined at their respective facing mounting ends, as by welding, to form a level tubular tunnel section 96. Typically, but not intended in any way to be restrictive of the invention, each mini-section 56 may be approximately 20 feet long, each midi-section 62 may be approximately 100 feet long, and each tubular tunnel section 96 may be approximately 500 feet long. The overall length of a tubular tunnel section 96 may be up to about 600 feet long.

Figure 13:
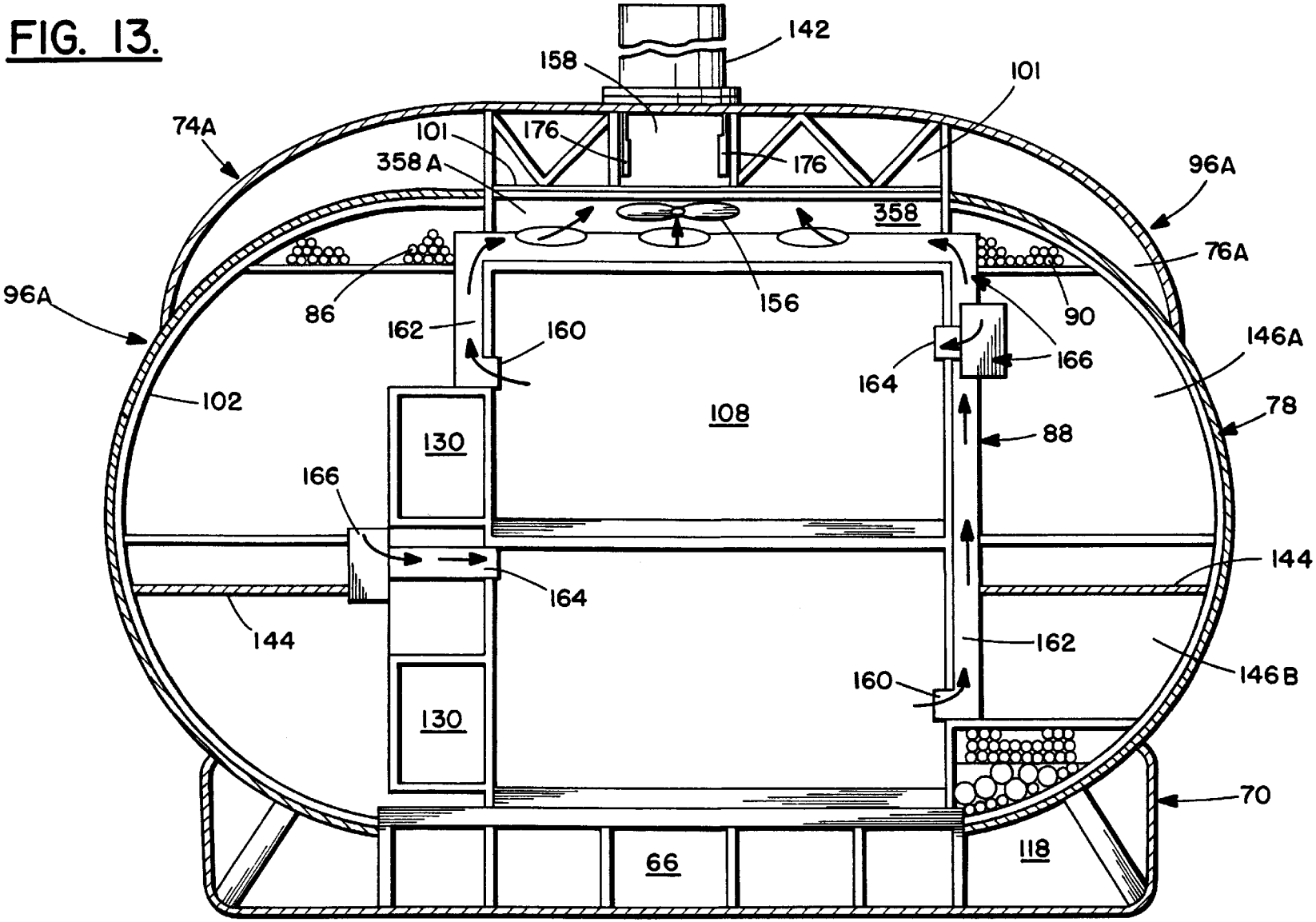
FIG. 13 is a cross section view of an elongated width tubular tunnel section.

In completion of the construction steps being related with respect to FIG. 7, a bulkhead closure 98 is attached to both opposed mounting ends of the tubular tunnel section (see FIGS. 8 and 8A) and a dome member 100 of suitable material and construction is temporarily attached to one of the mounting ends of the tubular tunnel section externally of the bulkhead closure 98. Thereafter, the watertight integrity of the entire tubular tunnel section 96 including the bulkhead closure 98 and the dome member 100 attached thereto is assessed and insured. During this same period of construction, the various systems and/or components already installed in each of the midi-sections 62, including the structurally defined dual use fluid tanks 78, the foundations 80, the internal support structure including at least upper and lower deck levels 82, 84, respectively, the piping systems 86, the ventilation systems 88, and the electrical systems 90 are integrated (see FIGS. 11 and 13).

Figure 10:
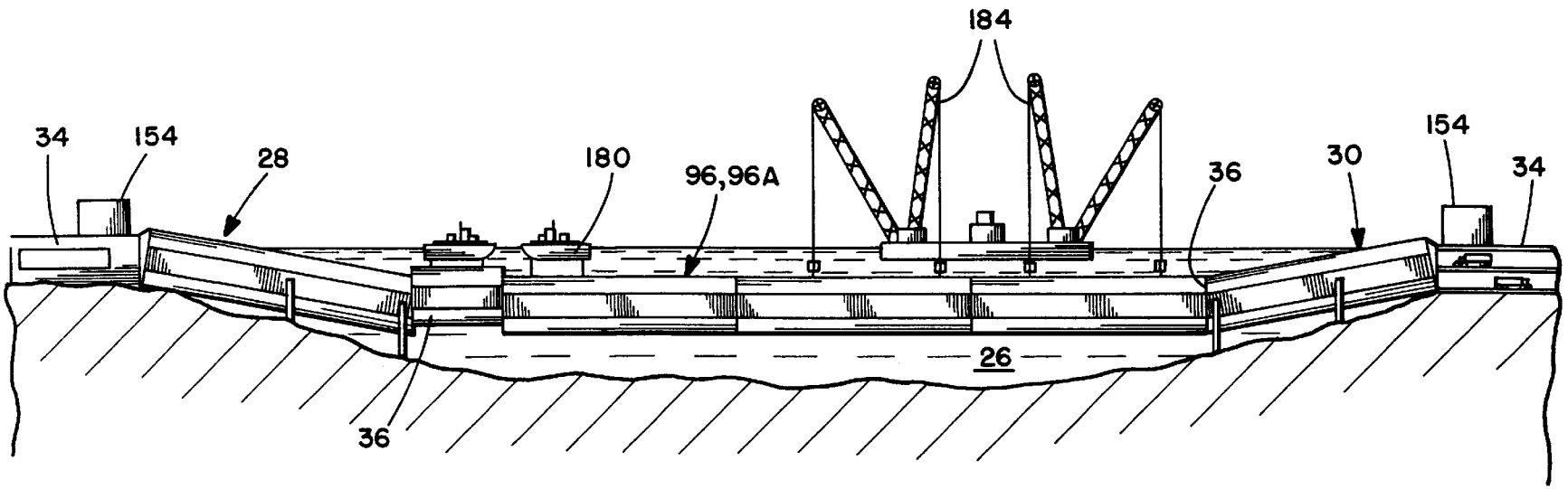
FIG. 10 is a side elevation view, partly in section, illustrating construction of the underwater tunnel system (Type III) such that it eventually extends between opposing shores.

With the description of the invention provided to this point, then, the underwater tunnel system 20 is seen to comprise a plurality of axially aligned tubular tunnel sections 96 which may be cylindrical or denoted by reference numeral 96A when extended in the athwartship direction. The underwater tunnel system 20 can vary from about thirty feet in diameter to about fifty feet in diameter in order to accommodate traffic flow between two to six lanes in a single modular-constructed tunnel section. The overall width span could vary from about 40 feet to about 70 feet for an elongated tubular tunnel section to accommodate the required number of traffic lanes. Each tunnel section, about five hundred feet in length, will be constructed using a modular approach (see FIG. 8) as previously described. This modular approach, as depicted in FIG. 5, will develop tubular tunnel mini-sections 56 which are about 20 to 30 feet in length and which, in turn, can be progressively joined with others to create a tubular tunnel midi-section length between about 80 feet and about 120 feet. The overall tubular tunnel section may typically join four, five, or six midi sections together to optimize the length (between about 450 to about 600 feet) or compatibility with the on site installation joining sequence (see FIG. 10).

The tunnel system 20 incorporates the required cylindrical or adjacent (if extended width-wise) hull structure and numerous subsystems, many of which will be described below. These subsystems may include: internal support structure for roadways, tank compensating system for buoyancy operations, ballast material for weight distribution, ventilation system for air quality, electrical system for power, control, lighting, and emergency operation, acoustic dampening and corrosion control materials, and informational display systems.

Figure 11:
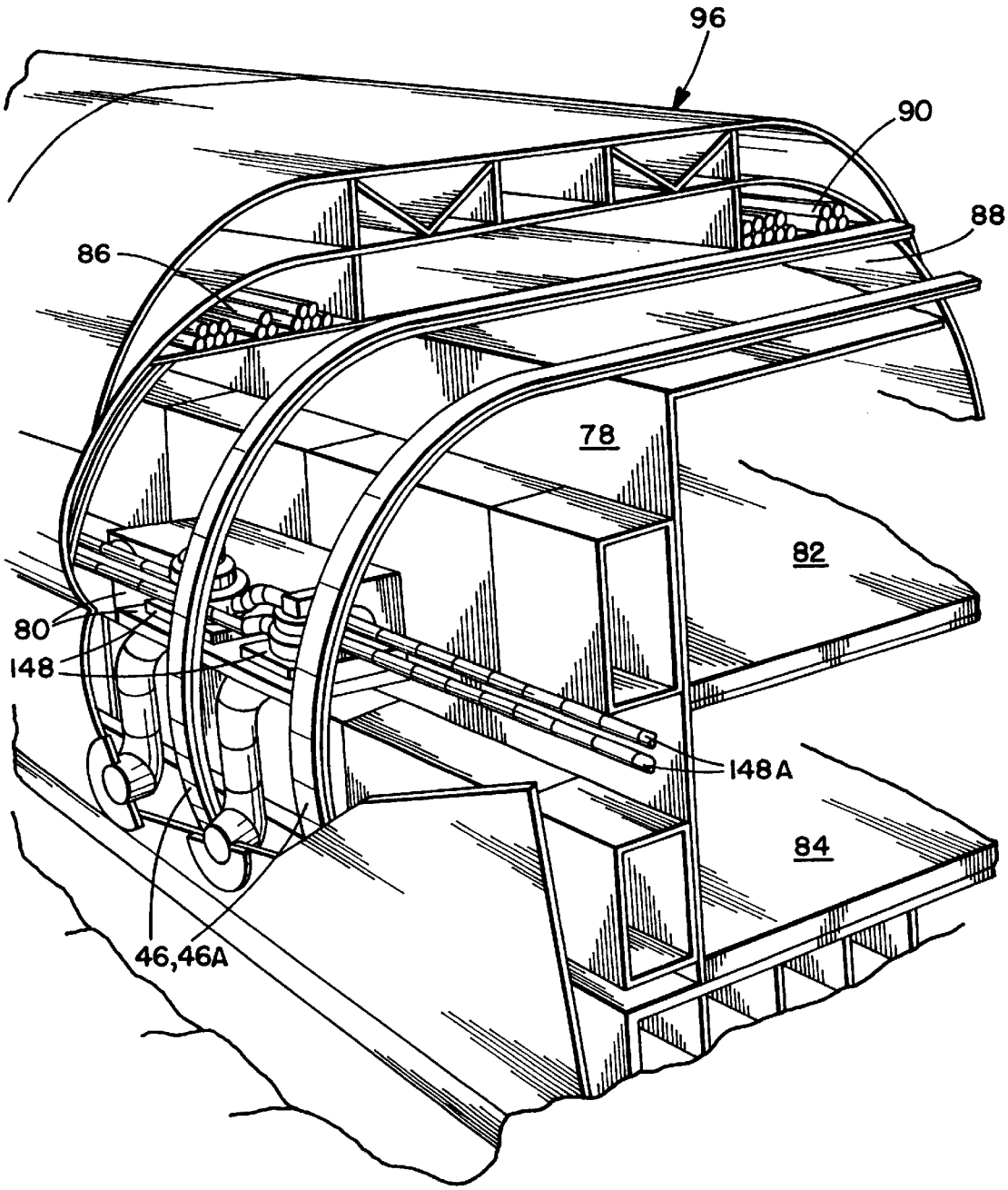
FIG. 11 is another detail perspective view, partly cut away and in section, of a tubular tunnel section and illustrating, in particular, part of the compensating piping/valve station of the invention.

The hull design may be of a cylindrical type tunnel with a pressure hull thickness between about five-eighths of an inch (⅝") and up to two inches (2") with a nominal thickness of about one inch (1") to accommodate the internal and external support structure. The selected grade of steel, or other suitable structural material, will provide the necessary strength, hardness, weight requirements, wear resistance, and corrosion resistance to optimize fabrication activities and satisfy all structural loading conditions. The requirements for sufficient hull rigidity for a tubular tunnel section shall be accomplished by maintaining a consistent frame spacing to include frame web and flange support, as depicted by the structural rings 46, 46A as seen in FIG. 11.

The use of a double pressure hull configuration is an option which would likely require external frames. Based upon the tunnel size, material thickness, and support structure design, the internal design may not be required in full circular use if external frames are utilized. The double hull configuration will be utilized predominantly for open-water and extended distance tunnels.

As previously noted, the tubular tunnel section 96 of cylindrical configuration (see FIGS. 2, 12 and 13) may be modified with a horizontal or width-wise extension 101 (FIGS. 2A and 13) to create a tubular tunnel section 96A of elongated configuration for shallow-water use which will minimize dredging requirements. The elongated tunnel configuration may utilize, for example, a nominal 42 foot diameter cylinder with, nominally, a 20 to 30 foot width wise extension structure to provide sufficient volume for traffic flow, tank structure, ballast/compensating materials, and ventilation flow.

Figure 12:
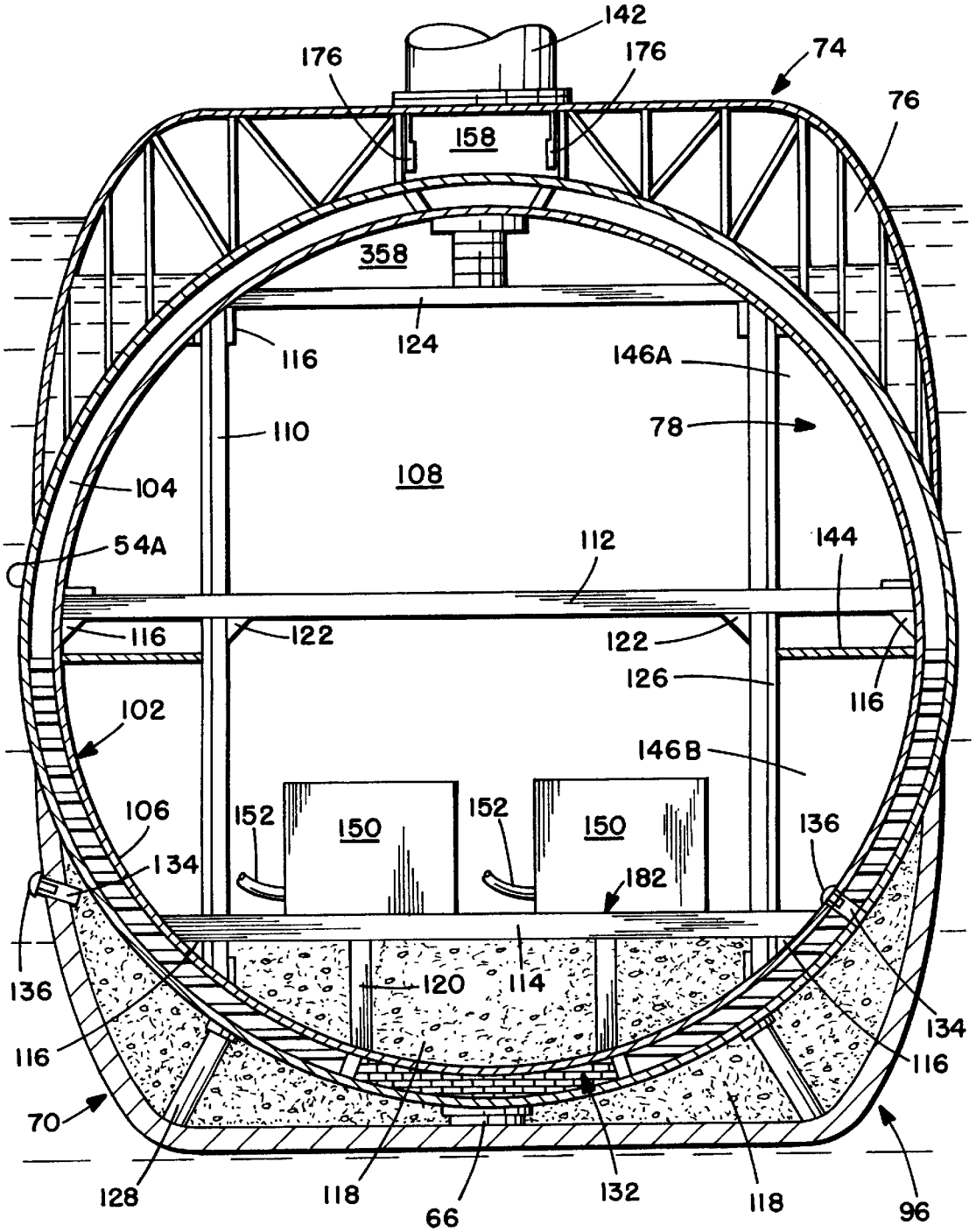
FIG. 12 is a cross section view of a cylindrical tubular tunnel section.

Viewing FIG. 12, an arcuate interior panel 102, which may be of about one-quarter to three-eighths inch (¼" to ⅜") steel sheet plating is uniformly spaced from hull plating 54A (which is the collective reference numeral for all of the arcuate plate members 54 attached to the tubular frame 52) and extends between each pair of the structural rings 46, 46A and thereby defines an internal frame bay envelope 104 and an inner peripheral surface 106 defining an internal compartment 108. The internal support structure of the hull of the tubular tunnel section 96 may desirably utilize columns 110 in the nature of I-beams, square tubing, or other suitable structural members to provide the necessary structural design for roadway support during dynamic traffic flow. The nominal frame spacing is about four feet (and may vary from three to six feet), which will provide an adequate foundation for the internal support structure members. Upper and lower deck platforms 112, 114, respectively, shall be structurally prefabricated to the maximum extent possible. The overall internal support structure integrates the major carrying members to the tubular frames 52 which will be the primary structural mechanism for support.

The horizontal structural members represented by the upper and lower deck platforms 112, 114, respectively, and the vertical structural members represented by the columns 110 shall be suitably attached to the structural rings 46, 46A or other internal frame structure by means of gussets 116 so as to distribute the weighted load directly to the hull of the tubular tunnel section 96 and the resultant buoyancy forces acting thereon. The internal support structure as defined by the columns 110 and the upper and lower deck platforms 112, 114 on which are built the upper and lower roadways 82, 84, as seen in FIG. 14, respectively, provide for the necessary walkways, access flow paths to equipment foundations, and internal component maintenance requirements and replacement activities.

The external support structure collectively comprising the bottom support tank structure 70 and the topside support structure 74 includes flat plating, I-beams, square tubing and other structural components and the external structural attachment hardware, all as necessary, whether or not full double hull plating is employed.

The overall bottom support tank structure 70 is located symmetrically width-wise about the main longitudinal axis of the tubular tunnel sections 96 and extends about two and one-half to five feet (2½' to 5') below the lowermost region 66 of each tubular tunnel section. This bottom support tank structure is enclosed to create an external lower-level vessel which can readily accept ballast material 118 to maintain prescribed buoyancy conditions. Indeed, it is intended to fill with ballast material 118 one or more of (i) the internal frame bay envelope 104 substantially encircling the tubular tunnel section 96, or at least the lowermost regions thereof, (ii) the elongated bottom support tank structure 70 extending substantially the length of the tubular tunnel section 96, and (iii) an internal longitudinally extending lower tank support structure 132 at the lowermost internal regions of the tubular tunnel section 96. The ballast material is preferably of a material having a density of no less than about 135 pounds per cubic foot and may typically be variously concrete, slag, or lead or a combination of those materials. Once the ballast material 118 is installed, as through orifices 134 (FIG. 12), for example, each individual holding compartment, that is, the internal frame bay envelope 104, or the elongated bottom support tank structure 70, or the internal lower tank support structure 132, is sealed by means of a plug 136 or other suitable closure to assure permanent containment of the ballast material. In this manner, the stability of each tubular tunnel section 96 is assured initially when it assumes the floating condition and subsequently, then when it is submerged for the joining operation, and finally when the completed underwater tunnel system is operational.

Figure 14:
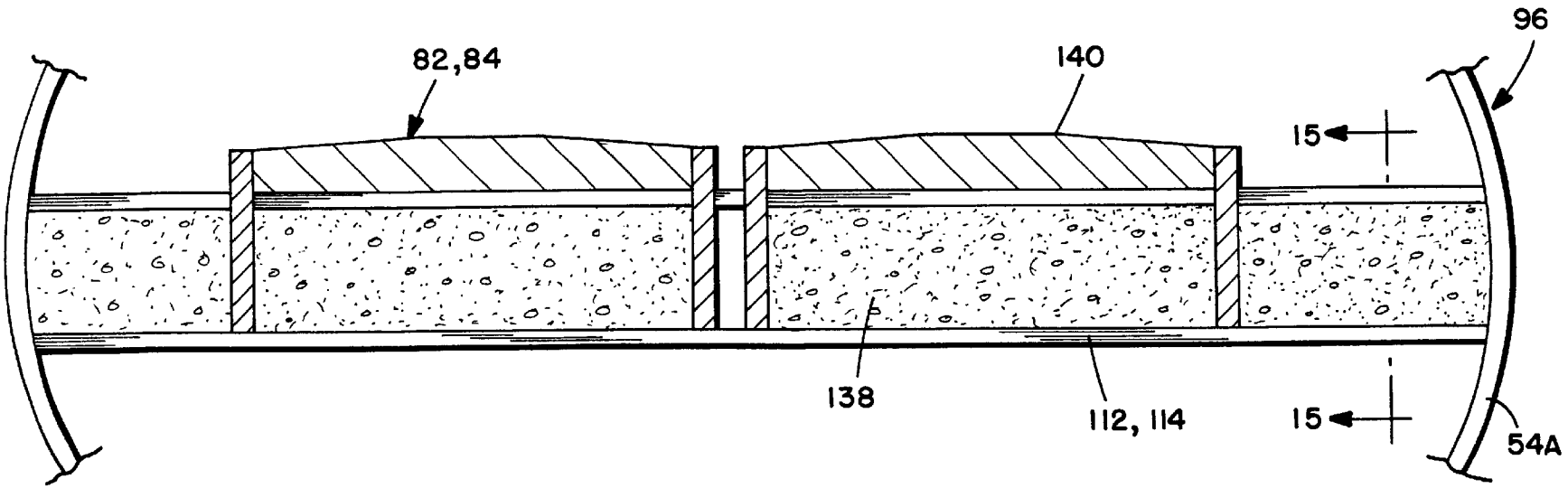
FIG. 14 is detail cross section view of a roadway in a tubular tunnel section.
Figure 15:
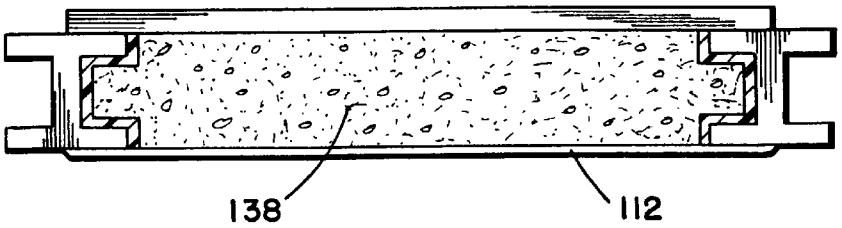
FIG. 15 is a detail cross section view taken generally across line 15—15 in FIG. 14.

Another form of the ballast material may be a predetermined quantity of concrete 138 and asphalt 140, or the like, used in the construction of the roadways 82, 84 on the upper and lower deck levels 112, 114, respectively (see FIGS. 14 and 15). This also aids substantially in achieving the stability of each tubular tunnel section when it assumes the floating condition, and subsequently.

As seen in FIG. 12, columns 110, longitudinal bracing 122, cross members 124, tank boundary structural members 126, and external structural members 128 shall align to the maximum extent possible for direct support with the internal vertical support members 120 and tubular frames 52. This will insure structural integrity of the resulting underwater tunnel system.

Figure 16:
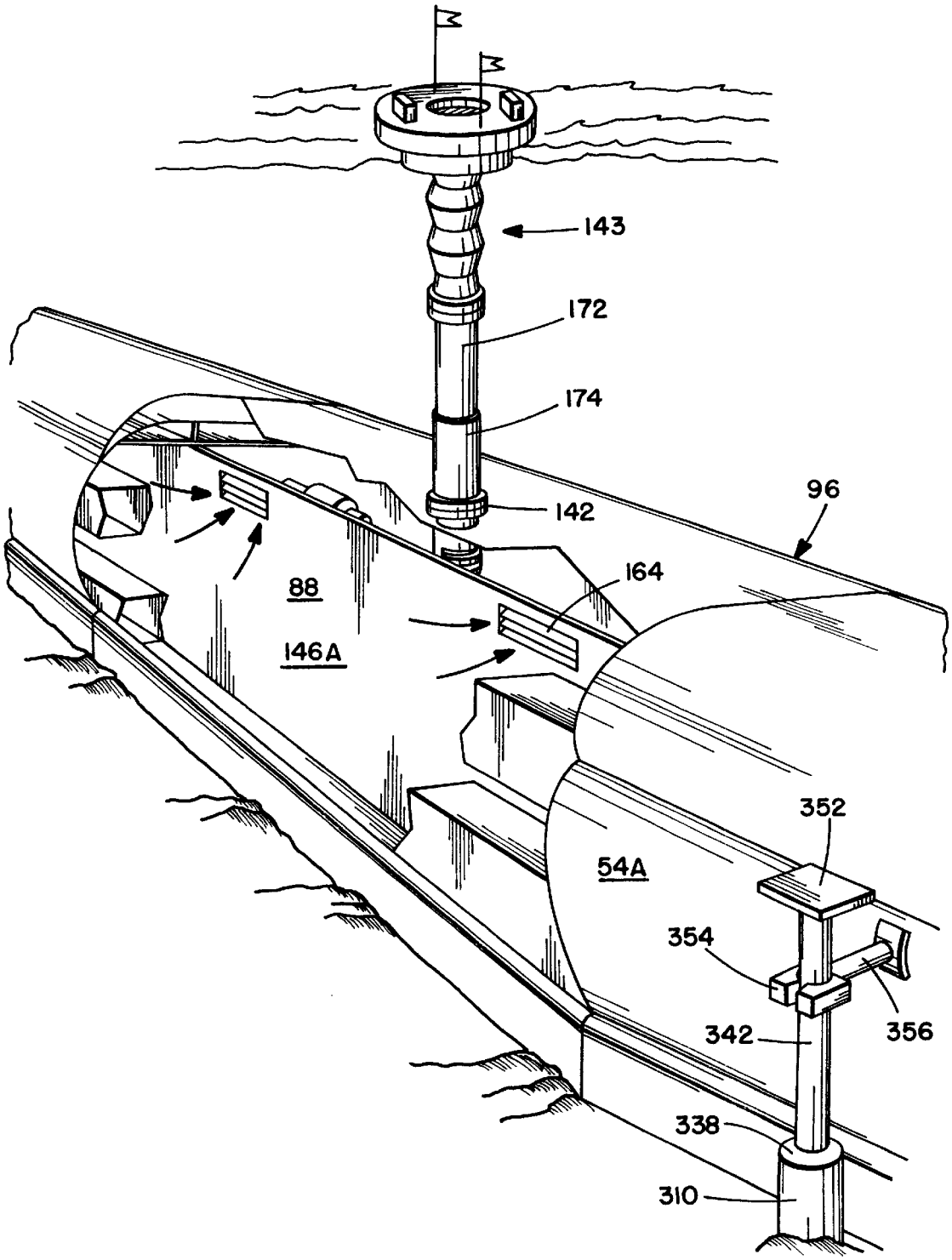
FIG. 16 is a perspective view, partly cut away and in section, illustrating a centrally located External Ventilation Exhaust Cylinder (EVEC)
Figure 17:
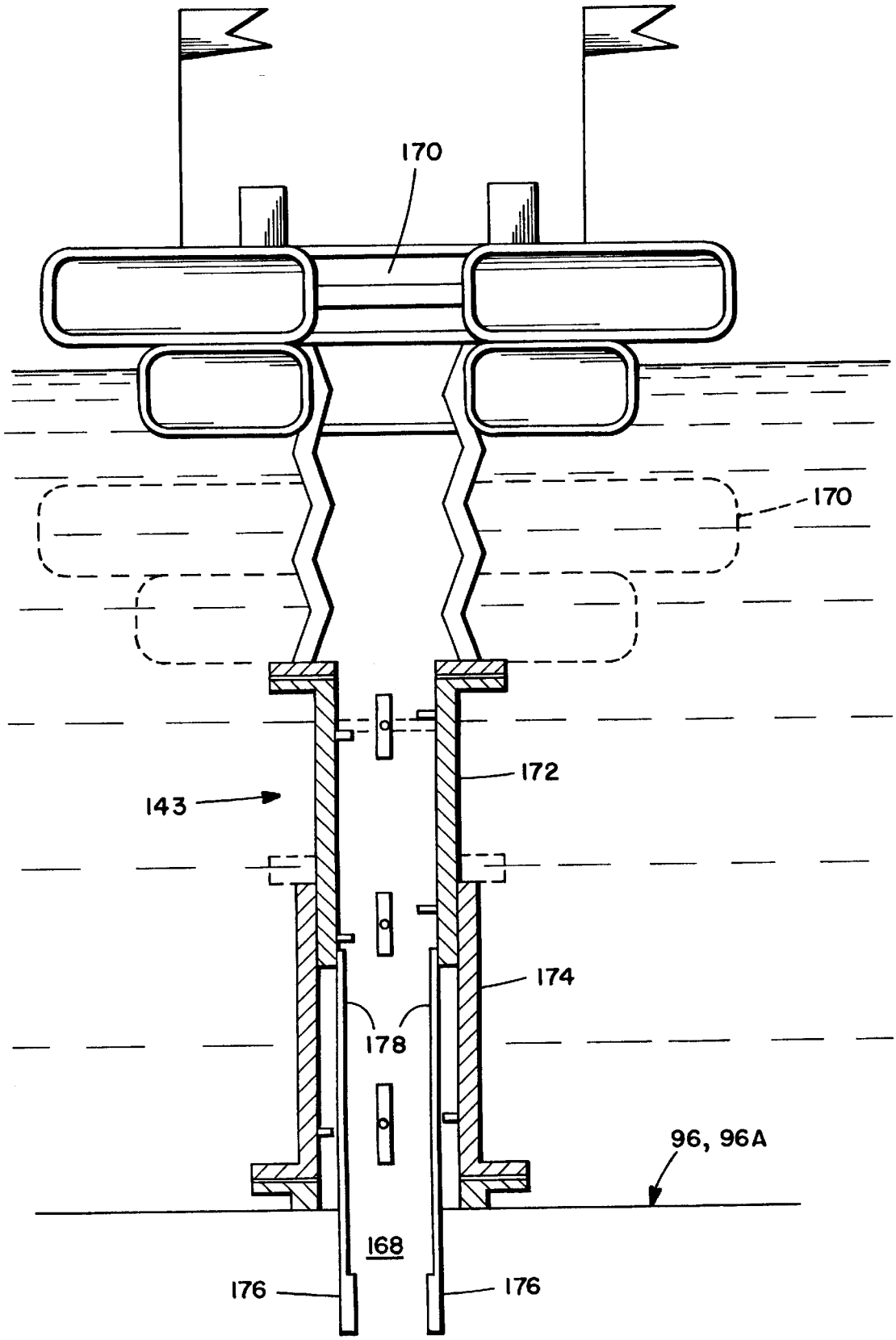
FIG. 17 is a detail cross section view, in elevation, of the External Ventilation Exhaust Cylinder.
Figure 18:
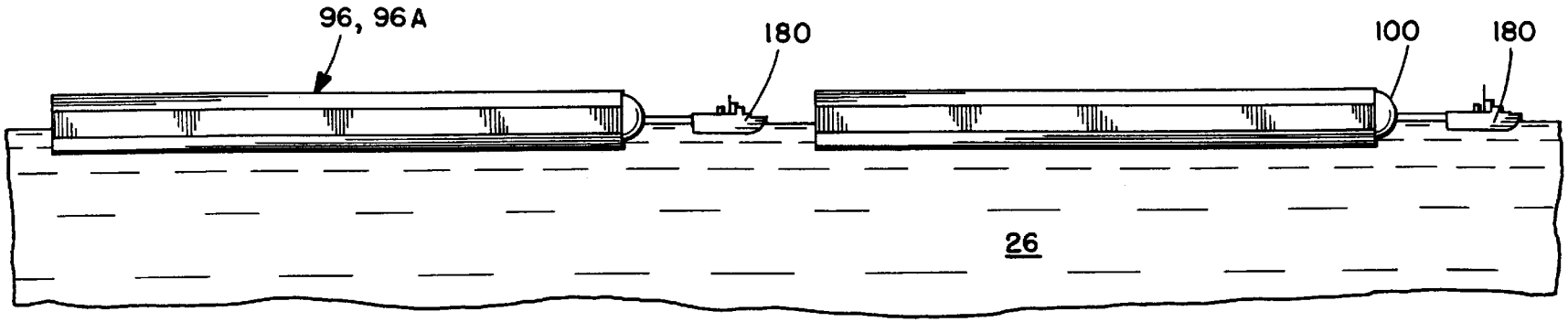
FIG. 18 is a side elevation view illustrating the procedure of transporting the tubular tunnel sections to the installation site intermediate the opposed shores.

With continuing reference to FIG. 12, the topside support structure 74 and support structure 142 for an External Ventilation Exhaust Cylinder (EVEC) 143 (see FIG. 16), to be described subsequently, attaches to the hull cylinder plating 54A and adjacent internal frame support locations, for example, the structural rings 46, 46A, as required. The overall topside support structure includes a buoyancy compensating tank 76 which is located in proximity to the main axis of the tubular tunnel section 96 and extends vertically so as to reach a horizontal projection above the top centerline of about two and one-half to five feet (2½' to 5') above. This insures adequate tank capacity for its intended use to be explained below.

In a full double plated or double hull configuration, the structure of the topside support structure 74 and of the bottom support tank structure 70 would continue around the sides of the tubular tunnel section 96 so as to fully encapsulate the hull plating 54A.

The size and material selection of the structural members for all three configurations of the underwater tunnel system 20, as described above, is based upon structural loading conditions. The topside support structure 74 is also intended to function as an energy absorbing entity to account for the undesirable, but improbable, impact by a marine vessel or other foreign object.

This invention also utilizes submarine technology which requires the operation of ballast tanks for air and/or water for initial submergence and to maintain prescribed buoyancy conditions. The tank design for the underwater tunnel system 20 is intended to accommodate at least the following three different design attributes:

(a) the internal dual use tanks 78 within the tubular tunnel section 96 to be utilized for buoyancy compensating conditions. A horizontal structural baffle plate 144 is located within each of the tanks 78 to define an upper air compartment 146A and a lower water compartment 146B for maintaining operational buoyancy conditions for the balance of water and/or air in the tubular tunnel section in a manner to be described;

(b) the external topside, or buoyancy compensating, tank 76 secured to the outer hull of the tubular tunnel section 96 to be utilized for buoyancy compensating conditions; and (c) the bottom support tank structure 70 secured externally to the outer hull of the tubular tunnel section 96 to be utilized for solid ballast materials, hull support structure, and contribute to the overall buoyancy compensating conditions.

The double hull configuration, mentioned above, can be secured externally to the hull cylinder boundary to be utilized for ballast materials and buoyancy compensating conditions.

The internal tank plating or arcuate interior panel 102 desirably has a nominal thickness of about one-half inch (½"), possibly within the range of from one-quarter inch (¼") to three-quarters inch (¾") and has a nominal external tank plating thickness of three-quarter inch and could vary from about one-half inch (½") to one inch (1"). Each of the dual use tanks 78 has sufficient internal stiffeners (not shown) at longitudinally spaced locations to provide adequate structural rigidity. The tank structure for the underwater tunnel system 20 will be integrated and interconnected throughout the entire tunnel section and controlled by both a port and starboard compensating/piping valve station 148 (FIG. 11) preferably located within a central tubular tunnel section 96 intermediate the shores 22 and 24. Additional internal tanks (not illustrated) may be required for such functions as roadway residue collection using gravity (fluid) flow, as well as storage of tunnel maintenance and emergency materials.

The internal dual use tanks 78 and topside external buoyancy compensating tank 76 provide sufficient capacity to change the overall tubular tunnel sections from about a 5% positive buoyancy to about a 3% negative buoyancy in conjunction with the solid ballast material in the internal frame bay envelope 104, the elongated bottom support tank structure 70, and the internal lower tank support structure 132 and temporary collapsible, probably flexible, bladders 150 as installed during various phases of construction and installation as depicted in FIG. 12. These temporary bladders, which are of suitable flexible construction and material to enable them to be enlarged from a deflatable condition of minimal size to a water-filled condition of maximum size, are strategically located throughout the tubular tunnel sections to accommodate a uniformed negative buoyancy for overall tunnel submergence. The flooding and draining of the collapsible bladders 150 is accomplished by the compensating piping/valve station 148 with the use of temporary hoses 152, all in a manner to be explained in greater detail below. The internal dual use fluid tanks 78 shall be configured to be jointly integrated with the upper frame bay envelope 104 for fluid flow to either the frame bay envelope or to the buoyancy compensating tank 76. The topside or external buoyancy compensating tank 76, if part of the configuration of the tubular tunnel section, can be controlled in parallel or series with the dual use fluid tanks 78.

For a submerged buoyant tunnel, these two tank configurations are operated in a controlled manner to mutually transfer (suction and discharge) from water to air and air to water as required in a specific rate of time (to be determined) for every tubular tunnel section as controlled by the compensating piping/valve station 148. This rate of buoyancy change is utilized to accommodate various weight distribution conditions of traffic flow during the normal operational cycle. It is intended that the compensating piping/valve station system would only be required for a limited time period for any one day of operation and only when excessive weight distribution changes occur over an extended period of time (for example, 30 minutes or greater). These changes are projected to occur primarily during rush hour or heavy traffic periods and then subsequent changes to a normal or lighter traffic flow.

Turning now to FIGS. 1, 2, 16 and 17, the invention utilizes a ventilation system 88 to optimize the flow of air throughout the entire length of the underwater tunnel system 20 to maintain a desired air quality. Two configurations exist for the ventilation air flow: (a) at all times, the system utilizes land-based ventilation transition buildings 154 at both ends of the tunnel system which will control air intake and exhaust throughout the entire length of the tunnel system, and (b) on occasion, when the length of the tunnel system warrants such use, the system 20 may utilize one or more External Ventilation Exhaust Cylinders (EVEC) 143 that are attached to mid-span tubular tunnel sections. The necessary ventilation equipment such as suitable exhaust fans 156 (FIG. 13), cooling coils, dehumidifiers, and the like, shall be built into internal ventilation support area 358 in proximity to a Logistic Access Trunk (LAT) 158 (see especially, FIGS. 12 and 13) to which the EVEC 143 is mounted.

The LAT 158 is built into the mid-span portion of each tubular tunnel section 96, 96A at its top centerline and faired into the topside external tank plating and structure. The LAT provides access during the construction and installation phases. The LAT should have an internal diameter between about two and one-half feet (2½') and five feet (5') for personnel and/or equipment access. The internal portion of the LAT has a dual use capability. In one instance, it may function as part of the EVEC configuration when the exhaust cylinder 143 configuration is required based upon tunnel system length and air quality requirements and, in another instance, the external topside portion of the LAT 158 allows for direct connection of the EVEC and can function as an emergency access connection for personnel.

If the length of the tunnel system 20 requires additional ventilation flow beyond the normal flow rate, then the majority of the internal tank system capacity can be utilized longitudinally to significantly increase the ventilation capacity. This "dual use" means that the internal tanks 78 are converted for ventilation. This dual use concept allows the tanks to be effectively increased in size to accommodate tank flooding thereby significantly reducing the internal positive buoyancy for the betterment of submerging the tunnel section during on-site installation. The internal tank design has already been configured to accept the necessary ventilation transitions once the change from buoyancy operations to ventilation is required. A mid-span tubular tunnel section accommodates the modular change from the compensating piping/valve station to a ventilation exhaust system. A smaller portion of the internal fluid tank system can be retained for compensating buoyancy requirements by specifically locating the horizontal divider or baffle plate 144, mentioned above, throughout the entire internal tank system 78. This baffle plate 144 can be secured to separate the dual use functions of ventilation (air flow) versus buoyancy (water flow) by suitably closing off the designated flood paths within the internal tank structure.

Hence, the land-based ventilation transition buildings 154 are positioned at the first and second shores 22, 24, respectively, for introducing fresh air into the underwater tunnel system and for exhausting stale air from the system. Intermediate the shores 22, 24, an external ventilation exhaust cylinder 143 may be mounted on one or more of the tubular tunnel sections 96, 96A distant from the first and second shores for assisting the transition buildings in providing exhaust ventilation to the system.

A plurality of stale air flow outlets 160 (FIG. 13) are mounted between a stale air flow duct 162 and the internal compartment 108 of each of the tubular tunnel sections 96, 96A at longitudinally spaced locations. The air flow duct system of the invention also includes a plurality of fresh air flow inlets 164 (FIG. 13) connecting a fresh air flow duct 166 from the land-based ventilation transition building and the internal compartment 108. The stale air flow duct 162 connects the stale air outlets both to the land-based ventilation transition buildings and to the EVEC 143. The exhaust fan 156 is suitably positioned between the stale air flow duct 162 and the logistic access trunk 158 for the flow of stale air from the interior 108 of the tubular tunnel section 96, 96A to and through the EVEC 143. The EVEC 143 extends between an entry end 168 and an exhaust end 170 and includes telescoping elements 172, 174 which are mutually slidable between a lowered position (dashed lines in FIG. 17) whereat the exhaust end is nearest the logistic access trunk 158 and a raised position (solid lines in FIG. 17) whereat the exhaust end is farthest away from the logistic access trunk. A suitable extension motor 176 (for example, of hydraulic operation) and associated mechanism 178 interengaging the telescoping elements 172, 174 are operable to this end. Hydraulic accumulators and system equipment of suitable design provide a rising movement to maintain the proper level of the body of water for ventilation exhaust.

As noted earlier, the invention employs the compensating piping/valve station 148 (FIG. 11) located within the mid-span region of the tubular tunnel section 96, 96A at both internal outboard locations (that is, port and starboard). The compensating piping/valve system is operable to alter the fluid ratio (water to air) in both the dual use internal tanks 78 and the topside external buoyancy compensating tank 76. The pipe 148A of the compensating piping/valve station 148 is interconnected such that one station can control the tanks on both sides, if required. The interconnection of the pipe 148A allows the fluid tanks 78 on both sides to introduce water or introduce air to ballast at a controlled rate. Due to the traffic directional flow conditions within the tunnel system 20, one side of the tank system for the underwater tunnel system could be taking in water while the other side is taking in air. The air is taken from the open tunnel environment and forced into the applicable tank envelope to discharge water. This air and water exchange is an integral part of the concept for maintaining buoyancy for either a Type II or Type III underwater tunnel system.

The internal, or dual use, tank 78 configuration is utilized (1) during construction of the system 20, for submerging tubular tunnel sections 96, 96A, and (2) during operation of the system 20, for maintaining specific buoyancy based upon dynamic traffic flow changes over a projected period of time.

The buoyancy compensating or topside external tank 76 is predominantly filled with air to insure that positive buoyancy is maintained during the installation on-site effort when the tubular tunnel sections are in a floating condition to enable access through the Logistic Access Trunk (LAT) 158. Once the installation activities are completed, then the access areas will be secured and the topside external tank 76 is flooded as prescribed to cause the tubular tunnel sections 96, 96A to submerge.

These two tank configurations, that is, the dual use fluid tanks 78 and the buoyancy compensating tank 76 can be operated, monitored and changed to accommodate the positive buoyancy conditions of the overall tunnel length to insure minimum stresses on the join areas for the tubular tunnel sections. The submergence of the tubular tunnel sections may also require the use of the temporary collapsible bladders 150 if sufficient ballast material is not provided because of certain tunnel size limitations. The compensating piping/valve station 148 , therefore, also has the capability of filling the temporary bladders via the temporary hoses 152 and suitable connections with the station 148. Once the installation procedure has been completed, the temporary collapsible bladders 150 are removed to enable the positive buoyancy conditions necessary to neutralize the projected traffic flow conditions once the tunnel becomes operational. The former two tank configurations, however, may be utilized thereafter to raise a tubular tunnel section for replacement and/or major maintenance activities.

It is now proper to explain in greater detail the operation of the dual use tank arrangement. Consider that one or more of the tubular tunnel sections 96, 96A, each with the bulkhead closure 98 secured at both ends and with the dome member 100 at the forward end, have been transported to a location on the body of water 26 distant from the first and second shores 22, 24 using suitable tugs 180 (FIGS. 18–21). By the appointed time for the tubular tunnel section 96, 96A to be submerged, a plurality of the structurally defined dual use fluid tanks 78 will have been installed. The elongated topside support structure 74 including the buoyancy compensating tank 76 will also have been installed. Additionally, a plurality of the temporary collapsible fluid bladders 150 will also have been positioned on roadways 82, 84 (FIGS. 9 and 14) within the internal compartment 108 of each of the mobile tubular tunnel sections and their hoses 152 connected to the compensating piping/valve station 148.

Figure 22:
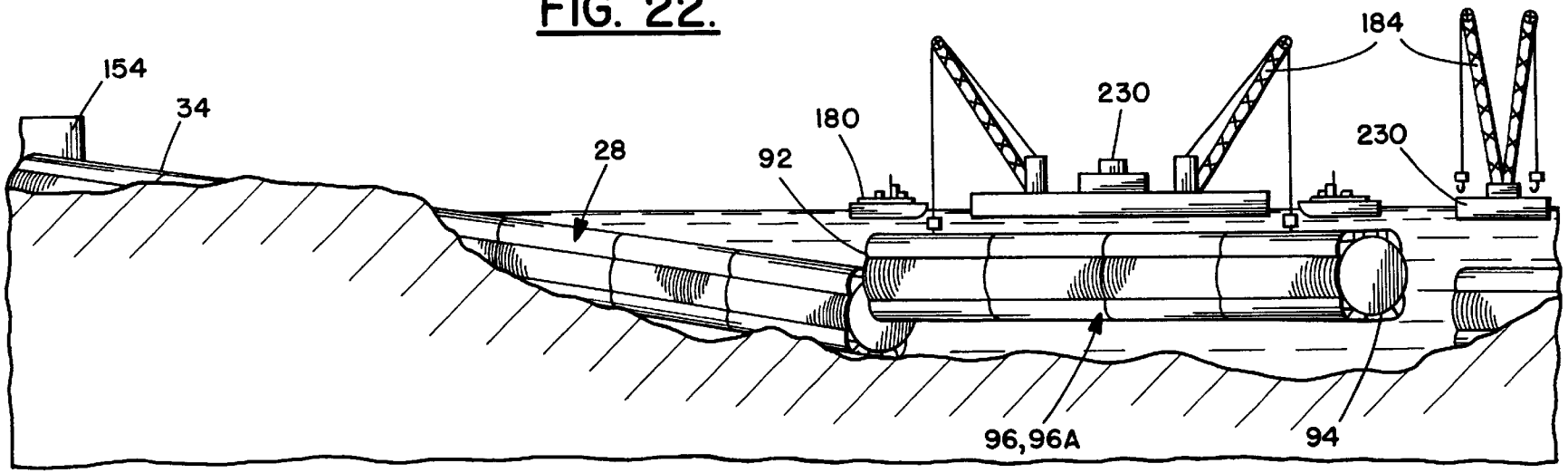
Figure 23:
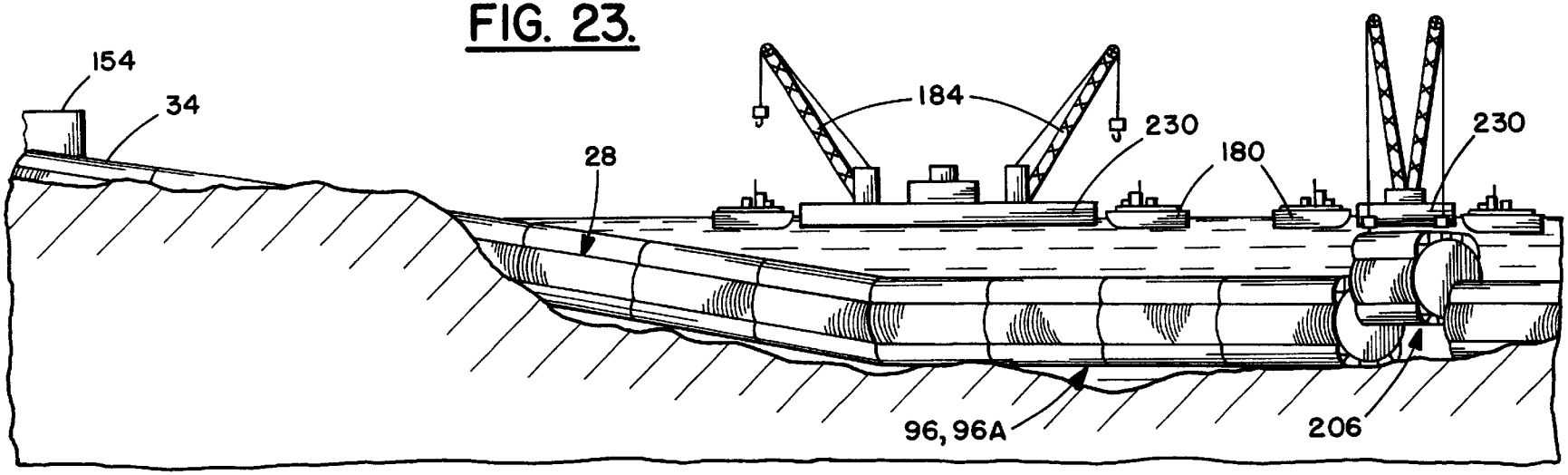

With this arrangement, the compensating piping/valve station 148 is operated so as to selectively fill with water one or more of (i) the internal dual use fluid tanks 78, (ii) the buoyancy compensating tanks 76, and (iii) the temporary collapsible fluid bladders 150, causing the mobile tubular tunnel section 96, 96A to descend to a predetermined depth generally at a level of the distal ends of the inclined stationary tubular tunnel sections 28, 30 (see FIGS. 22 and 23). By means of water-borne cranes 184, the mobile tubular tunnel section is guided such that when it reaches the predetermined depth it is generally aligned with the inclined stationary tubular tunnel sections or with other, already submerged, mobile tubular tunnel sections to which it is to be joined. After the joining operation, which will be described below in detail, the fluid tanks of all the tubular tunnel sections are suitably integrated to form fluid tank systems.

Once integration has been performed to form fluid tank systems, water is discharged from the temporary collapsible fluid bladders 150 which are then stored or removed for use elsewhere. Thereupon, the water contained in the fluid tank system of the dual use fluid tanks 78 is discharged. Each of the fluid tanks 78 is then partitioned into the mutually isolated upper air compartment 146A and lower water compartment 146B. This is achieved by means of the baffle plate 144.

While the baffle plate 144 has already been in position before submergence of the tubular tunnel section, it permitted flow of water with relative freedom between the compartments 146A and 146B based upon access openings. However, after integrations of each individual tubular tunnel section into the system 20, the baffle plate 144 is suitably modified to isolate the upper air compartment 146A from the lower water compartment 146B.

As will be described in greater detail below, each of the mobile tubular tunnel sections, when employed in the Type II or Type III tunnel configurations, is attached to the bottom 312 of the body of water 26 for limited elevational movement. Water can then be selectively introduced to, or discharged from, the topside buoyancy compensating tanks 76 and the lower water compartments 146B to compensate for the weight of the traffic traveling through the underwater tunnel system. Various combinations and permutations of operation can be performed by the selective operation of the compensating/piping valve station 148. Thus, water may be selectively introduced into the water compartment 146B for causing descent of the mobile tubular tunnel sections of selectively discharged from the water compartment for causing its ascent, within the prescribed limits.

Also, water may be introduced selectively to the port fluid tanks and simultaneously discharged from the starboard fluid tanks, or vice versa in order to compensate, for example, for heavier traffic occurring on one side of the tunnel system 20 than on the other side.

It will also be appreciated that the upper air compartment 146A (FIG. 12) is then available for connection to the land-based ventilation transition buildings 154 as an integral part of the ventilation system for the underwater tunnel system 20.

It was earlier mentioned that ballast material 118, for purposes of the invention, is preferably located in three regions, specifically: (a) in the internal frame bay envelope 104, particularly, below the main axis for the tubular tunnel section 96, 96A, (b) in the internal lower tank support structure 132, and (c) external bottom support tank structure 70 which is designed to fully store the ballast material. The ballast material 118 preferably comprises concrete or slag and partially lead, or other suitable material or materials as required to yield a material having a density greater than about 135 pounds per cubic foot. The overall weighted ballast distribution insures that the proper center of gravity is maintained throughout all phases of construction and installation to assure tunnel stability and proper orientation. Access openings and holes, such as the orifices 134 are located to easily permit the flow and installation of ballast material. The ballast material in the frame bay envelope is contained by the arcuate interior panel 102.

In keeping with the intention of the invention to utilize submarine technology in all phases of the construction and operation of the underwater tunnel system 20, a specific ballasting plan is intended to be implemented to account for the sequential addition of the ballast material 118 such as concrete, slag, and/or lead. The ballast material is to be placed in the following regions of the structure of the tubular tunnel section 96, 96A, as required:

(a) lowermost portions of the internal frame bay envelopes 104;

(b) external bottom support tank structure 70;

(c) internal lower tank support structure 132;

(d) increase of roadway 82, 84 deck thickness (concrete 138 and asphalt 140) to provide additional ballast to support the structural dynamic loading conditions; and (e) lead as an option for the internal lower tank support structure 132 to insure weight distribution stability of the tubular tunnel section 96, 96A.

The ballast material may be added during tunnel subsection tunnel section, and installation on-site work activities. The ballast material installation will be configured to transport (float) the tunnel sections as high (buoyant) as possible versus the optimum accomplishment of manufacturing work activities. The next phase involves adequately weighting the tunnel sections in order to reach a submergence condition (negative buoyancy) for positioning the tubular tunnel sections for final joining locations and external attachments. The use of internal and external compensating tanks is to be the mechanism for changing buoyancy conditions from positive to negative. If additional weight is required for tunnel installation, (to provide negative buoyancy), temporary ballast can also be supplied by placing the oversized temporary flexible bladders 150 along the individual lanes of each roadway 182. These temporary bladders can be inflated with water via the temporary hoses 152 to the compensating piping/valve station 148 to provide the additional weight. The size of the bladders is preferably about eight feet by six feet by sixteen feet or greater in order to accommodate at least about 750 cubic feet of water weight per roadway lane per individual tubular tunnel section. Once the tubular tunnel section has been secured by the external attachment system, then the bladders 150 can be discharged of water and deflated, then stored until the next use or removed from the tubular tunnel section, as desired.

The earliest stages of the fabrication process for the underwater tunnel system 20 using submarine construction technology have already been described with reference to FIGS. 5–8. This part of the fabrication process accounts for up to 85% or more of the effort for the entire construction of the system and is land-based and off-site in distinct contrast to known underwater tunnel construction technology. Continuing with reference to FIGS. 7A and 8, it is seen that the assembly transport process utilizes a plurality of mobile cranes 61 and fixed overhead cranes 186.

A graving dock 188 adjacent the body of water 26 and adjacent the land-based assembly location includes a submersible pontoon 190 movable between a raised floating position (as indicated by dashed lines) level with the land and a lowered (as indicated by solid lines) submerged position. A marine rail grid track system 192 (indicated as being in the plane of the surface of the land at the construction site) extends between the construction site and the graving dock 188 and is also provided on the submersible pontoon 190. A movable elongated platform 194 (FIG. 7B) includes a wheel-based rolling equipment system with industrial land-based transporters 196 rollingly engaged with the marine rail system 192 and serves to supportingly receive thereon the tubular tunnel section 96, 96A.

With this construction, the elongated platform 194 supporting the tubular tunnel section is capable of being moved across the marine rail system 192 and onto the submersible pontoon 190 when the submersible pontoon is in the raised (dashed line) position. This occurs when water has been introduced into the graving dock 188, causing the pontoon 190 to rise to the level of the land. Subsequently, the submersible pontoon can be moved to the lowered submerged position, allowing the tubular tunnel section 96 to float in the water (FIG. 8).

The industrial land-based transporter 196 serve to significantly accelerate the tubular tunnel section joining process. It will be appreciated that the construction of the tubular tunnel section 96 can be completed either in a floating environment (FIGS. 18–21), in a floating dry-dock (not shown), or in the land-based graving dock 188 depending upon the capabilities of the material handling and lifting cranes available. Thus the assembly process for constructing a tubular tunnel section 96 (typically about 450 feet to 600 feet long) can be accomplished by utilizing the large transport capability of the stationary and fixed overhead cranes 186 (FIGS. 7A and 8), 61 (FIG. 7), respectively, (as found in shipyard construction today) and/or the industrial land-based transporters 196 operatively movable on the marine rail system 192.

Figure 24:
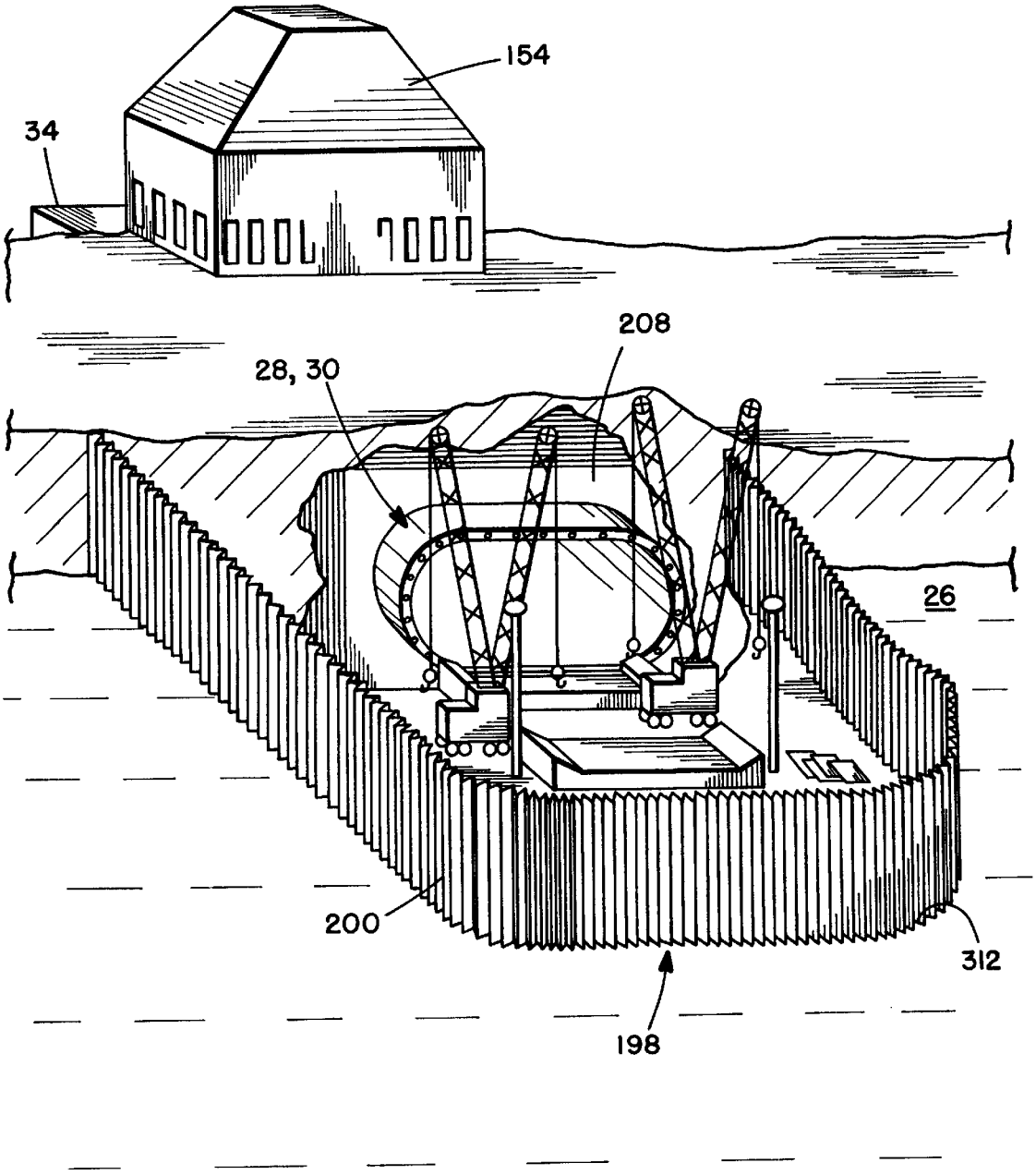
FIGS. 24 and 25 are perspective views of an on site cofferdam work area encompassing a join area at the interface between a pair of tubular tunnel sections to establish the proper inclined slope and illustrating successive steps relating to the joining procedure.
Figure 25:
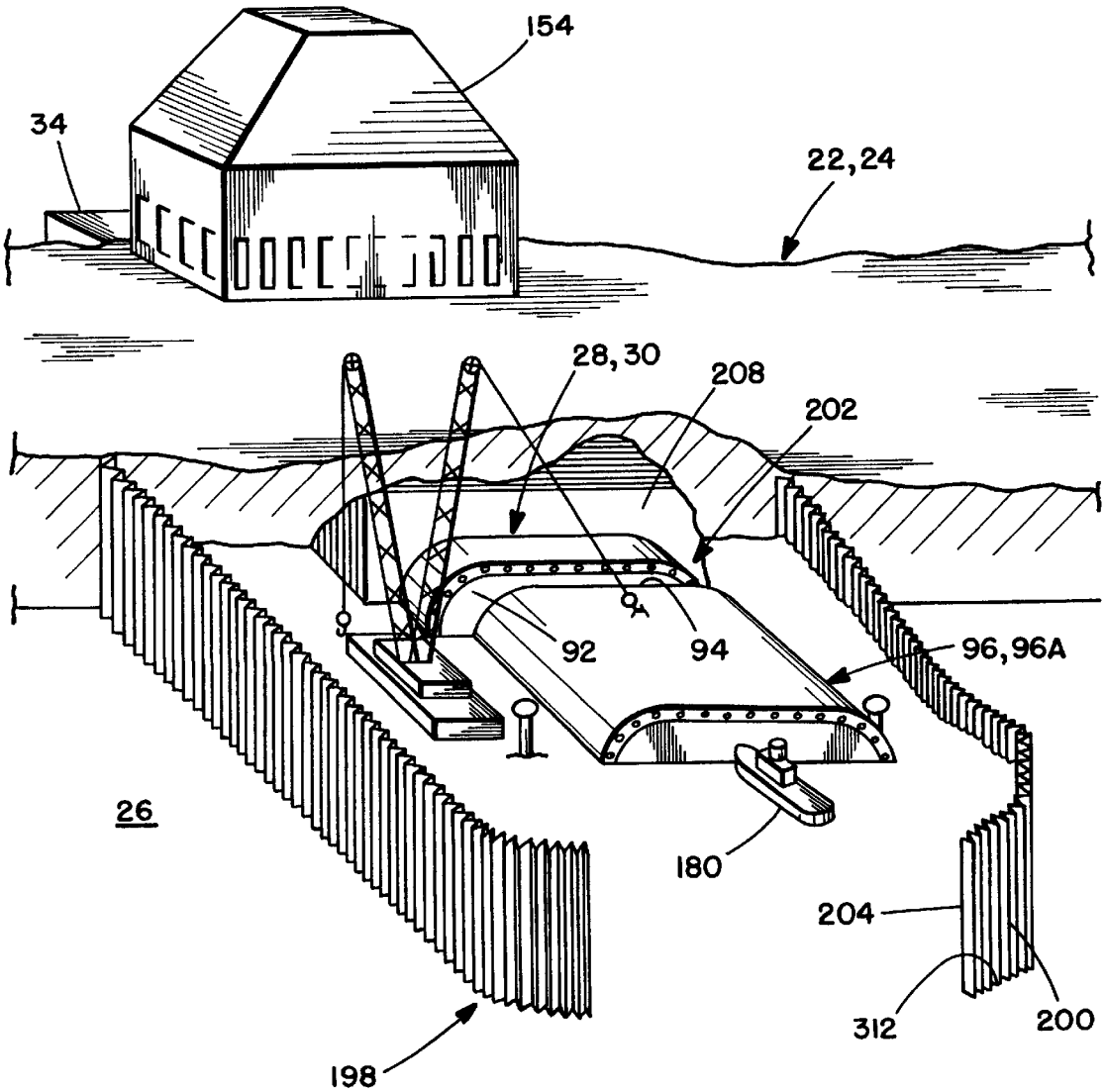

In order to join a mobile tubular tunnel section 96, 96A to a stationary tubular tunnel section 28 or 30 or, indeed, a pair of opposed mobile tubular tunnel sections, an operational sequence may be initiated whereby an external cofferdam 198 is established around the join regions of the tubular tunnel sections to permit structural welding activities to be performed. Such an operation may become better understood with reference to FIGS. 24 and 25 which illustrate the joining of a mobile tubular tunnel section to a stationary tubular tunnel section 28, 30.

For accomplishment of this procedure, the mounting ends 92, 94 must be installed on the opposed ends of each mobile tubular tunnel section and on the facing end of the inclined stationary tubular tunnel section. Viewing FIG. 24, the cofferdam 198 is constructed having suitable upstanding walls 200 extending from the bottom 312 of the body of water 26 to a height above the surface of the body of water. Following proper installation of the mounting ends 92, 94 on each tubular tunnel section, an entry port 204 is created through which one or more tugs 180 can deliver a mating mobile tubular tunnel section 96, 96A. When the mobile tubular tunnel section is fully received within the confines of the cofferdam 198, it encompasses an attachment region 202 (FIG. 25) including the opposed mounting ends 92, 94 of the inclined stationary tubular tunnel section 28, 30 and of the mobile tubular tunnel section 96, 96A to be attached together. Thereupon, the joining operation is performed in a manner to be described resulting in the joined construction illustrated in FIG. 26.

The waterborne tunnel sections joining method will require that holding bulkhead closures 98 are completely installed to ensure watertight integrity and to prevent internal flooding.

The basic design configuration of the invention insures that operations resulting in assembly of the tubular tunnel sections can be accomplished in either a land-based or waterborne sequence. The waterborne tunnel sections joining method will require that holding bulkhead closures 98 are completed to prevent internal flooding. The terminal boundary of the underwater tunnel system 20 is secured along the uppermost region of an inclined stationary tubular tunnel section to its associated land-based ventilation transition (vent) building 154. The interface must insure that the structure of the tubular tunnel sections is properly aligned during the land-based joining sequences. The overall alignment of the underwater tunnel system between both shores in critical to insure that a final tubular tunnel section for installation, represented by a section insert 206 (FIGS. 23 and 26), is of a specific length, reflecting with tolerance buildup, to accomplish the final underwater joining. The land-based transition is preferably by means of encapsulation in concrete 208 (FIGS. 24 and 25) of the external inclined tubular tunnel section 28, 30 to insure structural integrity. All tunnel systems will be integrated to pass through the ventilation transition buildings for monitor and control of the status of all operational and functional systems.

Figure 30:
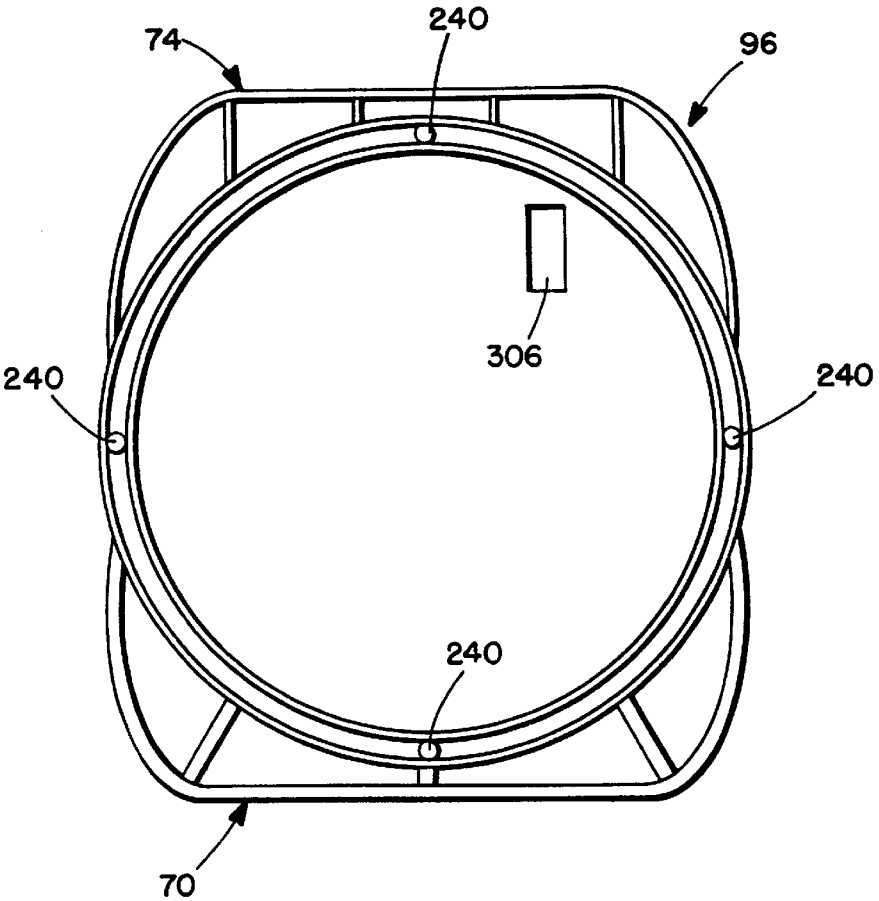
FIG. 30 is a detail cross section view of a cylindrical tubular tunnel section with provision for engagement with a similar mating tubular tunnel section.
Figure 31:
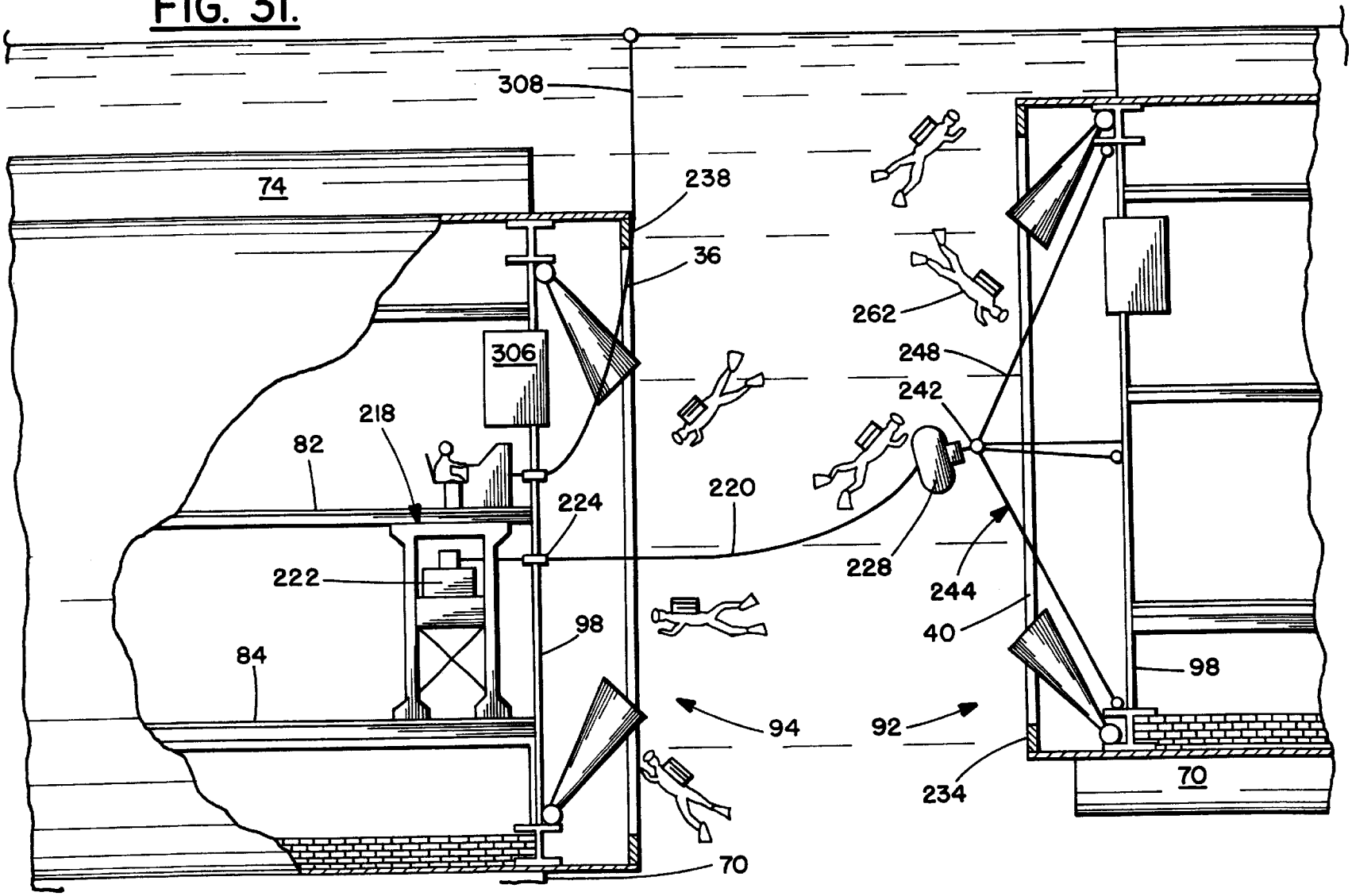
FIG. 31 is a side elevation view, of facing mounting ends for a pair of opposed tubular tunnel sections, certain (aspects) being cut away and shown in section, illustrating the submergence of a tubular tunnel section to be aligned with a mating, already submerged, tubular tunnel section.

The invention will require that an alignment methodology be established such that the inclined tubular tunnel sections at both sides of the body of water 26 can be properly aligned for accepting the horizontal, or mobile, tubular tunnel sections. To this end, the distal ends of the inclined stationary tubular tunnel sections 28, 30 and the opposed ends of the mobile tubular tunnel sections 96, 96A are provided at their top centerlines with fixture holding supports 210 to place vertical alignment rods 212 (FIG. 27) in a rigid position extending above the waterline. Alignment positioning pins 240 (see FIGS. 30 and 34) can be used in the floating condition as the tubular tunnel sections are joined together in an extended tunnel section configuration prior to submergence. These positioning pins allow for critical cylinder/extended cylinder interface alignment. The alignment methodology requires that each tubular tunnel section join area be configured for the progressive alignment process and distance measuring evaluation.

Figure 27A:
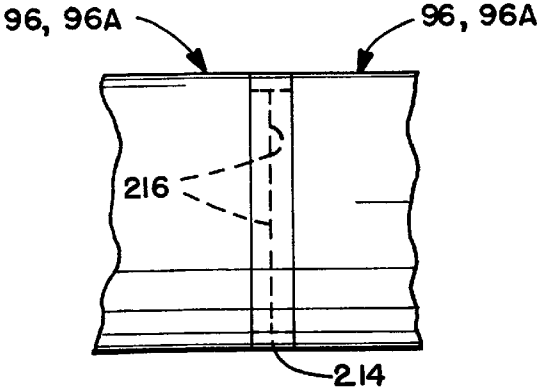
FIG. 27A is a detail side elevation view illustrating the steps in the procedure of joining the opposed mounting ends for the tubular tunnel sections.
Figure 27:
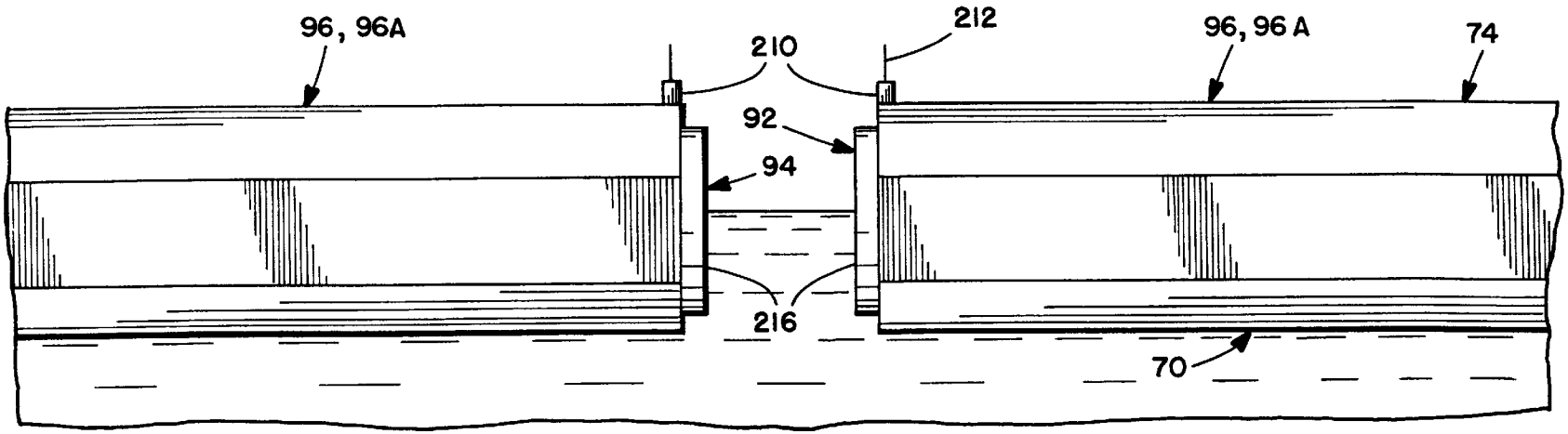
FIG. 27 is a side elevation view illustrating a pair of longitudinally aligned tubular tunnel sections in a floating condition and juxtaposed for a joining operation.
Figure 20:
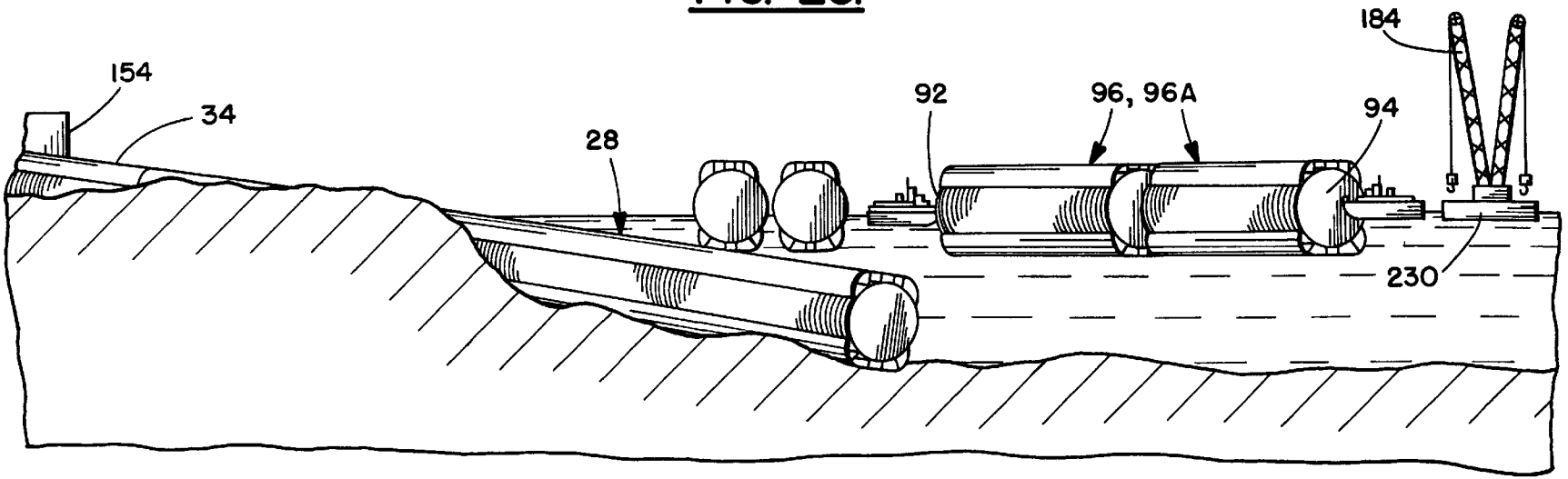
FIGS. 20–23 are generally side elevational views, partly in section, illustrating successive steps in the construction of the underwater tunnel system, at one of the opposing shores with initial positioning of the tubular tunnel sections in a floating condition, then assembling and joining the tubular tunnel sections, then submerging them for the operation of joining them to the inclined stationary tubular tunnel section.
Figure 21:
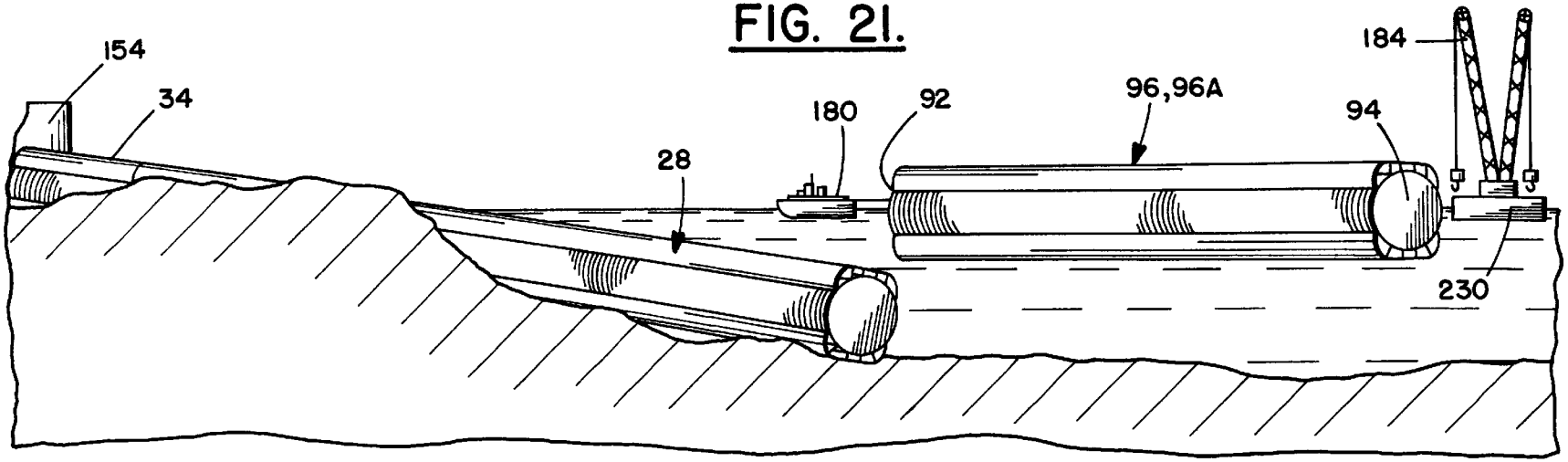

Viewing FIGS. 27 and 27A, the continuous measurement and alignment methodology for the invention insures that the final section insert 206 can be properly installed including a liner 214 extending between boundaries 216 of the two tubular tunnel sections 96, 96A. The final section insert 206 has the capability to use a specified liner thickness to accommodate the final separation distances on each end.

Preferably, the installation of the system 20 will be predominantly in 500 foot tubular tunnel sections which will be towed (FIG. 18), in a floating, or positive buoyancy, condition, to the installation site. In order to accelerate the transport of tunnel sections, elliptical shaped dome members 100 of Glass Reinforced Plastic (GRP), steel or other suitable material are temporarily attached to the front portion of the lead tubular tunnel sections. These dome members provide the optimum hydrodynamic shape for transporting the tubular tunnel sections together with the capability of being easily removed for reuse.

During the submergence operations for the tubular tunnel sections, a cable winch system 218 is utilized, viewing FIGS. 28–35. While the ensuing description will be concerned with joining a mobile tubular tunnel section 96, 96A to a stationary tubular tunnel section 28, 30, the procedure will be the same for joining a newly submerged mobile tubular tunnel section to an already submerged tubular tunnel section. The cable winch system 218 is initially installed through the bulkhead closures 98 for the stationary inclined tubular tunnel sections 28, 30. A floatable tension line 220 is extended through the holding bulkhead closure from the temporary hydraulic winch mounted on the lower roadway 84. The tension line 220 extends from a centrally disposed winch 222 within an extreme end of each of the tubular tunnel sections 28, 30, through a centrally positioned watertight stuffing tube 224 in the bulkhead closure 98 to a suitable connector 226 which is initially supported above the surface of the body of water 26 by a suitable float 228.

Once the submergence tank flooding is initiated, the cable winch system 218 serves to guide together the pair of adjoining tubular tunnel sections during submergence of the mobile tubular tunnel section 96, 96A (see FIGS. 20–23). The positioning and rate of submergence of the tubular tunnel section 96, 96A will be controlled by at least two waterborne cranes 184 on barges 230 in conjunction with the compensating piping/valve station 148. The cable winch system 218, in conjunction with the controlled submergence of the mobile tubular tunnel section, allows a distal end 36 of the appropriate stationary inclined tubular tunnel section 28, 30 to be joined to the appropriate end 40, 42 of the now submerged mobile tubular tunnel section 96, 96A.

As earlier noted, on-site installation will require at least two barges 230 which are at each end of a mobile tubular tunnel section 96, 96A to be submerged, then lowered into its final position. The submergence of a tubular tunnel section, typically about 1,500 to 1,800 feet long, will utilize submarine technology to control the ballast/compensating buoyancy conditions. Therefore, the barge crane lifting capability will be primarily utilized for guiding the tunnel section to its attachment location.

Figure 46:
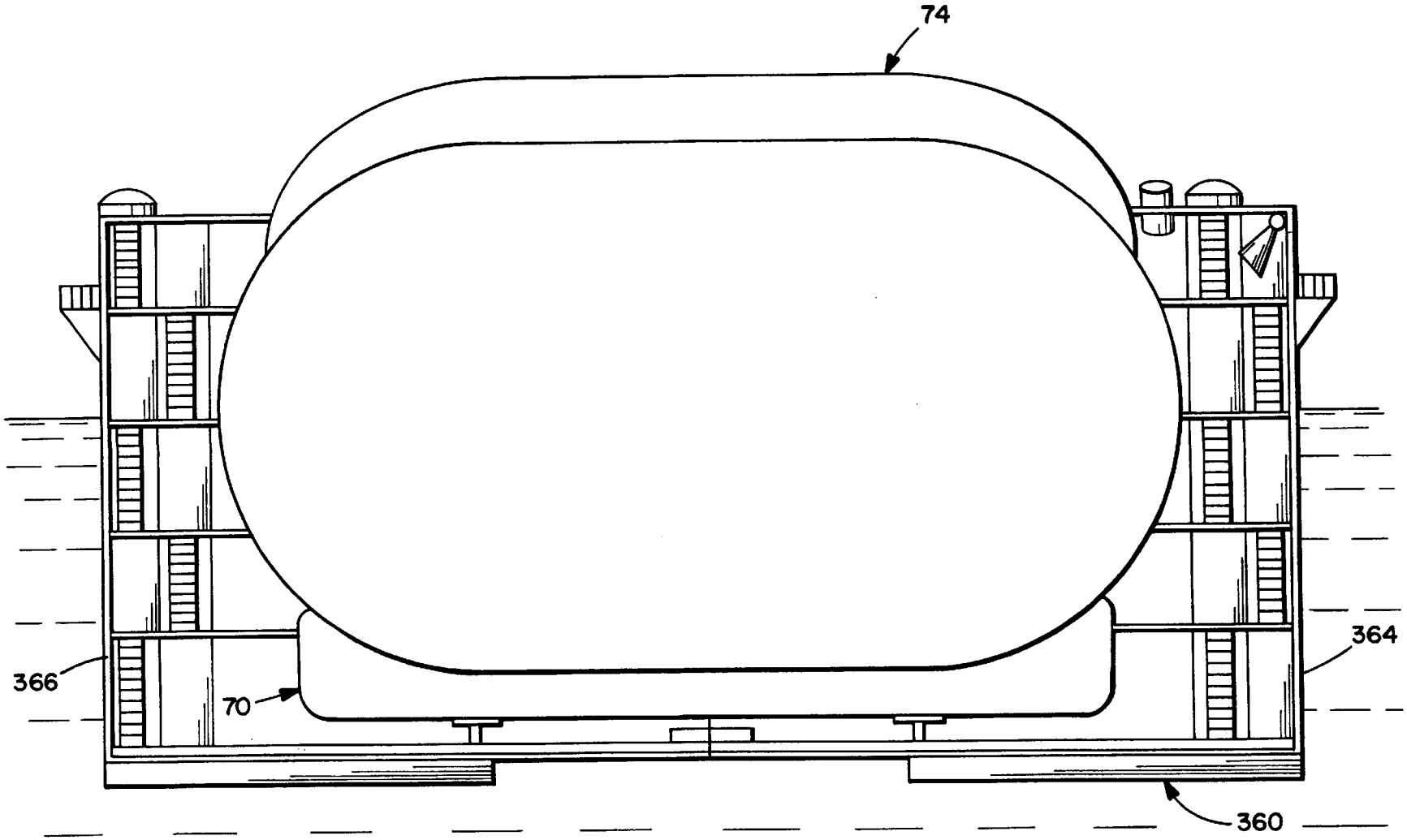
FIG. 46 is a an end elevation view, in section, of a floating dry dock intended for welding operations for joining waterborne adjacent tubular tunnel sections.

A preferred method for joining mobile tubular tunnel sections 96, 96A, each approximately 500 feet in length, is by welding their ends together at the installation site by mechanically aligning and joining them while in a floating, above water, condition. Viewing FIG. 46, a floating cofferdam 360 for welding operations for joining adjacent tubular tunnel sections may be provided. It may include opposed sections 362, 364 which envelop the attachment region 202 of the adjoining tubular tunnel sections and are suitably joined in a watertight manner to provide a dry environment for the welding operation. As seen especially well in FIG. 46, the topside support structure 74 and the bottom support tank structure 70 are recessed from the extreme end of its associated tubular tunnel section, typically by about two and a half feet (2½'). This provides for a cofferdam width to accommodate a span of about four feet (4') to cover this weld area. This cofferdam configuration can also be replaced for working in submerged depth conditions by ensuring that an external pump system can remove water, as required, and by providing the tubular tunnel sections with access cuts or watertight hatches 306 (FIG. 8A) on the port and/or starboard sides, as required. The cofferdam 360 is preferably spaced about five (5') feet from the hull plating 54A to accommodate the set up of semi- or fully automated welding equipment. The majority of the weld (bead) material shall be accomplished within the internal tubular hull plating area. The cofferdam 360 allows for welding personnel to conduct their operations either as the tubular tunnel sections float or possibly once the tubular tunnel section is submerged.

The invention offers three (3) different tubular tunnel section joining techniques in a submerged condition for the underwater connection of the major extended tunnel sections. There are two (2) mechanical joining techniques that can be utilized, the first is a mechanical bolting configuration and the second is the insertion of an inner sleeve between the tunnel end sections that can be welded in place once properly positioned. The third joining technique utilizes cofferdams around the tunnel end section joining area where a full welding technique can be completed both externally and internally. The two primary mechanical joining methods for tunnel sections are: (a) mechanical bolting (about 200 locations) of two cylinder web plating sections installed at the edge of each tunnel section using a pull concept by the use of hydraulic actuators, and (b) installation of an inner sleeve cylinder (circular structural ring) which is about eighteen inches (18") in length an recessed just within the tunnel section inner plating boundary and moved in place by using a push concept from hydraulic actuators.

As previously stated for the ensuing discussion, it makes little difference whether the sections being joined are the inclined stationary tubular tunnel sections 28, 30 or the mobile tubular tunnel sections 96, 96A. For ease of explanation only, the discussion will be limited to the joining of opposed mobile tubular tunnel sections 96, 96A. As previously noted, each of the tubular tunnel sections is formed of a plurality of coaxial endless structural rings 46, 46A lying in parallel spaced apart planes extending between first and second mounting ends 58, 60. A plurality of the hull plate members 54 overlie the structural rings and are fixed thereto as by welding. The plurality of structural rings 46, 46A and the hull plate members 54 together define a pressure hull having a hull bottom and a hull topside. A bulkhead closure 98 is suitably fixed to one of the structural rings 46A at a first mounting end 92 and, similarly, a bulkhead closure 98 is fixed to one of the structural rings 46A at the second mounting end 94.

The watertight joint to be formed at the interface between two tubular tunnel sections 96, 96A includes the facing mounting ends 92, 94. The mounting end 92 includes a peripheral flange 234 having a plurality of peripherally spaced positioning holes 236 therein. The mounting end 94 includes a peripheral flange 238 having a plurality of peripherally spaced longitudinally projecting positioning pins 240 generally aligned with the positioning holes 236 of the peripheral flange 234 when the juxtaposed tubular tunnel sections are substantially aligned. An operative mechanism which will be described momentarily operates to draw the peripheral flanges 234, 238 into a preliminary pre-closure orientation (FIGS. 32 and 33) lying, respectively, in parallel proximately spaced planes.

The operative mechanism just mentioned includes the winch 222 within the tubular tunnel section adjacent the bulkhead closure 98 at the mounting end 94, the bulkhead closure being formed with the centrally positioned watertight stuffing tube 224 therein. It also includes a closure ring 242 positioned intermediate the facing mounting ends 92, 94, a harness 244 attached, respectively, to the peripheral flange 234 and to the closure ring, and the tension line 220 attached at one end to the winch 222, extending through the centrally positioned watertight stuffing tube 224 in the bulkhead closure 98 at said first mounting end, and removably attached at an opposite end to the closure ring 242.

Figure 28:
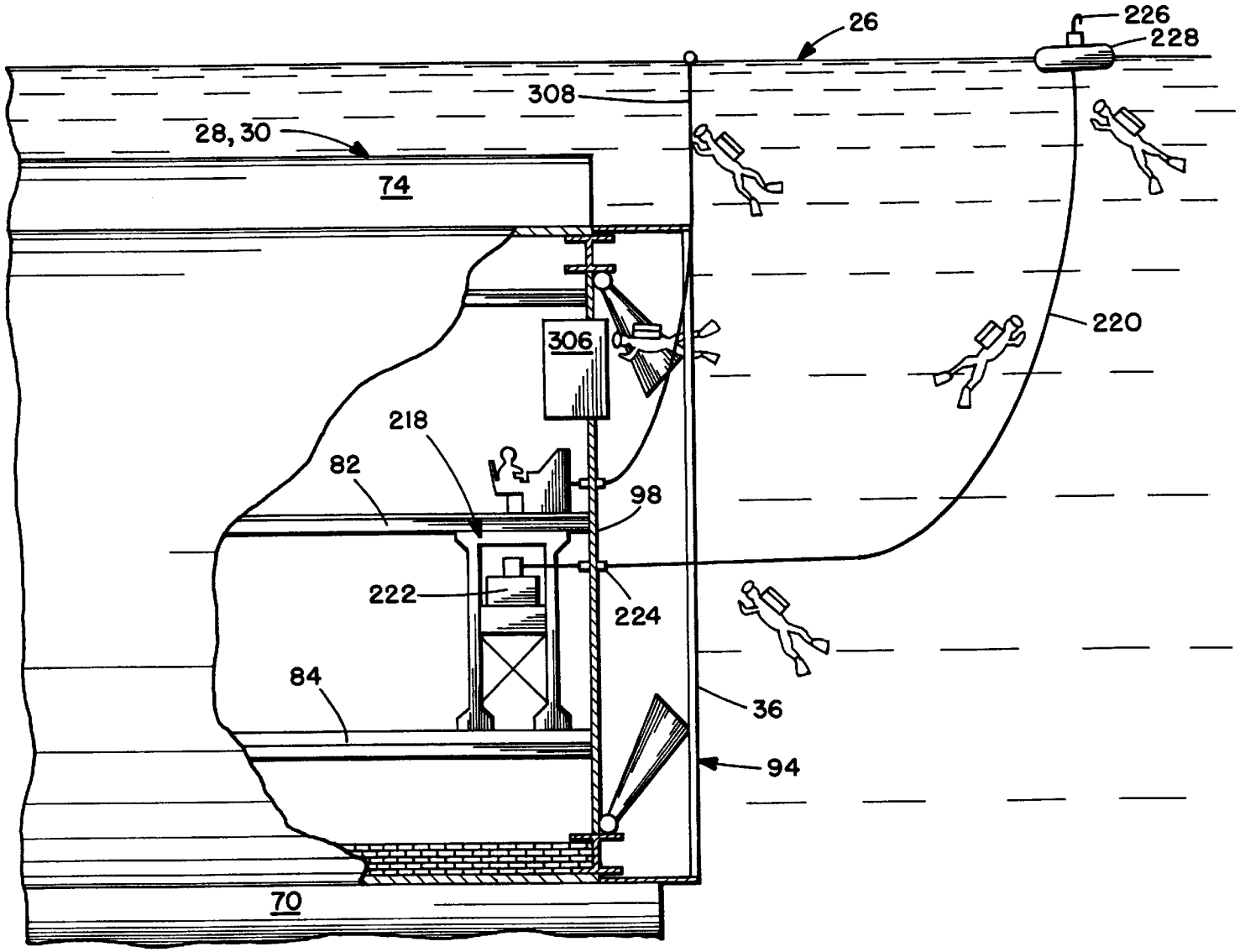
FIG. 28 is a side elevation view, certain parts being cut away, of a mounting end of a tubular tunnel section awaiting descent of a mating tubular tunnel section to be joined thereto.
Figure 29:
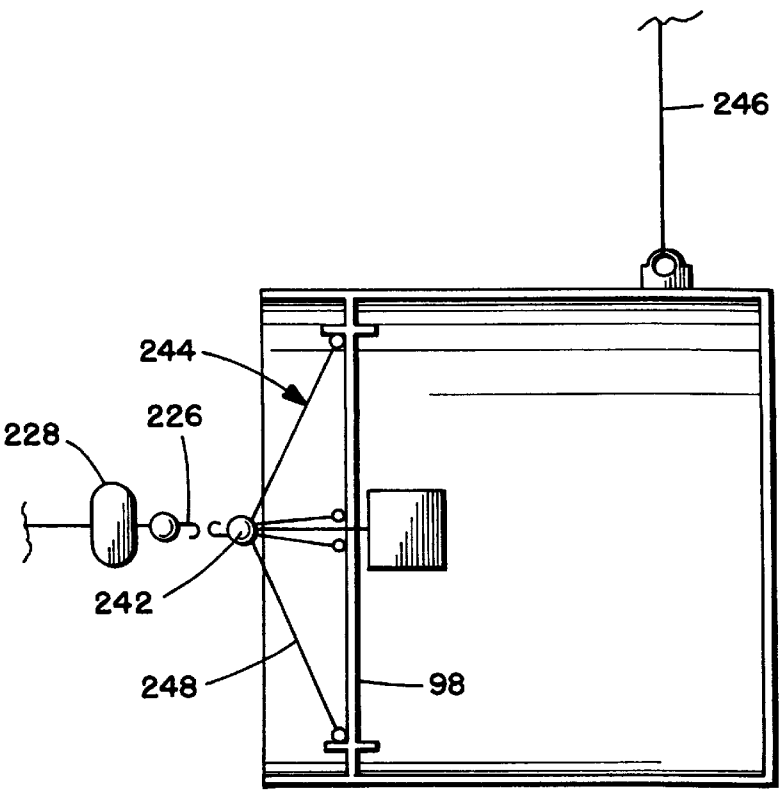
FIG. 29 is a side elevation view of a mounting end of a mobile tubular tunnel section descending for mating to the tubular tunnel section already in place.

As earlier noted, until the tubular tunnel section incorporating the mounting end 92 has submerged to a level which is generally the same as the tubular tunnel section incorporating the mounting end 94, the connector 226 is held above the surface of the body of water 26 by means of the float 228 (FIG. 28). However, upon descent of the movable tubular tunnel section with the aid of guide lines 246 (FIG. 29) to the level generally indicated in FIG. 31, the connector 226, still attached to the float for visibility purposes, is drawn toward the mounting end 94 by the winch 222. Thereupon, the connector 226 is attached to the closure ring 242 (see FIGS. 29 and 31–35).

Figure 33:
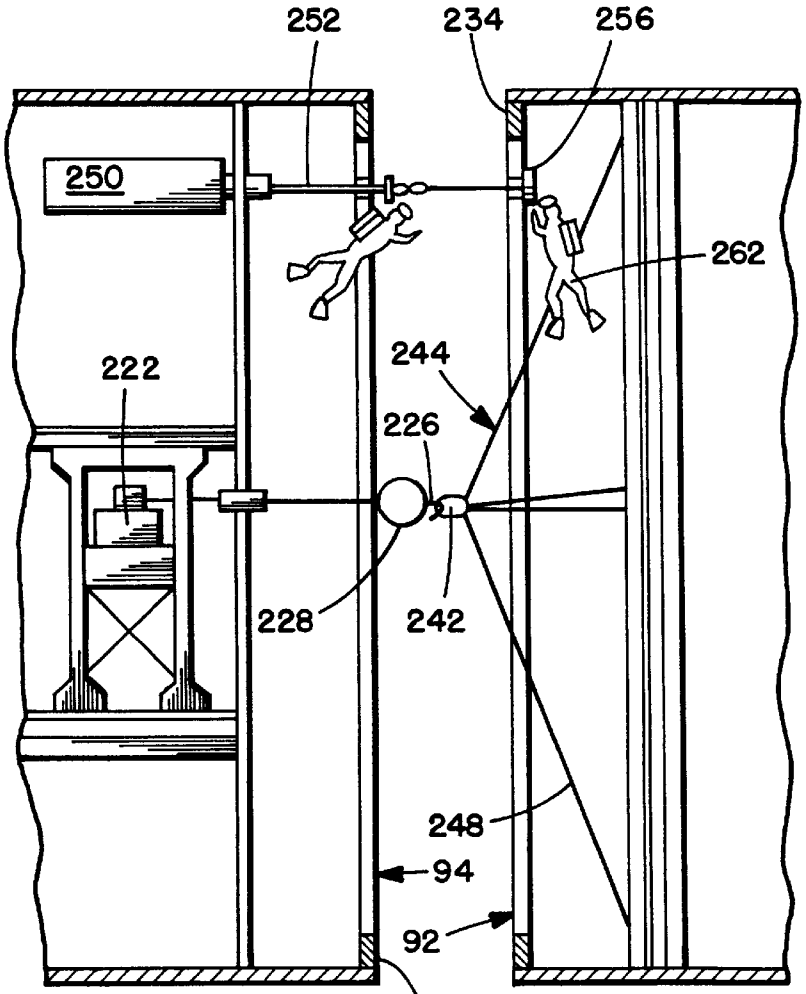
FIG. 33 is a detail side elevation view, similar to FIG. 32, illustrating opposed mounting ends of a pair of tubular tunnel sections lying, respectively, in parallel proximately spaced planes in a preliminary pre-closure orientation and awaiting movement performed by another manner of operation to a final position in an abutting relationship.

The harness 244 includes a plurality of individual leads 248, each of the leads extending between first and second ends, the leads being attached at their first ends to the bulkhead closure 98 of the mounting end 92 at peripherally spaced locations and at their second ends to the closure ring 242. The winch 222 is operable through the tension line 220 and the harness 244 to draw the opposed peripheral flanges together into a preliminary pre-closure orientation (FIGS. 33 and 35). At this point, the mounting ends 92, 94 may be, perhaps, two feet apart.

Figure 36:
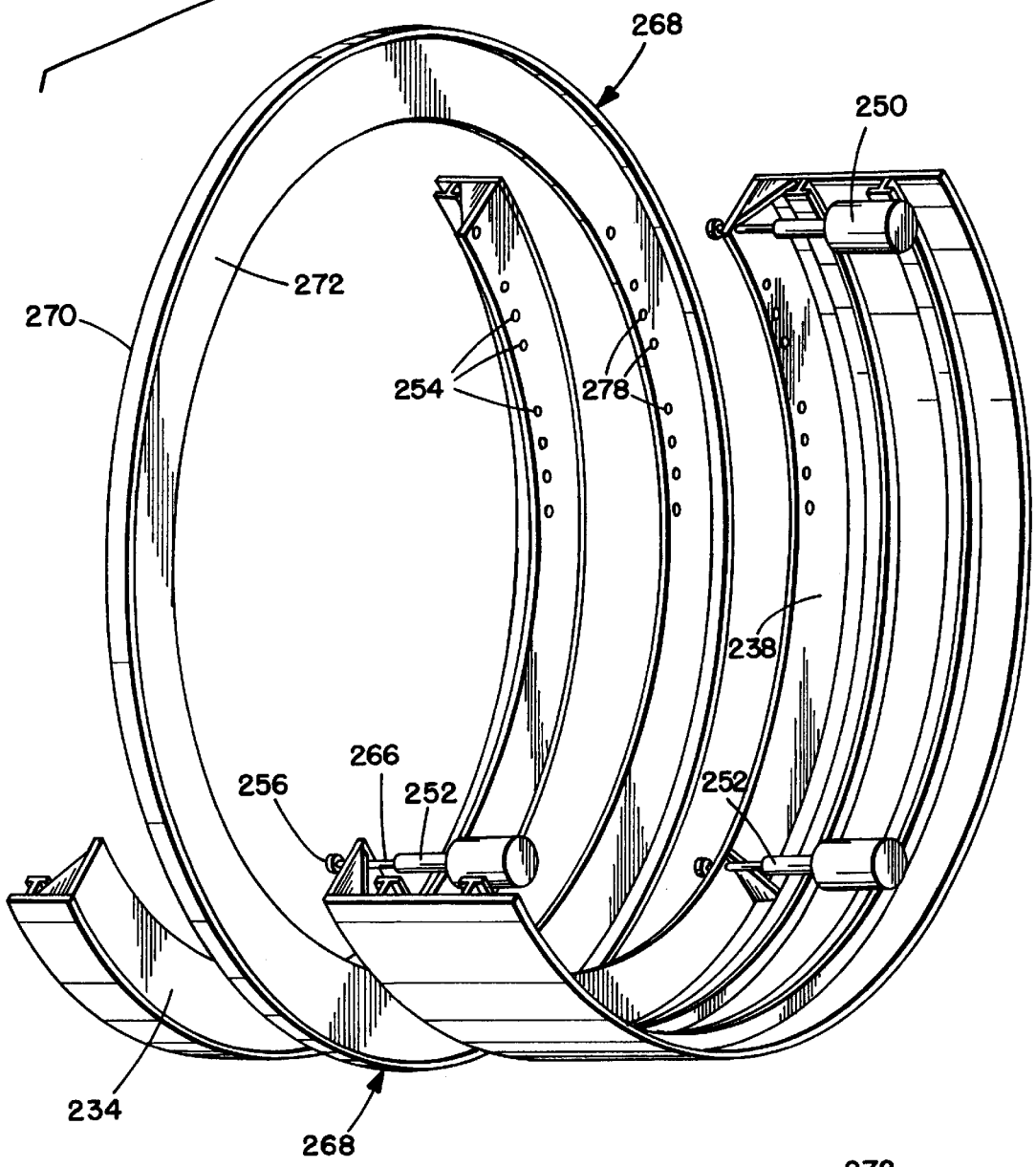
FIG. 36 is an exploded perspective view of components illustrated in FIG. 33.

A plurality of actuators 250 are suitably mounted within the first tubular tunnel section at peripherally spaced locations adjacent the bulkhead closure 98 at the mounting end 94. Each actuator 250 has an actuating rod 252 which extends generally parallel to the longitudinal axes of the opposed tubular tunnel sections. Viewing FIGS. 34, 35A, and 36, the peripheral flanges 234, 238 have a plurality of peripherally spaced fastening holes 254 there through. Connection members 256 (see FIG. 35A) which may include an enlarged head 258 and a centrally disposed hub 260 terminating at an integral attachment loop 264, may be temporarily, releasably, attached to the flange 234 by divers 262 so as to extend through the fastening holes 254 at peripherally spaced locations generally aligned with the actuator rods, respectively. Then, the divers attach pull cables 266 so as to connect terminal ends of each of the actuator rods 252 to their respective associated attachment loop connection members. With this arrangement achieved, operation of the actuators 250, together with the continuing operation of the winch 222, is effective to draw together the peripheral flanges 234, 238 into abutting relationship for subsequent fastening.

Figure 35B:
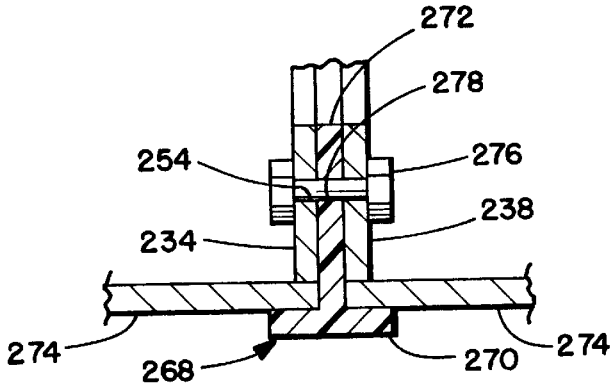
FIG. 35B is another detail cross section view, enlarged, of other components utilized for sectional joining as illustrated along line 35B—35B in FIG. 35.

Viewing FIG. 35B, the watertight joint formed at the interface between the facing mounting ends 92, 94 also includes a continuous resilient barrier member 268 of T cross section having an overlying flange 270 and a radially inwardly extending web 272 deformably interposed between the opposed peripheral flanges 234, 238, the overlying flange proximately overlying outer surfaces 274 of the abutting tubular tunnel sections 96, 96A adjacent their respective mounting ends 92, 94. When the operation of the actuators 250 and winch 222 cease, a plurality of fasteners 276 are thrust through the fastening holes 254 and through mating fastening holes 278 in the barrier member 268 and tightened to thereby fixedly connect together the peripheral flanges 234, 238. Of course, the connection members 256 will subsequently have been removed by the divers to provide for reception in their associated fastening holes 254 of the fasteners 276.

Figures 26, 26A, 26B, 35C:
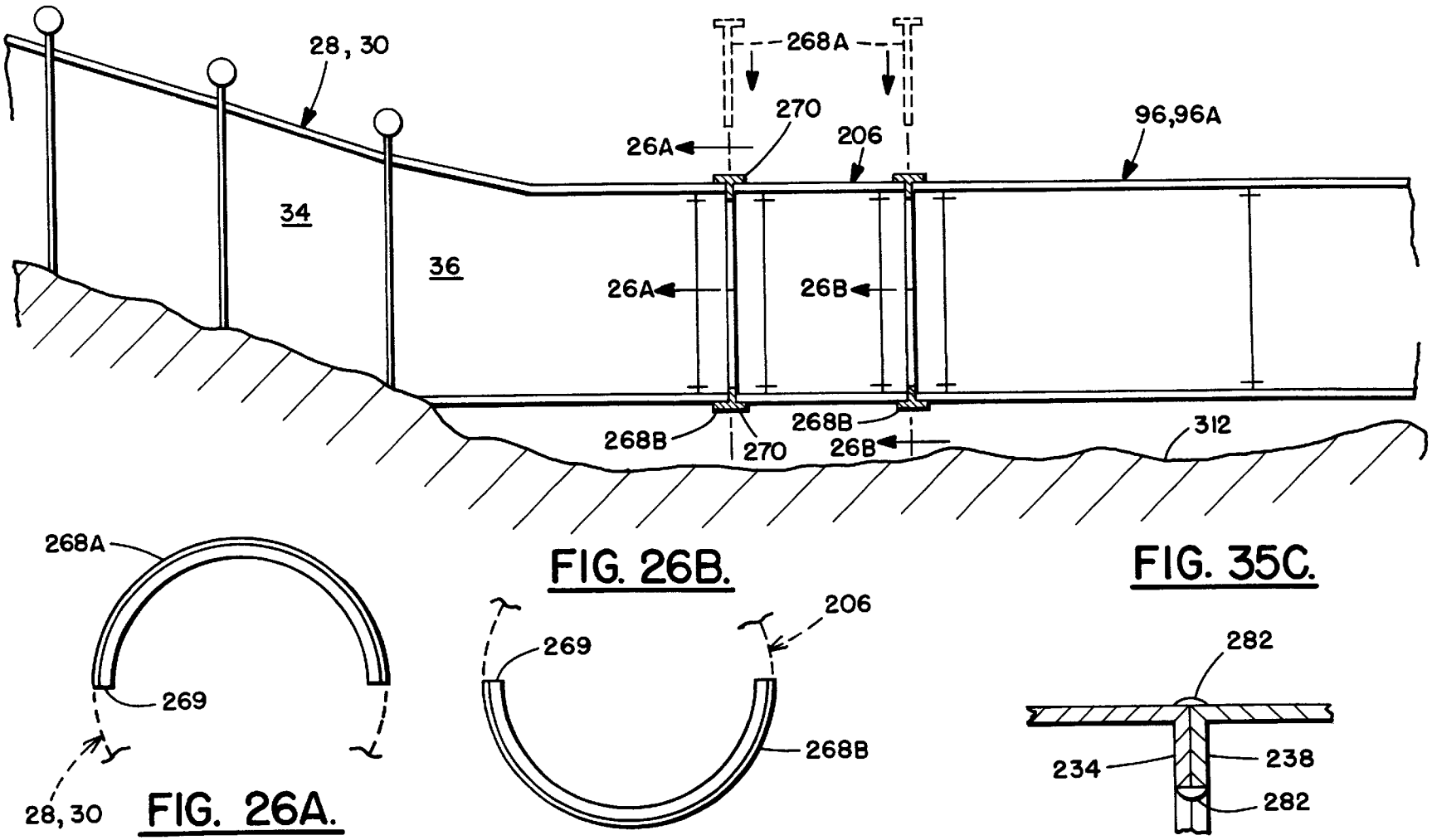
FIG. 26 is a side elevation view illustrating the final connection of predetermined length between a mobile tubular tunnel section and a second stationary inclined tubular tunnel section.
FIG. 26A is a diagrammatic cross section view taken generally along line 26A—26A in FIG. 26.
FIG. 26B is a diagrammatic cross section view taken generally along line 26B—26B in FIG. 26.
FIG. 35C is still another detail cross section view, enlarged, of another mode of joining the components illustrated along line 35C—35C in FIG. 35.

In another embodiment, turning now to FIG. 35C, a welded joint indicated by inside and outside welds 282, respectively, may be employed for fastening together the peripheral flanges 234, 238, in place of the construction illustrated in FIG. 35B.

Figure 37:
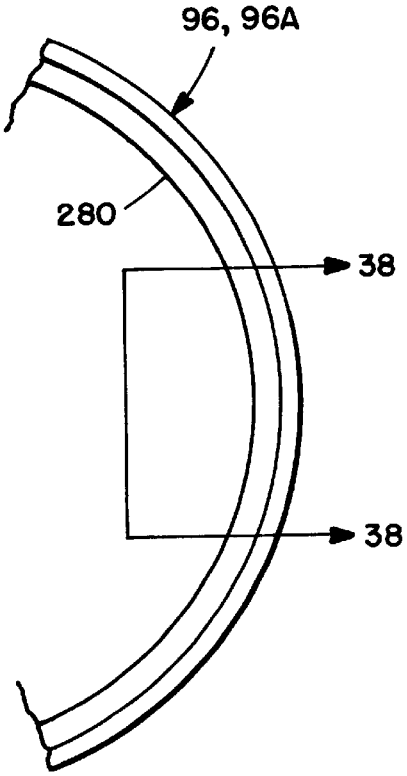
FIG. 37 is a detail elevation view of a construction resulting from a further operation performed subsequent to those depicted in FIGS. 33 and 35.
Figure 38:
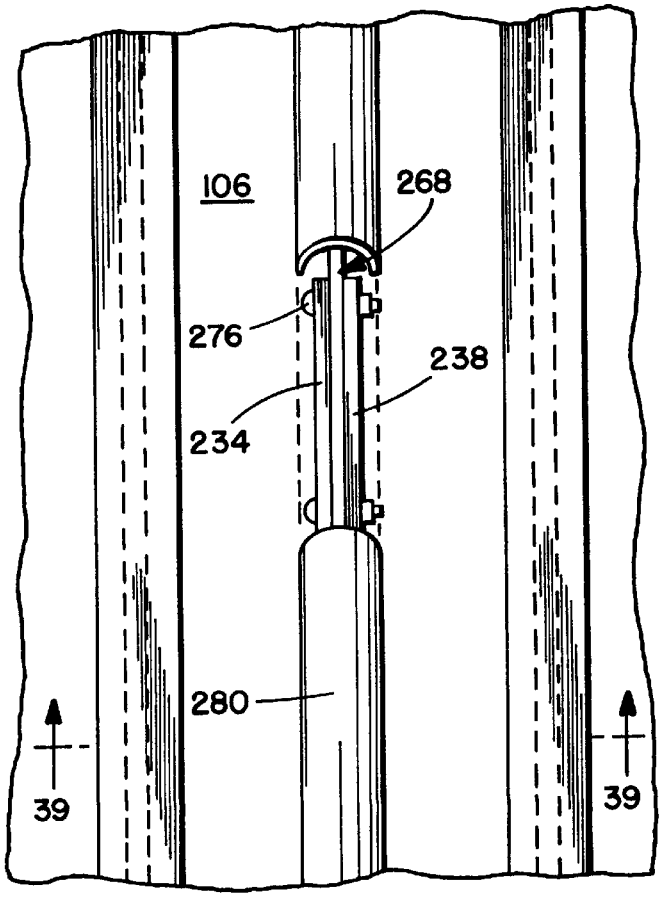
FIG. 38 is a view taken generally along line 38—38 in FIG. 37.
Figure 39:
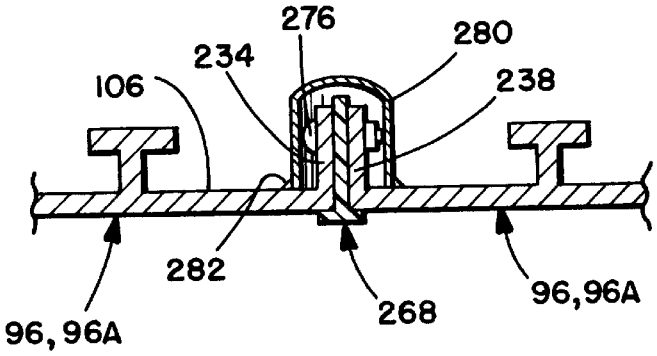
FIG. 39 is a cross sectional view taken generally along line 39—39 in FIG. 38.

In still another embodiment, turning now to FIGS. 37–39, a joint cover 280 having a U-shaped cross section is fixedly attached, as by welded joints 282, to the inner peripheral surfaces 106, respectively, of the tubular tunnel sections 96, 96A and encapsulates the fastened peripheral flanges 234, 238 therein. Although the joint cover 280 is illustrated in combination with the joint construction of FIG. 35B, and would more properly be so used, it may also be used to good effect with the welded joint of FIG. 35C or with some other suitable joint to insure the watertight integrity of the resulting underwater tunnel system.

In yet another embodiment, turning now to FIGS. 32, 40A, 40B, 40C, 41 and 41A, another technique will now be described to form the watertight joint at the interface between the facing mounting ends 92A, 94A. In this instance, the mounting ends 92A, 94A will be drawn together generally in the manner described above with the aid of FIGS. 28–31 and 34. However, in this instance, whereas the peripheral flanges 234, 238 has an inner diameter which extends inwardly beyond the inner peripheral surfaces 106 of the tubular tunnel sections, they are, at best in this instance, flush with the inner peripheral surfaces. An inner sleeve member 284 coaxial with the tubular tunnel sections 96, 96A and their respective mounting ends 92A, 94A, is slidably received on the mounting end 92A. It is axially movable between an initial position spaced from the peripheral flanges 234A, 238A in a direction away from the facing peripheral flange 234A and a final position overlying the inner surfaces 106 of both adjoining tubular tunnel sections adjacent the peripheral flanges.

Figure 32:
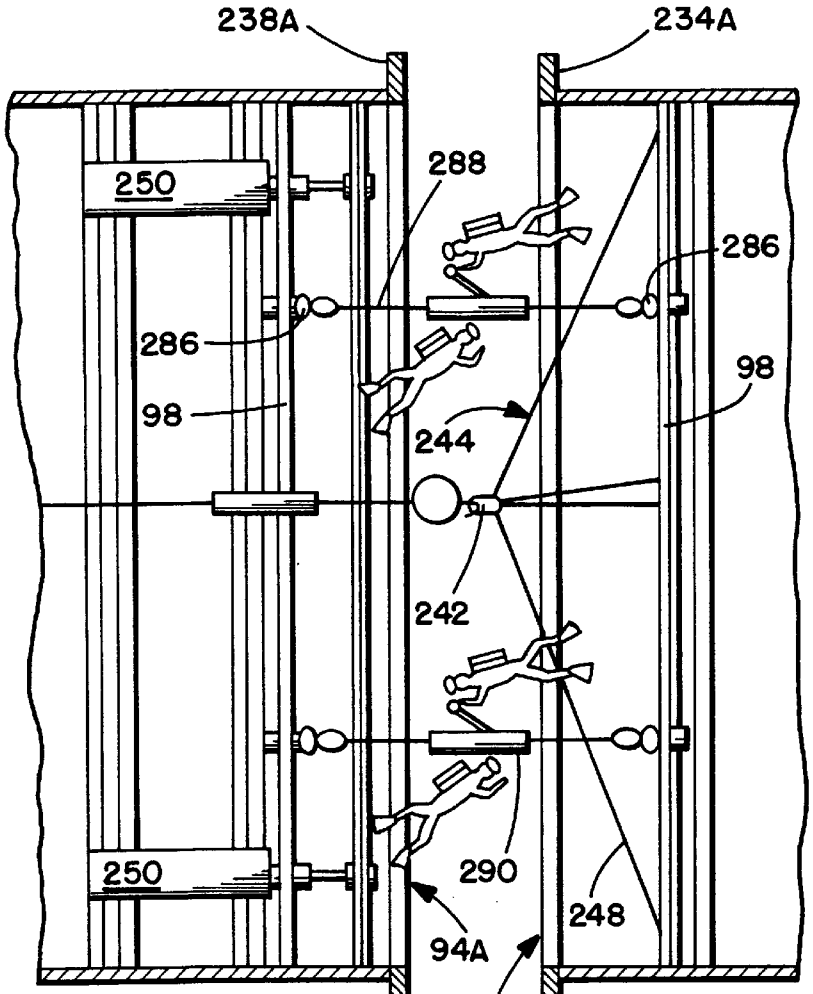
FIG. 32 is a detail side elevational view illustrating opposed mounting ends of a pair of tubular tunnel sections lying, respectively, in parallel proximately spaced planes in a preliminary pre-closure orientation and awaiting movement performed by one manner of operation to a final position in an abutting relationship.
Figure 40A:
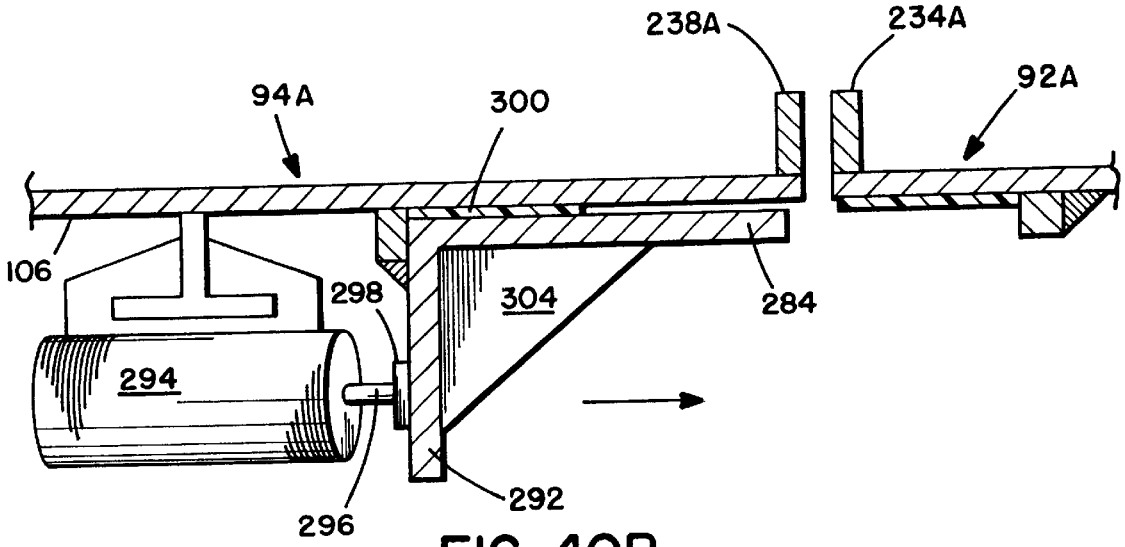
FIGS. 40A, 40B, and 40C are detail cross sectional views of components illustrated along lines 40A—40A, 40B—40B and 40C—40C, respectively in FIG. 32 and depicting successive relative positions of the components.
Figure 40B:
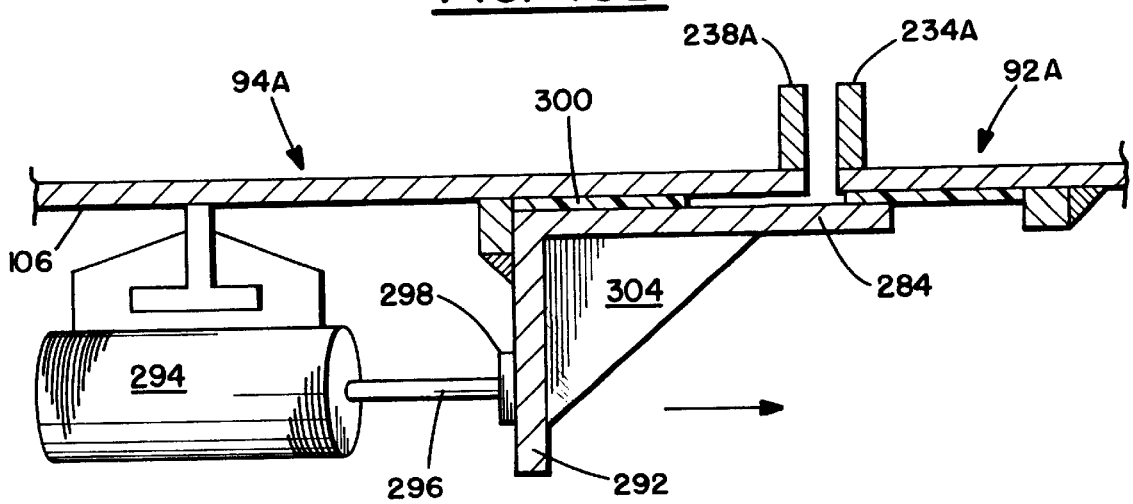
Figure 40C:
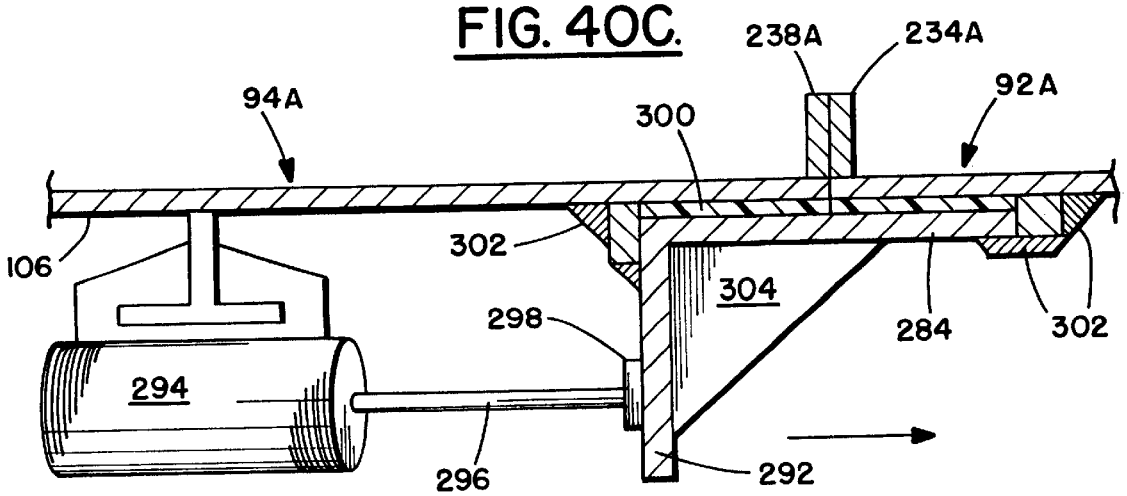
Figure 41:
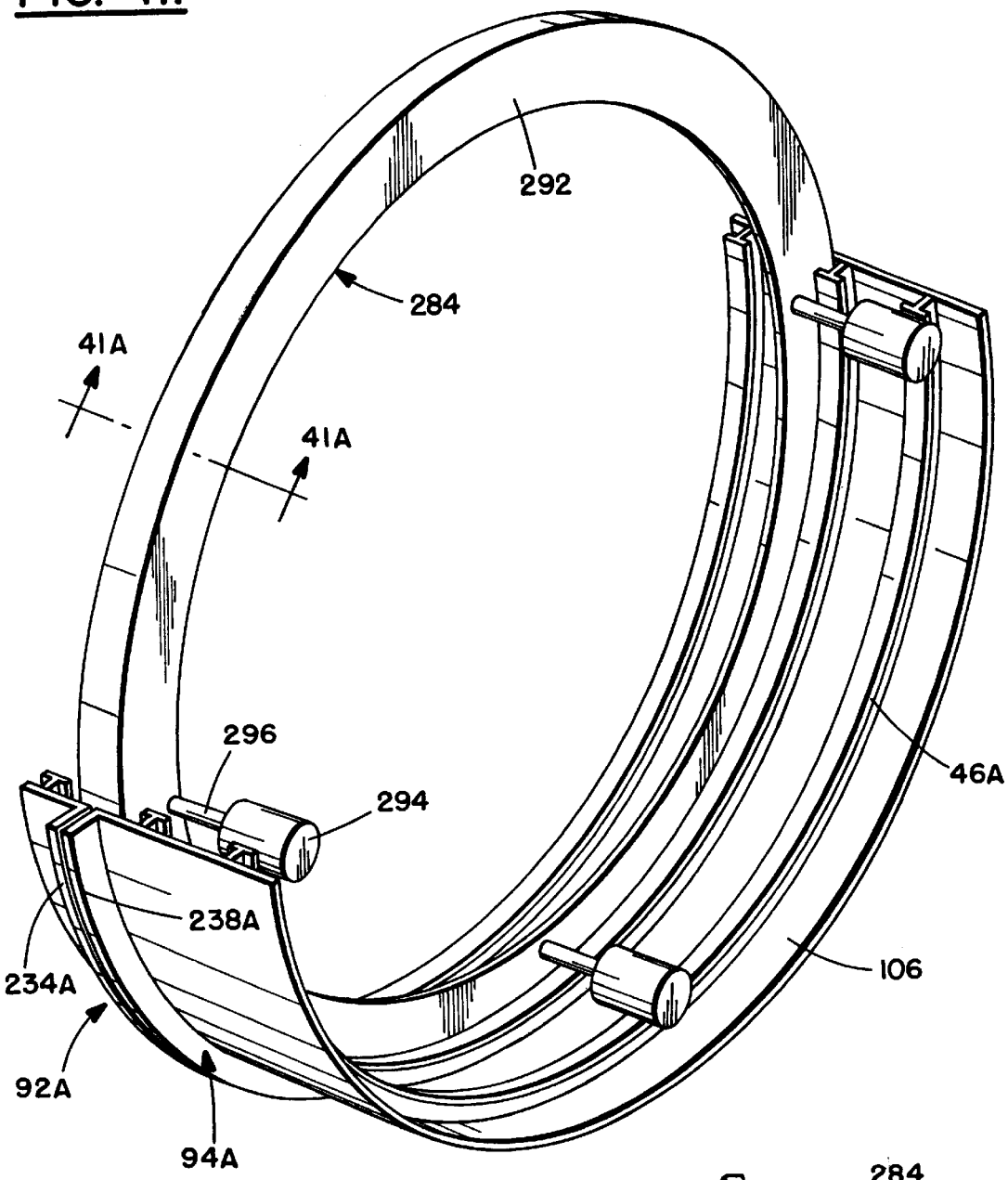
FIG. 41 is an exploded perspective view of components illustrated in FIG. 32.
Figure 41A:
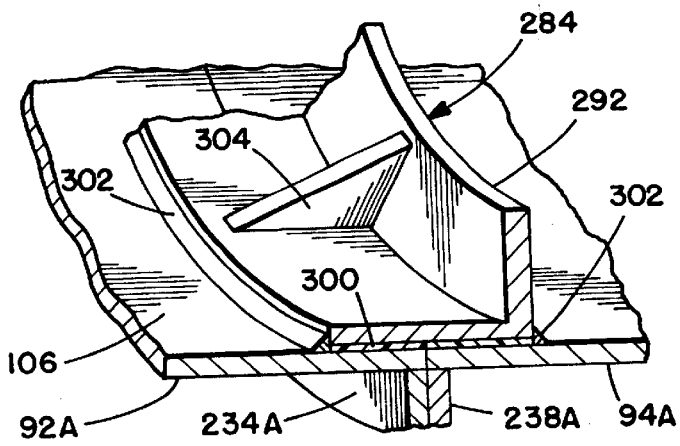
FIG. 41A is a detail perspective view, enlarged, of components illustrated along 41A—41A in FIG. 41.

When the opposed mounting ends 92A, 94A achieve the preliminary pre-closure orientation lying, respectively, in parallel proximately spaced planes as illustrated in FIG. 32. An operative mechanism is employed for drawing the peripheral flanges 234A, 238A from the preliminary pre-closure orientation (FIG. 32) to the final position in an abutting relationship (FIGS. 41, 41A). This operative mechanism includes a plurality of padeyes 286 (FIG. 32) which are integral with the opposed bulkhead closures 98, respectively, at a plurality of peripherally spaced locations, a plurality of pull cables 288, and a plurality of "comealongs" 290, which is submarine construction yard terminology for a lever operated chain hoist, or equivalent, mechanism. Each pull cable 288 is releasably attached at its opposite ends to each opposed pair of the padeyes 286 on the bulkhead closures 98 and a comealong 290 is suitably mounted on each of the pull cables; intermediate its opposed ends. The comealongs 290, which are cable shortening mechanisms used for drawing the bulkhead closures 98 together, are operable in unison to draw together the peripheral flanges 234A, 238A into the abutting relationship of FIGS. 40C, 41 and 41A.

The inner sleeve member 284 includes an integral annular flange 292 and a plurality of actuators 294 are mounted on structural rings 46A nearest the mounting ends 94A and positioned at peripherally spaced locations in their associated tubular tunnel section. Each of the actuators 294 has an actuating rod 296 which is generally parallel to the longitudinal axes of the tubular tunnel sections and extends to a terminal end 298 distant from its actuator and engageable with the annular flange 292. The actuators are operative to push the annular flange 292 to advance the inner sleeve member from an initial position (FIG. 40A) through an intermediate position (FIG. 40B) to a final position (FIG. 40C).

Preferably, a resilient annular sliding pad 300 is interposed between the inner sleeve member 284 and the inner surfaces 106 of both of the tubular tunnel sections adjacent the peripheral flanges 234A, 238A to minimize friction. When the inner sleeve member 284 has been moved to the position illustrated in FIGS. 40C and 41A, continuous welds 302 are applied at an interface between the inner sleeve member 284 and the inner peripheral surface 106. A plurality of triangular shaped gussets 304 or other suitable strengthening members may be welded, for example, at 15° spaced intervals to, and extend between, the annular flange 292 and the inner sleeve member 284.

Once the initial joining operation is completed for either join sequence with the use, typically, of either four or eight hydraulic piston cylinders as the actuators 250 and 294, the internal region is pumped out and final attachment methods are accomplished. As mentioned above, the pull concept, especially of FIGS. 33, 35, and 36, utilizes a barrier member 268 of T-shaped cross section and of suitable thermoplastic material positioned between the opposed peripheral flanges 234, 238 which functions as a barrier to water intrusion. The barrier member may be manufactured in specified are segments and can be installed during the construction assembly process of completing the tubular tunnel section. Once closure has been achieved by operation of the fasteners 276 on the flanges 234, 238 and through the barrier member 268, the U-shaped (in cross section) joint cover 280 is welded into place overlapping the joint to (1) eliminate any water intrusion through the joint ring and (2) provides flexural support during buoyancy/dynamic tubular tunnel section movement conditions.

For the installation of the section insert 206 which is the final tubular section to be installed, turn now to FIGS. 26, 26A, and 26B. In this instance, the section insert 206 incorporates an integral semi-circular upper segment barrier member 268A and the adjoining tubular tunnel sections, either 96, 96A or 28, 30 having a mating semi-circular lower segment barrier member 268B. Upon descent of the section insert 206 to its final resting position, the terminal ends 269 of the barrier members 268A and 268B abut one another to provide full closure and watertight integrity of the system.

Also, as noted above, the push concept, especially of FIGS. 32, 40A, 40B, 40C, 41 and 41A, utilizes a sliding pad 300 of thermoplastic material that provides a bearing/sliding surface for the inner sleeve member 284 to move into its adjoining tubular tunnel section so as to overlap by about nine inches (9") in each tubular tunnel section. Once moved into its final position, the inner sleeve member may be rigidly welded at a plurality of weld locations to the inner peripheral surfaces 106 of each adjoining tubular tunnel section. Any temporary hydraulic devices are removed once the join is completed, where the holding bulkhead closure penetrations will be blanked off if sudden flooding occurs. A temporary pump installation may be located in close proximity to the bulkhead closures and would be utilized to pump water out from between bulkheads during the joining sequence just described. Once the water is pumped out, the joining process is complete, and any divers remaining would exit through an upper bulkhead closure hatch 306. The bulkhead closure plating is removed to provide open access for connecting systems and extending the roadways in unison once watertight integrity is insured.

The invention also requires external structural support and restraint expedients in the area of the inclined tubular tunnel section at specific locations to insure structural integrity during adverse loading conditions. This underwater foundation system can utilize several different concepts to secure tunnel sections as follows:

(a) concrete support base 332 where the tubular tunnel section bottom rests directly on a concrete layer 320 and is attached directly by either mechanical or cable hardware to be described;

(b) upright piling 310, driven deep into the seabed 312 of the body of water 26, will align with tunnel attachment hardware located at the main axis area. The mechanical hardware attachment system can utilize a bottom saddle type support cross member, if needed; and (c) tether cables 314 secured to the hull plating for each tubular tunnel section at inclined angles from isolated restraint areas at equally spaced locations.

Figure 2A:
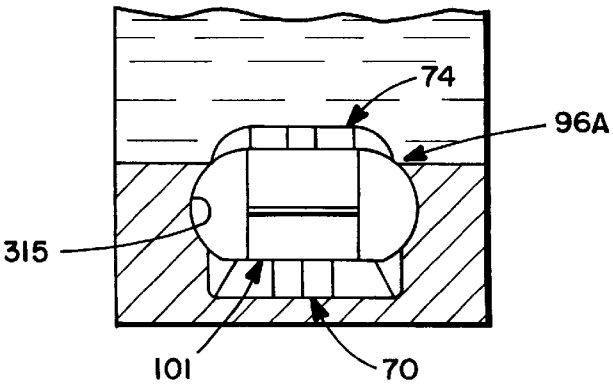
FIG. 2A is a cross section view taken generally along line 2A—2A in FIG. 2.

Turning now to FIGS. 1–4, 9, and 42–45, and in keeping with the invention, a variety of restraint systems for restricting movement of the underwater tunnel system 20 within predetermined limits will now be described. One instance in which no restraint system is needed is illustrated in FIG. 2A. Because of the minimal depth of the body of water 26 in this instance, it is necessary to excavate a channel 315 partly into the seabed 312 in order to maintain the level attitude of the underwater tunnel system 20 which accommodates the draft of vessels traveling on the surface of the body of water 26.

Figure 3A:
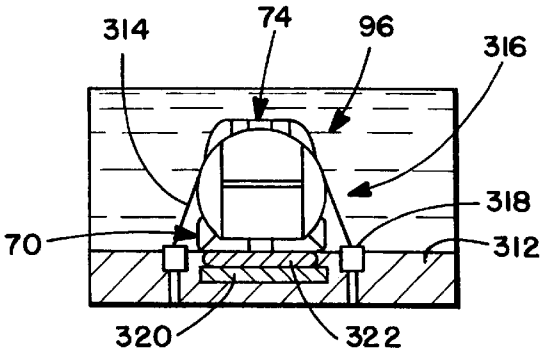
FIG. 3A is a cross section view taken generally along line 3A—3A in FIG. 3.
Figure 42:
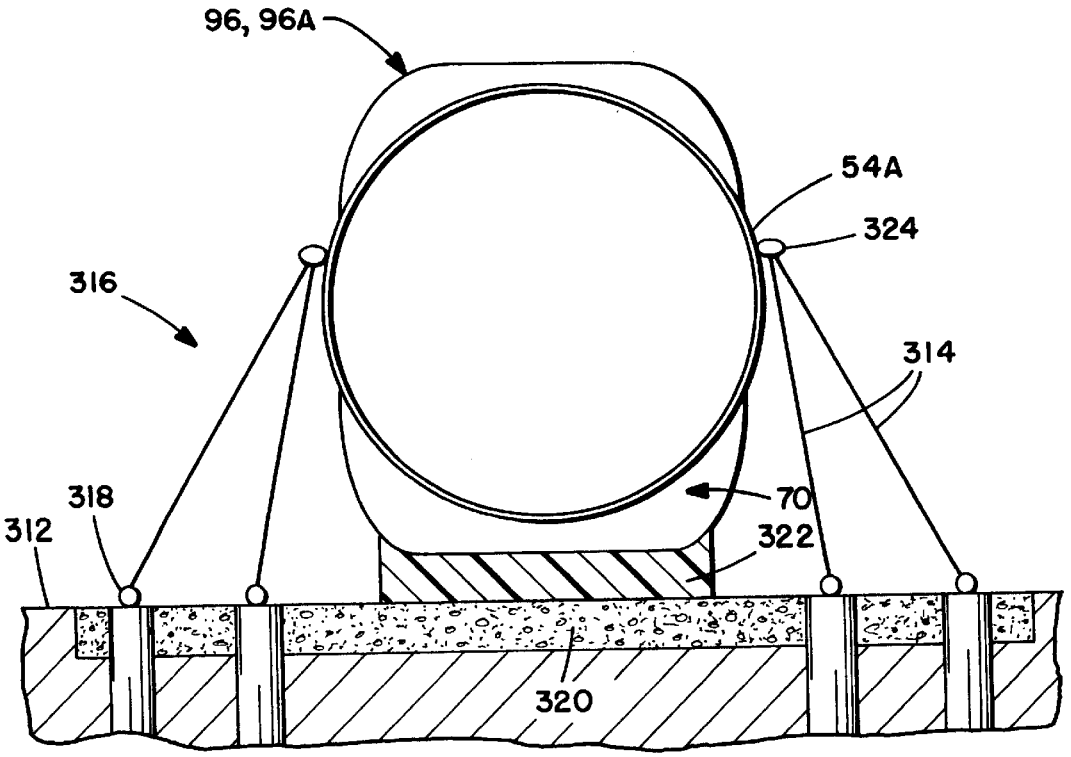
FIG. 42 is a cross section view taken through a tubular tunnel section illustrating a restraint system for mounting it firmly on the bottom of the body of water.
Figure 42A:
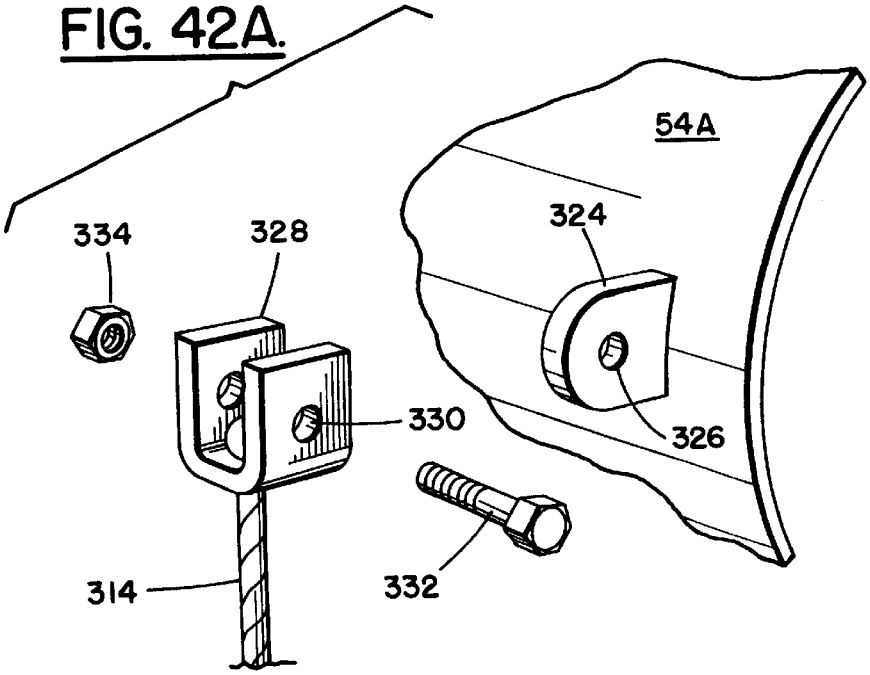

With particular attention now to FIGS. 3A and 42, a restraint system 316 includes an anchor device 318 which is embedded in the seabed 312 or bottom of the body of water adjacent a tubular tunnel section. In this instance, the tubular tunnel section 96, 96A is in relatively shallow water or, at least, is supported on the seabed 312. For this purpose, it might be desirable to prepare the surface on which the tubular tunnel section rests by providing a bottom concrete layer 320 and, over that, a support base 322 for supporting the bottom support tank structure 70. Suitable fittings 324 are provided that are integral with the hull plating 54A of the tubular tunnel section and the tether cables 314 have opposed ends attached, respectively, to the anchors 318 and to the fittings and extend therebetween. As seen in FIG. 42A, the fitting 324 may be an outwardly projecting ear with a mounting hole 326 therethrough and the tether cables 314 may each have a yoke 328 with opposed mounting holes 330. When the mounting holes 330 are aligned with the mounting hole 326 of the fitting 324, a screw fastener 332 is fully inserted and a nut 334 threaded onto the screw fastener and tightened until firm attachment is achieved. A similar construction may be provided at the anchor 318.

Figure 43:
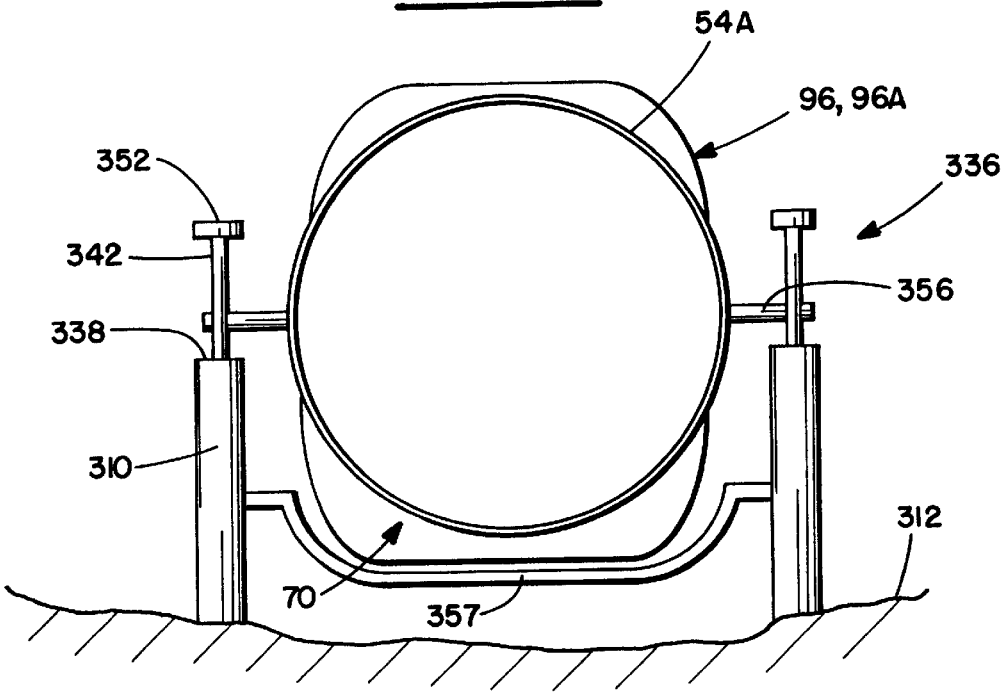
FIG. 43 is a cross section view taken through a tubular tunnel section illustrating a restraint system for mounting it near to the bottom of the body of water but permitting vertical movement within limits.
Figure 45:
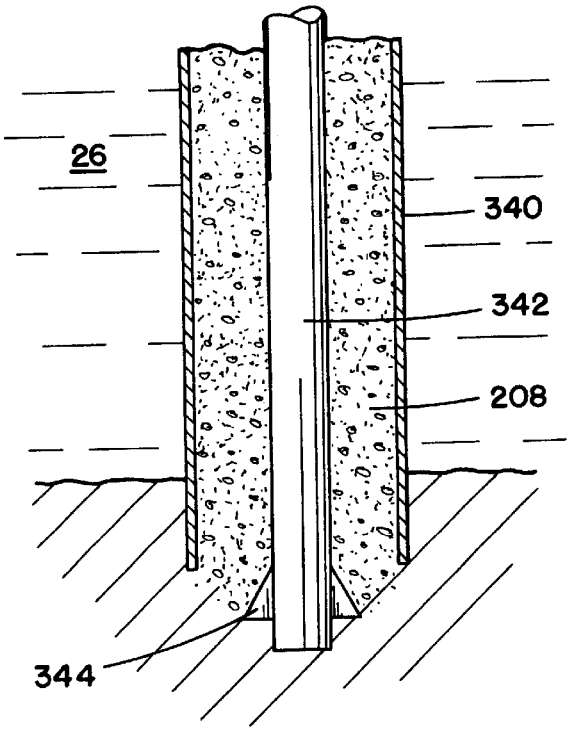
FIG. 45 is a detail elevation view, partly in section, illustrating some components of FIG. 44 in greater detail.
Figure 44:
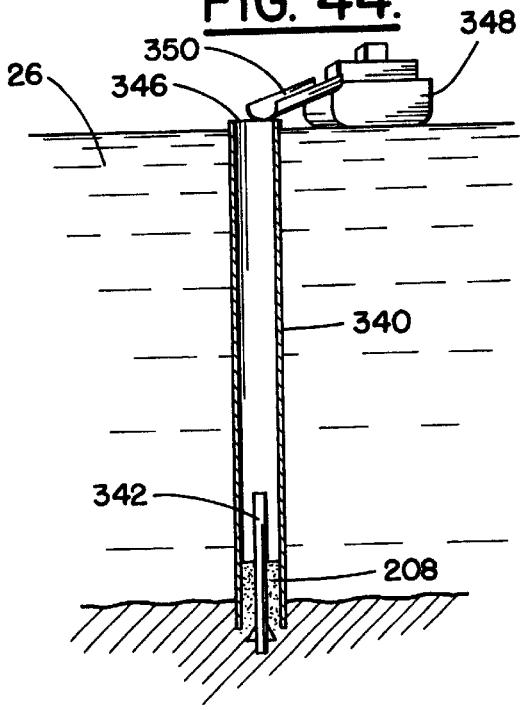
FIG. 44 is an elevation view, partly in section, illustrating a manner of constructing an upright piling for use by two types of restraint systems disclosed herein.

In another instance, viewing FIGS. 43–45, a restraint system 336 is provided for supporting the tubular tunnel section 96, 96A a moderate height above the seabed 312 or bottom 312 of the body of water. The restraint system 336 includes the upright piling 310 embedded in the seabed 312 adjacent the tubular tunnel section, as with the preceding restraint system, and extending to an uppermost end 338. To this end, as seen in FIGS. 44 and 45, a tubular form 340 of any suitable water impervious material is caused to be firmly embedded into the seabed 312 or bottom of the body of water 26. Preferably, the tubular form extends a substantial distance into the seabed 312 and some of the seabed inside the tubular form will have been removed. The tubular form is coaxial with an upright pylon rod 342 also embedded in the seabed 312 and preferably with integral fins 344 (FIG. 45) to aid in improving the strength of the restraint system 336. As depicted in FIG. 44, the tubular form 340 extends to an upper end 346 which is above the surface of the body of water. Concrete 208 can be introduced through the upper end 346 of the tubular form from a utility boat 348 through a trough 350. The concrete 208 forms about the upright pylon rod 342 up to the uppermost end 338 which is, in effect, an enlarged lower stop member. The upright pylon rod 342 extends up to an enlarged upper stop member 352 fixed to its uppermost end at a location spaced from the uppermost end 338 of the upright piling 310.

A bifurcated guide member 354 is (FIGS. 1 and 9) is slidably engaged with the upright rod and a laterally extending guide arm 356 is fixed at one end to the hull plating 54A of the tubular tunnel section 96, 96A and at an opposite end to the bifurcated guide member. With this construction, engagement of the bifurcated guide member 354 with the enlarged upper stop member 352 defines the uppermost limit of travel of the tubular tunnel section and engagement of the bifurcated guide member with the enlarged lower stop member 338 defines the lowermost limit of travel of the tubular tunnel section.

As seen in FIG. 43, the restraint system 336 may also include a saddle member 357 extending between and fixed to the upright piling 310 and underlying the elongated bottom support tank structure such that engagement of the elongated bottom support tank structure with the saddle member defines the lowermost limit of travel of the tubular tunnel section.

Figure 3B:
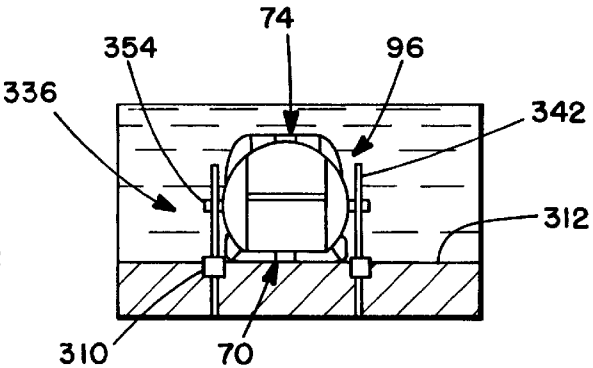
FIG. 3B is a cross section view taken generally along line 3B—3B in FIG. 3.

As seen in FIG. 3B, the restraint system 336 may be utilized in the instance that the tubular tunnel section rests relatively squarely on the seabed 312.

Figure 4A:
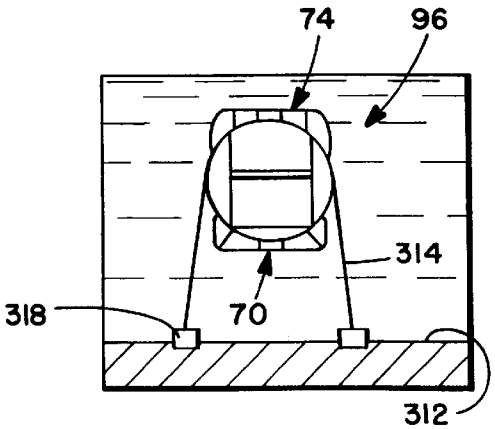
FIG. 4A is a cross section view taken generally along line 4A—4A in FIG. 4.

In the deepest water in which the underwater tunnel system 20 would be installed, a restraint system may be employed which would be similar to the system 316 of FIG. 42 insofar as the anchors 318, fittings 324, and tether cables 314 are concerned. This construction is best illustrated in FIGS. 4 and 4A. In this instance, the compensating piping/valve station 148 would preferably be operable for positive control of the buoyancy of the tubular tunnel sections to compensate for the flow of vehicular traffic through the tunnel system.

Figure 4B:
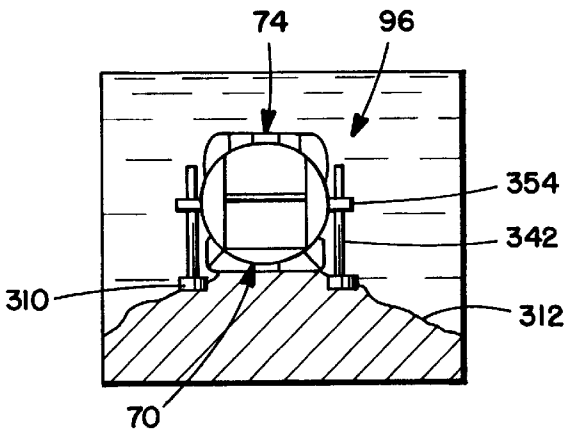
FIG. 4B is a cross section view taken generally along line 4B—4B in FIG. 4.

In those instances in which the seabed 312 rises dramatically, as illustrated in FIG. 4B, the tubular tunnel section may rest relatively squarely on the seabed in a manner similar to the situation depicted in FIG. 3B.

The invention will be exposed to three different environmental loading activities which may require specific design attributes to insure structural integrity:

(1) The seismic loading conditions caused by earthquakes or tremors will predominantly not affect the submerged buoyant tubular tunnel sections as surrounding water will act as a dampening medium. The stationary inclined tubular tunnel sections are to be permanently attached to the land mass transition area which will require energy absorbing materials and design attributes. The interface between the ventilation transition buildings 154 and the tubular tunnel sections provide for a sliding roadway slip joint to permit longitudinal and lateral movement within the prescribed requirements to satisfy the areas seismic loading conditions.

(2) The marine environmental loading conditions caused by waves, tidal action and changes in water composition will be accommodated by maintaining an external structural support system which can secure the tunnel in place. The open water submerged buoyant tunnel (Type III) at times can be located at a sufficient depth to minimize or eliminate typical tidal action. The inclined tubular tunnel section in proximity to the land-mass transition area must be structurally secured based upon the impact of hurricane, typhoon and other types of water generated force levels. temperature changes must be accounted for within the material expansion and contraction changes for the overall tubular tunnel sections. The cylinder joining areas that utilize non-metallic materials shall provide sufficient elasticity to accommodate these temperature changes.

Preferably, the invention will utilize an epoxy based painting system to maximize hull corrosion protection for the underwater tunnel system 20. The paint system will be protected from the ballast material 118 by placing a plastic or rubber coating material over the paint system. The flow and/or placement of the ballast material 118 will move easily over this protective coating material. The internal hull cylinder area between bulkhead closures and tank/frame bay envelopes will also be preserved by utilizing a marine epoxy-based paint system, or equivalent, to prevent any internal corrosion. It is anticipated that marine growth will occur on the external hull cylinder and tank structure surfaces which function to minimize, retard or prevent corrosion from manifesting itself in this predominantly static marine environment.

In recapitulation, this invention relates to the design, construction and installation of a submerged, floatable underwater tunnel system of large diameter and length for use by vehicular, including rail, traffic. The invention utilizes submarine technology to provide specific modes of construction and buoyancy capabilities which can be adjusted to meet desired depths and conditions. The buoyancy capability derives from tanks which can be internal and/or external and pumps which operate by a self-compensating system. The buoyancy capabilities utilized are: positive buoyancy, that is, floating, utilized during fabrication, assembly, and transport phases; negative buoyancy (submergence) for underwater cylinder joining; and relative controlled buoyancy (slightly positive) for final outfitting. These three conditions occur prior to the operational phase of the underwater tunnel system. The final operational weighted configuration for the underwater tunnel system 20 utilizes a slightly positive buoyancy which is neutralized by the weight of the dynamic traffic flow. The controlled/external tank compensation system can also be utilized as necessary to maintain a specified balance which accounts for minimal reduced stress factors exerted upon the tunnel boundary. The 'dual use' concept of the internal tank configuration is first utilized for flooding to create a submergence condition for the tunnel sections. Once the tubular tunnel sections are permanently secured, then the second use of the tank configuration is changed to function as the boundary for ventilation flow throughout the tunnel sections.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. An underwater tunnel system for vehicular traffic connecting first and second shores of opposed land masses separated by a body of water, said underwater tunnel system using submarine manufacturing technology, comprising:

a first watertight elongated inclined stationary tubular tunnel section for ingress into and egress from said underwater tunnel system of the vehicular traffic traveling through said underwater tunnel system, said first inclined stationary tubular tunnel section being embedded into the first shore, extending transverse of the shoreline and into the body of water and having a land-based proximal end and a distal end immersed in the body of water at a predetermined depth at a location distant from the first shore;

a second watertight elongated inclined stationary tubular tunnel section for ingress into and egress from said underwater tunnel system of the vehicular traffic traveling through said underwater tunnel system, said second inclined stationary tubular tunnel section being embedded into the second shore and extending transverse of the shoreline and into the body of water and having a land-based proximal end and a distal end immersed in the body of water at a predetermined depth at a location distant from the second shore, the longitudinal axis of said second inclined stationary tubular tunnel section being generally aligned with the longitudinal axis of the first inclined stationary tubular tunnel section;

a plurality of elongated watertight intermediate tubular tunnel sections, each of said intermediate tubular tunnel sections extending between opposed ends and having a longitudinal axis;

each of said first and second inclined stationary tubular tunnel sections and of said intermediate tubular tunnel sections being constructed using the submarine manufacturing technology without need of external fixed structures otherwise necessary to provide a watertight boundary for joining the tubular tunnel sections together; and watertight joint means joining together said opposed ends of said intermediate tubular tunnel sections and joining said distal ends of said first and second inclined stationary tubular tunnel sections to associated ones of said ends of said intermediate tubular tunnel sections such that the longitudinal axes of said first and second inclined stationary tubular tunnel sections and of said intermediate tubular tunnel sections are substantially aligned.

2. An underwater tunnel system as set forth in claim 1 wherein each of said tubular tunnel sections comprises:

a plurality of coaxial endless structural rings lying in parallel spaced apart planes extending between first and second ends;

a plurality of hull plate members overlying said plurality of structural rings and fixed thereto;

said plurality of structural rings and said hull plate members together defining a pressure hull having a hull bottom and a hull topside;

a first bulkhead closure fixed to one of said structural rings at said first end;

a second bulkhead closure fixed to one of said structural rings at said second end;

an elongated bottom support tank structure extending substantially between said first and second ends and mounted to said pressure hull at said hull bottom; and an elongated topside support structure extending substantially between said first and second ends and mounted to said pressure hull at said hull topside.

3. An underwater tunnel system as set forth in claim 2 wherein a plurality of said tubular tunnel sections are initially buoyant in a body of water; and wherein each of said tubular tunnel sections includes:

a plurality of structurally defined internal fluid tanks; and means for filling said fluid tanks with water for causing said tubular tunnel section to descend into the body of water to a predetermined depth.

4. An underwater tunnel system as set forth in claim 3 wherein a plurality of said tubular tunnel sections are initially buoyant in a body of water; and wherein each of said tubular tunnel sections includes a plurality of structurally defined internal fluid tanks;

wherein said elongated topside support structure includes a buoyancy compensating tank; and including:

means for filling said buoyancy compensating tank and said internal fluid tanks with water for causing each of said tubular tunnel sections to descend into the body of water to a predetermined depth.

5. An underwater tunnel system as set forth in claim 3 including:

partition means for dividing each of said internal fluid tanks into an air flow compartment and a water flow compartment isolated from said air flow compartment;

said internal fluid tanks of adjoining ones of said tubular tunnel sections being joined to create continuous air flow duct means from a plurality of adjoining ones of said air flow compartments and continuous water flow duct means from a plurality of adjoining ones of said water flow compartments.

6. An underwater tunnel system as set forth in claim 5 including:

land-based ventilation transition means at the first and second shores, respectively, for introducing fresh air into said underwater tunnel system and for exhausting stale air from said underwater tunnel system;

a plurality of inlet means between said air flow duct means and the interior of each of said tubular tunnel sections at longitudinally spaced locations; said air flow duct means including fresh air duct means connecting said inlet means and said land-based ventilation transition means; and a plurality of outlet means between said air flow ducts and the interior of each of said tubular tunnel sections at longitudinally spaced locations; and said air flow duct means including stale air duct means connecting said outlet means and said land-based ventilation means.

7. An underwater tunnel system as set forth in claim 5 including:

land-based ventilation transition means at the first and second shores, respectively, for introducing fresh air into said underwater tunnel system and for exhausting stale air from said underwater tunnel system;

intermediate exhaust ventilation means mounted on said underwater tunnel system distant from the first and second shores for providing exhaust ventilation to the underwater tunnel system;

a plurality of inlet means between said air flow duct means and the interior of each of said tubular tunnel sections at longitudinally spaced locations; said air flow duct means including fresh air duct means connecting said inlet means and said land-based ventilation transition means; and a plurality of outlet means between said air flow ducts and the interior of each of said tubular tunnel sections at longitudinally spaced locations; and said air flow duct means including stale air duct means connecting said outlet means both to said land-based ventilation transistor means and to said intermediate exhaust ventilation means.

8. An underwater tunnel system as set forth in claim 2 wherein at least one of said tubular tunnel sections includes intermediate exhaust ventilation means for providing exhaust ventilation to the underwater tunnel system.

9. An underwater tunnel system as set forth in claim 8 wherein said intermediate exhaust ventilation means includes:

a logistic access trunk located intermediate said first and second ends in said elongated topside support structure for each tubular tunnel section;

an external ventilation exhaust cylinder mounted on said tubular tunnel section at said logistic access trunk and extending upwardly therefrom;

a plurality of outlet means adjacent to the interior of each of said tubular tunnel sections at longitudinally spaced locations;

stale air duct means connecting said outlet means both to said land-based ventilation transition means and to said intermediate exhaust ventilation means; and exhaust fan means between said stale air duct means and said logistic access trunk for the flow of stale air from the interior of said tubular tunnel section to and through said external ventilation exhaust cylinder.

10. An underwater tunnel system as set forth in claim 9 wherein said external ventilation exhaust cylinder extends between an entry end and an exhaust end and is telescopable between a lowered position whereat said exhaust end is nearest said logistic access trunk and a raised position whereat said exhaust end is farthest away from said logistic access trunk.

11. An underwater tunnel system as set forth in claim 2 including:

restraint means for restricting movement of the underwater tunnel system within predetermined limits.

12. An underwater tunnel system as set forth in claim 11 wherein said restraint means includes:

anchor means embedded in the bottom of the body of water adjacent said underwater tunnel system;

fitting means integral with said pressure hull of at least one of said tubular tunnel sections; and cable means having opposed ends attached, respectively, to said anchor means and to said fitting means and extending therebetween.

13. An underwater tunnel system as set forth in claim 11 wherein said restraint means includes:

anchor means embedded in the bottom of the body of water adjacent said underwater tunnel system on opposite sides thereof;

fitting means integral with said pressure hull of at least one of said tubular tunnel sections; and cable means having opposed ends attached, respectively, to said anchor means and said fitting means and extending therebetween.

14. An underwater tunnel system as set forth in claim 11 wherein said restraint means includes:

upright piling means embedded in the bottom of the body of water adjacent said underwater tunnel system and extending to an uppermost end;

an enlarged upper stop member fixed to said uppermost end of said upright piling means;

an enlarged lower stop member integral with said upright piling means at a location spaced from said uppermost end thereof;

bifurcated guide means slidably engaged with said upright piling means; and a laterally extending guide arm fixed at one end to said pressure hull of at least one of said tubular tunnel sections and at an opposite end to said bifurcated guide means;

whereby engagement of said bifurcated guide means with said enlarged upper stop member defines the uppermost limit of travel of said tubular tunnel section and engagement of said bifurcated guide means with said enlarged lower stop member defines the lowermost limit of travel of said tubular tunnel section.

15. An underwater tunnel system as set forth in claim 11 wherein said restraint means includes:

upright piling means embedded in the bottom of the body of water adjacent said underwater tunnel system on opposite sides thereof and extending to an uppermost end;

an enlarged upper stop member fixed to said uppermost end of each of said upright piling means;

an enlarged lower stop member integral with each of said upright piling means at a location spaced from said uppermost end thereof;

bifurcated guide means slidably engaged with each of said upright piling means; and laterally extending guide arms fixed at one end, respectively, to opposite sides of said pressure hull of at least one of said tubular tunnel sections and at opposite ends thereof to said bifurcated guide means;

whereby engagement of each said bifurcated guide means with its associated said enlarged upper stop member defines the uppermost limit of travel of said tubular tunnel section and engagement of each of said bifurcated guide means with its associated said enlarged lower stop member defines the lowermost limit of travel of said tubular tunnel section.

16. An underwater tunnel system as set forth in claim 11 wherein said restraint means includes:

upright piling means embedded in the bottom of the body of water adjacent said underwater tunnel system on opposite sides thereof and extending to and uppermost end; and saddle means extending between and fixed to said upright piling means and underlying said elongated bottom support tank structure;

whereby engagement of said elongated bottom support tank structure with said saddle means defines the lowermost limit of travel of said tubular tunnel section.

17. An underwater tunnel system as set forth in claim 2 wherein said watertight joint means includes:

first and second facing mounting ends at opposed ends of first and second tubular tunnel sections, respectively;

said first mounting end including a first peripheral flange having a plurality of peripherally spaced positioning holes therein;

said second mounting end including a second peripheral flange having a plurality of peripherally spaced longitudinally projecting positioning pins generally aligned with the positioning holes of said first peripheral flange when said first and second tubular tunnel sections are substantially aligned; and including:

operative means for drawing said first and second peripheral flanges into a preliminary pre-closure orientation lying, respectively, in parallel proximately spaced planes.

18. An underwater tunnel system as set forth in claim 17 wherein said operative means includes:

winch means within said first tubular tunnel section adjacent said bulkhead closure at said first mounting end, said bulkhead closure having a centrally positioned watertight stuffing tube therein;

coupling means intermediate said first and second facing mounting ends;

harness means attached, respectively, to said annular flange and to said coupling means; and a tension line attached at one end to said winch means, extending through said centrally positioned watertight stuffing tube in said bulkhead closure at said first mounting end, and removably attached at an opposite end to said coupling means;

said winch means being operable through said tension line and said harness means to draw said opposed annular flanges together into the preliminary preclosure orientation.

19. An underwater tunnel system as set forth in claim 18 wherein said coupling means includes a closure ring member; and wherein said harness means includes a plurality of individual leads, each of said leads extending between first and second ends, said leads being attached at said first ends to said annular flange of said second mounting end at peripherally spaced locations and at said second ends to said closure ring member.

20. An underwater tunnel system as set forth in claim 17 including:

actuating means for drawing together said first and second peripheral flanges into abutting relationship for subsequent fastening.

21. An underwater tunnel system as set forth in claim 20 wherein said actuating means includes:

a plurality of actuators having actuating rods generally parallel to the longitudinal axes of said first and second tubular tunnel sections and extending to terminal ends distant from said actuators, said actuators positioned at peripherally spaced locations in said first tubular tunnel section;

said first and second peripheral flanges having a plurality of peripherally spaced mounting holes therethrough;

connection members releasably attached to said second peripheral flange at peripherally spaced locations generally aligned with said actuator rods, respectively; and pull cable means connecting said terminal ends of said actuator rods to said connection members;

whereby operation of said plurality of actuators is effective to draw together said first and second peripheral flanges into abutting relationship for subsequent fastening.

22. An underwater tunnel system as set forth in claim 21 including:

a welded joint for fastening together said first and second peripheral flanges.

23. An underwater tunnel system as set forth in claim 21 wherein said first and second peripheral flanges have a plurality of peripherally spaced fastening holes therein; and including:

a plurality of fasteners received in the fastening holes fixedly connecting together said first and second peripheral flanges.

24. An underwater tunnel system as set forth in claim 23 wherein said pressure hull for each of said first and second tubular tunnel sections has an outer surface; and wherein said watertight joint means includes:

a continuous resilient barrier member of T cross section having a web deformably interposed between said first and second peripheral flanges and opposed flange members proximately overlying said outer surfaces of said first and second tubular tunnel sections adjacent said first and second facing mounting ends, said web having a plurality of peripherally spaced mounting holes therethrough for reception of said fasteners.

25. An underwater tunnel system as set forth in claim 21 wherein said pressure hull for each of said first and second tubular tunnel sections has an outer surface; and wherein said watertight joint means includes:

a continuous resilient barrier member of T cross section having a web deformably interposed between said first and second peripheral flanges and opposed flange members proximately overlying said outer surfaces of said first and second tubular tunnel sections adjacent said first and second facing mounting ends.

26. An underwater tunnel system as set forth in claim 21 wherein each of said first and second tubular tunnel sections has an inner surface; and wherein said watertight joint means includes:

an internal continuous cylinder boundary cover overlying said first and second peripheral flanges; and welded joint means fixedly attaching said cover to said inner surfaces, respectively, of said first and second tubular tunnel sections and encapsulating said first and second peripheral flanges therein.

27. An underwater tunnel system as set forth in claim 2 wherein each of said first and second tubular tunnel sections has an inner surface; and wherein said watertight joint means includes:

first and second facing mounting ends at opposed ends of first and second tubular tunnel sections, respectively;

said first mounting end including a first peripheral flange having a plurality of peripherally spaced positioning holes therein;

said second mounting end including a second peripheral flange having a plurality of peripherally spaced longitudinally projecting positioning pins generally aligned with the positioning holes of said first peripheral flange when said first and second tubular tunnel sections are substantially aligned; and an inner sleeve member coaxial with said first and second tubular tunnel sections and slidably received on said first tubular tunnel section, said inner sleeve member being axially movable between an initial position spaced from said first peripheral flange in a direction away from said second peripheral flange and a final position overlying said inner surfaces of both said first and second tubular tunnel sections adjacent said first and second peripheral flanges; and including:

first operative means for drawing said first and second peripheral flanges into a preliminary pre-closure orientation lying, respectively, in parallel proximately spaced planes; and second operative means for drawing said first and second peripheral flanges from the preliminary pre-closure orientation to the final position in an abutting relationship.

28. An underwater tunnel system as set forth in claim 27 wherein said first operative means includes:

winch means within said first tubular tunnel section adjacent said bulkhead closure at said first mounting end, said bulkhead closure having a centrally positioned watertight stuffing tube therein;

coupling means intermediate said first and second facing mounting ends;

harness means attached, respectively, to said annular flange and to said coupling means; and a tension line attached at one end to said winch means, extending through said centrally positioned watertight stuffing tube in said bulkhead closure at said first mounting end, and removably attached at an opposite end to said coupling means;

said winch means being operable through said tension line and said harness means to draw said opposed annular flanges to the preliminary pre-closure orientation; and wherein said second operative means includes:

a plurality of padeyes integral with said first and second bulkhead closures, respectively, at a plurality of peripherally spaced locations;

a pull cable releasably attached at its opposite ends to each opposed pair of said padeyes on said first and second bulkheads; and a comealong on each of said pull cables intermediate said opposed ends, said comealongs being operable in unison to draw together said first and second peripheral flanges into the abutting relationship.

29. An underwater tunnel system as set forth in claim 28 wherein said coupling means includes a closure ring member; and wherein said harness means includes a plurality of individual leads, each of said leads extending between first and second ends, said leads being attached at said first ends to said annular flange of said second mounting end at peripherally spaced locations and at said second ends to said closure ring member.

30. An underwater tunnel system as set forth in claim 27 including:

actuating means for moving said inner sleeve member from the initial position to the final position.

31. An underwater tunnel system as set forth in claim 30 wherein said inner sleeve member includes an annular flange integral therewith; and wherein said actuating means includes:

a plurality of actuators having actuating rods generally parallel to the longitudinal axes of said first and second tubular tunnel sections and extending to terminal ends distant from said actuators and engageable with said annular flange, said actuators positioned at peripherally spaced locations in said first tubular tunnel section and operative to push said annular flange to advance said inner sleeve member from the initial position to the final position.

32. An underwater tunnel system as set forth in claim 31 including:

a resilient annular sliding pad interposed between said inner sleeve and said inner surfaces of both said first and second tubular tunnel sections adjacent said first and second peripheral flanges.

33. An underwater tunnel system as set forth in claim 31 including:

welded joints for fastening together said inner sleeve and said inner surfaces of both said first and second tubular tunnel sections adjacent said first and second peripheral flanges.

34. A tubular tunnel section for constructing an underwater tunnel system for vehicular traffic connecting first and second shores of opposed land masses separated by a body of water comprising:

a plurality of coaxial endless structural rings lying in parallel spaced apart planes extending between first and second ends;

a plurality of hull plate members overlying said plurality of structural rings and fixed thereto;

said plurality of structural rings and said hull plate members together defining a pressure hull having a hull bottom and a hull topside;

a first bulkhead closure fixed to one of said structural rings at said first end;

a second bulkhead closure fixed to one of said structural rings at said second end;

an elongated bottom support tank structure extending substantially between said first and second ends and mounted to said pressure hull at said hull bottom; and an elongated topside support structure extending substantially between said first and second ends and mounted to said pressure hull at said hull topside.

35. A tubular tunnel section as set forth in claim 34 including:

panel means uniformly spaced from said hull plating and extending between each pair of said structural rings defining a plurality of internal frame bay envelopes and an inner peripheral surface defining an internal compartment.

36. A tubular tunnel section as set forth in claim 35 including:

an internal longitudinally extending lower tank support structure within said pressure hull; and ballast material filling at least one of (i) said elongated bottom support tank structure, (ii) said internal longitudinally extending lower tank support structure; and (iii) the internal frame bay envelopes.

37. A tubular tunnel section as set forth in claim 35 wherein said ballast material has a density of no less than approximately 135 pounds per cubic foot.

38. A tubular tunnel section as set forth in claim 35 wherein said ballast material is at least one of concrete, slag, or lead.

39. A tubular tunnel section as set forth in claim 35 including in the interior thereof at least one of:

(i) fluid tanks, (ii) foundations, (iii) internal support structure including at least upper and lower deck levels, (iv) piping systems, (v) ventilation systems, and (vi) electrical systems.

40. A tubular tunnel section as set forth in claim 35 wherein said topside support structure includes a buoyancy compensating tank; and including:

a plurality of structurally defined fluid tanks within the internal compartment; and a plurality of temporary collapsible fluid bladders selectively supported within the internal compartment;

whereby one or more of: (i) said fluid tanks, (ii) said buoyancy compensating tank, and (iii) said temporary collapsible fluid bladders may be selectively filled with water for causing the mobile tubular tunnel section to descend to a predetermined depth generally at a level of distal ends of an inclined stationary tubular tunnel section.

41. A tubular tunnel section as set forth in claim 35 wherein said tubular tunnel section is buoyant in a body of water; and includes:

a plurality of structurally defined internal fluid tanks; and means for filling said fluid tanks with water for causing the mobile tubular tunnel section to descend to a predetermined depth.

42. A tubular tunnel section as set forth in claim 35 wherein said tubular tunnel section is buoyant in a body of water; and includes:

an elongated topside support structure including a buoyancy compensating tank, the elongated topside support structure extending the length of the mobile tubular tunnel section; and a plurality of structurally defined internal fluid tanks; and means for filling said buoyancy compensating tank and said internal fluid tanks with water for causing the mobile tubular tunnel section to descend to a predetermined depth.

43. A tubular tunnel section as set forth in claim 35 including:

partition means for dividing each of said internal fluid tanks into an air flow compartment and a water flow compartment isolated from said air flow compartment.

44. A tubular tunnel section as set forth in claim 43 including:

intermediate exhaust ventilation means for providing exhaust ventilation therefrom.

45. A tubular tunnel section as set forth in claim 44 wherein said intermediate exhaust ventilation means includes:

a logistic access trunk located intermediate said first and second ends in said elongated topside support structure;

an external ventilation exhaust cylinder mounted on said tubular tunnel section at said logistic access trunk and extending upwardly therefrom;

a plurality of outlet means adjacent to the interior of said tubular tunnel section at longitudinally spaced locations;

stale air duct means connecting said outlet means to said intermediate exhaust ventilation means for the flow of stale air from the interior of said tubular tunnel section; and exhaust fan means between said stale air duct means and said logistic access trunk for the flow of stale air from the interior of said tubular tunnel section to and through said external ventilation exhaust cylinder.

46. A tubular tunnel section as set forth in claim 43 wherein said external ventilation exhaust cylinder extends between an entry end and an exhaust end and is telescopable between a lowered position whereat said exhaust end is nearest said logistic access trunk and a raised position whereat said exhaust end is farthest away from said logistic access trunk.

* * * * *